US005111627A

United States Patent [19]

Brown

[11] Patent Number: 5,111,627

[45] Date of Patent: May 12, 1992

[54] MODULAR-ACCESSIBLE-UNITS

[76] Inventor: John G. Brown, 20205 State Line Rd., Harvard, Ill. 60033

[21] Appl. No.: 506,644

[22] Filed: Apr. 6, 1990

Related U.S. Application Data

[63] Continuation-in-part of Ser. No. 436,158, Nov. 13, 1989, abandoned, which is a continuation of Ser. No. 106,204, Oct. 5, 1987, abandoned, which is a continuation-in-part of Ser. No. 783,309, Oct. 2, 1985, Pat. No. 4,698,249, which is a continuation of Ser. No. 391,760, Jun. 24, 1982, Pat. No. 4,546,024, which is a continuation of Ser. No. 131,516, Mar. 18, 1980, abandoned, and a continuation of Ser. No. 567,151, Jan. 3, 1984, Pat. No. 4,681,786.

[51] Int. Cl.[5] ..... E04B 9/00

[52] U.S. Cl. ..... 52/126.5; 52/220

[58] Field of Search ..... 52/126.5, 126.6, 220, 52/221

[56] References Cited

U.S. PATENT DOCUMENTS

| | | | |
|---|---|---|---|
| Re. 33,220 | 5/1990 | Collier | 52/221 |
| 3,903,667 | 9/1975 | Zetlin | 52/221 |
| 4,596,095 | 6/1986 | Chalfant | 52/220 |
| 4,640,067 | 2/1987 | Hangemann | 52/220 |
| 4,676,036 | 6/1987 | Bessert | 52/221 |
| 4,773,196 | 9/1988 | Yoshida | 52/126.5 |
| 4,852,315 | 8/1989 | Fakayama | 52/220 |
| 4,883,503 | 11/1989 | Fish | 52/220 |

FOREIGN PATENT DOCUMENTS

| | | | |
|---|---|---|---|
| 2644711 | 12/1977 | Fed. Rep. of Germany | 52/220 |
| 2913959 | 6/1980 | Fed. Rep. of Germany | 52/220 |
| 8602685 | 5/1986 | World Int. Prop. O. | 52/220 |

*Primary Examiner*—Henry E. Raduazo

[57] ABSTRACT

An array of suspended structural load-bearing modular-accessible-pavers 189 comprising cast plates over a three-dimensional conductor-accommodative passage and foundation grid 161 comprising modular structural plates 162 and structural bearing supports 163, 164 or load-bearing plinths 172. The modular-accessible-pavers 189 have a tension reinforcement layer to enable them to withstand heady loads.

71 Claims, 17 Drawing Sheets

MODULAR-ACCESSIBLE-UNITS

This is a continuation-in-part of Ser. No. 436,158, filed Nov. 13, 1989 now abandoned, which is a continuation of Ser. No. 106,204, filed Oct. 5, 1987, now abandoned which is a continuation-in-part of Ser. No. 783,309, filed Oct. 2, 1985, issued Oct. 6, 1987, as U.S. Pat. No. 4,698,249, which is a continuation of Ser. No. 391,760, filed Jun. 24, 1982, issued Oct. 8, 1985, as U.S. Pat. No. 4,546,024, which is a continuation of Ser. No. 131,516, filed Mar. 18, 1980, now abandoned, and refiled Jan. 3, 1984, as a file wrapper continuation Ser. No. 567,151, issued Jul. 21, 1987, as U.S. Pat. No. 4,681,786.

This invention has been disclosed in part in International Publication No. WO 89/02961, published 6 Apr. 1989 (06.04.89) under the Patent Cooperation Treaty (PCT).

BACKGROUND OF THE INVENTION

The advent of factory automation has ushered in a new era in industry. Computer-integrated manufacturing and automated warehousing has brought new, more sophisticated requirements to the plant floor. Meshing the requirements of the forklift and the automated guided vehicle in the same workplace requires new approaches to equipment, materials, and personnel Conventional conductor management systems leave much to be desired. The present invention, however, provides accessible conductor accommodation which allows the user to meet changing needs, whether in the factory or in the office, as he copes with evolutionary unfolding change.

Prior art encompasses computer access flooring supported on fixed corner support columns and the like. The access panels are generally supported at their corners. Generally, access flooring has been composed of metal panels and sometimes covered with carpet and other flooring materials. The stability of computer access flooring has been challenged, particularly when photographs of access flooring installations taken after an earthquake reveal that the supports gave way, causing millions of dollars in equipment damage and data loss.

My own U.S. Pat. Nos. 4,546,024, 4,681,786, and 4,698,249 have certain elements in common with this invention.

There are several United States patents which deal with the polymerization of impregnated monomers by means of vacuum irradiation. They include Witt U.S. Pat. No. 4,519,174 issued May 28, 1985, Bosco U.S. Pat. No. 3,808,032 and Bell U.S. Pat. No. 3,808,030, both issued Apr. 30, 1974, Barrett U.S. Pat. No. 3,721,579 issued Mar. 20, 1973, and Welt U.S. Pat. No. 3,709,719 issued Jan. 9, 1973. Although this invention does not deal with these methods of finishing hard surface materials, this invention does deal with the use of applied wearing surface materials which have been finished by these methods.

The forces driving this invention are the development of flexible manufacturing, the electrical powering of factories, the electronic operation and computerization of factory production, the use of computer-assisted engineering, computer-assisted design, computer-assisted manufacturing, computerized numerical control, and the general automation and computerization of the factory and office workplace.

This invention is substantially different than all the known art computer access flooring disposed on corner support columns. My invention provides discretely selected special replicative accessible pattern layouts of suspended structural cast plate modular-accessible-units with biased corners shaped to accommodate combinations, such as, the following:

suspended structural modular-accessible-units plus modular accessible nodes suspended structural modular-accessible-units plus modular accessible passage nodes suspended structural modular-accessible-units plus modular accessible poke-through nodes suspended structural modular-accessible-units plus modular accessible nodes plus modular accessible passage nodes suspended structural modular-accessible-units plus modular accessible nodes plus modular accessible poke-through nodes suspended structural modular-accessible-units plus modular accessible passage nodes plus modular accessible poke-through nodes suspended structural modular-accessible-units plus modular accessible nodes plus modular accessible passage nodes plus modular accessible poke-through nodes.

The arrays of suspended structural modular-accessible-units and nodes are disposed over matrix conductors accommodated within a load-bearing three-dimensional-conductor-accommodative-passage-and-support-matrix and held in place by gravity, friction, and assemblage, and sometimes by registry, to provide shallow depth of less than 6 inches (150 mm). The modular-accessible-units comprise modular-accessible-planks, modular-accessible-pavers, modular-accessible-matrix-units, and modular-accessible-tiles which also include modular-accessible-carpets and modular-accessible-laminates.

Tile floors are desirable for many purposes, since they are easily maintained in clean condition and in a high level of appearance, and are less subject to wear than carpeted floors, where the appearance level is reduced rapidly to a generally lower level than when originally installed. Accordingly, tile floors are highly desirable for use in, for example, multi-story public and government buildings.

Ceramic, quarry, selected natural stone, and hardwood flooring, and the like, have proven capability to last centuries when properly installed, while currently these tiles installed with rigid joints more often than not have cracking of joints or penetration of the tile joints by liquids and chemicals which cause loosening of the rigid bonding of the tile to the supporting substrate, causing breaking of the tile and further loosening of adjacent tile, or acids in liquids deteriorate structural elements, such as steel reinforcement in concrete substrate, or allow unsanitary liquids to drain down on occupied spaces below.

Conventional grouts, thin-set mortars, and mortar setting beds, as well as improved conventional grouts and thin-set mortars with a variety of new type additives, are all rigid in nature, requiring a rigid substrate, wherein this rigid support depends on rigid bond and support, and such tiles are all subject to gradual penetration of liquids in varying degrees working their way through grout joints, thin-set mortars or mortar setting beds adhering the tiles, causing gradual swelling, bacterial growth, bond disintegration, which lead to gradual coming loose of tile in most installations from their horizontal base surface, and deflection of the horizontal base surface quite often causes conventional, rigidly set and rigidly grouted tiles to come loose, which uncushioned tiles easily break against their rigid substrate and adjacent tiles, causing additional disintegration of tile, whereas this invention exploits the gravity weight of the tile, friction, and accumulated-interactive-assemblage combined with the flexible joints between adjacent tiles, forming a dynamic, interactive, floating assembly with fluidtight flexible joints between adjacent tile free of penetration of fluids to the horizontal base surface below, beyond the porosity of the tile itself, which tile, if it is made of good quality clays fired at high temperature, is of very low porosity, wherein the tile is held in place by a more dependable force of gravity with a proven superior duration when compared with conventional rigid bonding means for attaching tile to a horizontal base surface, and wherein floating tiles are cushioned against breakage by a horizontal-disassociation-cushioning-layer which concurrently provides the improved impact sound isolation disassociation within a very thin combination.

As a disadvantage to the currently available tile floors in multi-story structures, those above the first floor of a building are highly transmissive to impact sound generated, for example, by the shoe heels of a person walking across the tile floor (women with spike heels and men with metal clips), or other forms of impact on the floor. The sound is transmitted to the floor below, and in the event of a heavy traffic area, such as, a restaurant, dance floor, apartment, condominium, hospital, nursing home, or the like, impact sound transmission through the floor below to occupied spaces below can be a very serious problem, requiring the installation of carpeting even when, for other reasons, carpet is undesirable or not the best answer. As a result of this, it becomes very difficult to place a dance floor, high-traffic restaurant, hospital, nursing home or apartment on an upper floor of a multi-story building since there are strong reasons or personal preferences to leave such establishments uncarpeted but, rather with hard surface, enduring floors. The occupants of the floor below may be seriously disturbed by the continuous transmission of the impact of footsteps on the tile.

Similarly, in multi-story apartments and condominiums where it is desired to keep maintenance costs to a minimum, the impact sound of footsteps and the like from the apartment overhead can generate excessive disturbing noise and a continuous series of tenant complaints, forcing the installation of carpeting, and its added expense, periodic cleaning, replacement costs, and the like.

While previous attempts have been made to produce tile coverings having high loss of impact sound from transmission to other occupied areas, particularly areas below sources of impact sound, they have not been very successful. For example, wood tiles have been placed on ½ inch (12 mm) plywood which, in turn, rests upon ¼ inch (6 mm) cork sheet lying on a wood or concrete structural subfloor. With this configuration, the sound damping has not been exceptionally high, and the problem of warping of the plywood requires the use of screws to hold the plywood in place which, in turn, helps to transmit the impact sound to the structural subfloor. Also the system is not waterproof and comes up if water is allowed to stand on its surface overnight. This invention, using waterproof materials, overcomes this disadvantage.

In accordance with this invention, a horizontal-tile-array is provided having reduced impact sound transmission through its horizontal base surface. If desired, this can be combined with improved thermal insulation or the floor supported on foam insulation, with or without a horizontal-disassociation-cushioning-layer, for impact sound isolation, and may be accomplished with a unique, dynamic system in which the tiles are resiliently carried upon the horizontal-disassociation-cushioning-layer. Tile breakage, due to the receipt of an excessive load from a spike heel or a heavy woman or the like, can be essentially controlled or dampened for good tile floor life, coupled with improved impact sound isolation.

DESCRIPTION OF THE INVENTION

A detailed review of the state of the art materially helps in differentiating the teachings of this invention from the current state of the art, in particular as to the following:

In the existing state of the art, the tile is held in place by the materials for setting ceramic tile or held in place by special products for setting ceramic tile, whereas in this invention the tile is held in place by gravity, friction, and accumulated-interactive-assemblage In the existing state of the art, the tile is installed on a rigid substrate and is fastened mechanically or by adhesives of some type, or by both, whereas in this invention the tile floats loose laid on a horizontal-disassociation-cushioning-layer, such as, the following resilient materials, by means of the above-stated gravity, friction, and accumulated-interactive-assemblage:

Horizontal-disassociation-cushioning-layer

Disassociation elastic foam pads of the type used as carpeting pads

Thin disassociation elastic foam layer

Rigid foam insulation

Resilient substrate

Non-woven compression-resistant three-dimensional nylon matting

Non-woven vinyl random filament construction

Cushioning granular substrate

Granular base substrate

In the existing state of the art, the joints between the tile are filled with rigid grout, except for pre-grouted ceramic tile sheets of various sizes for interior and wall installations. According to the Ceramic Tile Institute, such sheets, which also may be components of an installation system, are generally grouted with an elastomeric material, such as, silicone, urethane, or polyvinyl chloride (PVC) rubber, each of which is engineered for its intended use. The perimeter of these factory pre-grouted sheets may include the entire, or part of the, grout between sheets, or none at all. Field applied perimeter grouting may be of the same elastomeric material as used in the factory pre-grouted sheets or as recommended by the manufacturer. Factory pre-grouted ceramic tile sheets offer flexibility, good tile alignment, overall dimensional uniformity and grouts that resist stains, mildew, shrinkage and cracking. Factory pre-grouted sheets tend to reduce total installation time where the requirement of returning a room to service or the allotted time for ceramic tile installation (as on an assembly line) is critical. These tiles are installed on a rigid substrate and are fastened mechanically or by adhesives of some type, or by both, whereas in this invention the tiles are not grouted, but are filled with dynamic-interactive-fluidtight-elastomeric-adhesive-sealant and held in place by gravity, friction, and accumulated-interactive-assemblage for floating loose laid on a horizontal-disassociation-cushioning-layer for impact sound isolation by disassociation of impact sound source on tile from the horizontal base surface.

It is very expensive to remove adhesive- and cement-adhered hard-surface floor coverings. The established heights of fixed elements, such as floor drains, fixtures, equipment, door frames and doors, make it difficult, expensive and even impossible due to the limitation of physical dimensions or structural weight or previous product failure not to require costly removal of existing floor coverings. This invention makes possible easy removal, reinstallation and salvage of the units.

The desirability and importance of the fluidtightness of the joints can be seen when it is realized that OSHA Regulation 1910.141 Sanitation Requirement states that all toilet rooms, floors and sidewalls, to a height of at least 6 inches (15 cm), shall be of watertight construction. This invention makes unnecessary the waterproof membrane which prior art dictates for installation below the floor tile coverings because of the fluidtight joints which retain spilt liquids on the surface for cleanup or disposal by gravity drainage.

The tiles are adhesively joined at their sides to adjacent sides of the adjoining tiles with an elastomeric adhesive sealant, which provides a dynamic system described below, providing accumulated interactive assemblage.

When a heavy load is placed upon a small area of tile, it will tend to temporarily sink into the horizontal cushioning layer, usually in a non-uniform manner, since the load will rarely be placed in the exact center of each tile. The joints between the adjoining tiles will correspondingly stretch or compress to adjust for the temporary deflection of the tiles, with the tops of said joints being in compression and the bottoms of said joints being in tension, or vice versa, to avoid breakage and rupture of the elastomeric adhesive sealant joints between tiles, to disperse the stress, and to prevent breaking of the tiles which by the nature of many ceramic and stone materials are relatively brittle.

As a result of this, impact sound applied to the tiles and passing through the horizontal base surface is substantially diminished, being dampened by the presence of the horizontal cushioning layer, and also due to the resilient, dynamic system of flexible joints utilized to join the tiles together.

Four major qualities of site-installed tile are (1) hard-surface tile, such as, ceramic mosaic tile, paver tile, quarry tile, hardwood floor tile, softwood floor tile, stone tile, terrazzo tile, cementitious tile, and resilient tile, (2) horizontal-composite-assemblage-sheets, such as, flexible plastic sheets, flexible metallic sheets, flexible boards, and rigid boards, (3) loose-laid horizontal-disassociation-cushioning-layer, and (4) dynamic-interactive-fluidtight-flexible-joints, which combine to give functional results and benefits which are greater than the sum of the four basic elements, such as:

Enhanced sound isolation by a horizontal-disassociation-cushioning-layer of elastic foam without mechanical fastening through or adhering to a horizontal base surface Capability of selecting from a variety of existing hard-surface floor materials as to their relative functional capabilities and long-term cost benefits which best suit building user needs for assembly of finished floor system with other inherent benefits given by this invention Substantially improved reliability and endurance by holding floor tile one to another enduringly with a suitably engineered elastomeric-adhesive-sealant and holding the floor tiles in place by optimum utilization of more dependable and long-term, enduring use of gravity, friction, and accumulated-interactive-assemblage effect by the flexible joint which is filled with dynamic-interactive-fluidtight-elastomeric-adhesive-sealant for holding the tiles one to another.

Three major qualities of modular-accessible-tiles where joints in the horizontal-composite-assemblage-sheets are directly below the dynamic-interactive-fluidtight-flexible-joints in the array of modular-accessible-tiles, as disclosed in the teachings of this invention, are (1) modular-accessible-tiles, (2) floating of horizontal-disassociation-cushioning-layer, and (3) dynamic-interactive-fluidtight-flexible-joints, which combine to give functional results and benefits which are greater than the above three basic elements, such as:

Enhanced sound isolation by horizontal-disassociation-cushioning-layers without mechanical fastening through or adhering to the horizontal base surface Capability of using a variety of hard-surface flooring materials to manufacture modular-accessible-tiles When utilizing quarry tile, pavers, ceramic tiles, and certain stones, the dynamic-interactive-fluidtight-flexible-joints give fluidtight joints substantially more impervious to fluids while retaining flexibility of joint and adhesion of elastomeric-adhesive-sealant to perimeter sides of tile and/or perimeter sides of modular-accessible-tiles so that liquids remain on the surface for drainage to drain or cleanup Factory manufacture of modular-accessible-tiles by one of several means outlined and of a variety of hard-surface materials and degrees of sound isolation due to arrangement of horizontal-disassociation-cushioning-layer Variety of hard-surface floor materials mating and matching with one another and/or carpet with a thinness to the varying combination a compared to the existing state of the art to meet a variety of functional needs while providing inherent cost effective advantages and improved sound isolation Conservation of finite energy since no steam or pressure is required to make hard-surface modular-accessible-tiles or dynamic-interactive-fluidtight-flexible-joints in the factory or when assembled on the job Utilization of horizontal-disassociation-cushioning-layer on bottom of modular-accessible-tiles to protect top finish floor surface when modular-accessible-tiles are stacked for shipment Relative thinness of finish floor system assembled of modular-accessible-tiles when compared to existing conventional methods, which has very important advantages in retrofit and remodeling as well as in new construction Capability of relocating modular-accessible-tiles on original project during renovation to meet changing functional needs or for accessibility to repairs Capability of salvaging modular-accessible-tiles and recycling modular-accessible-tiles to other projects Provision of soft resilient feel to hard-surface floor with capability to vary this soft resilient feel to suit user needs and desires by varying the combination of components Capability of hard-surface modular-accessible-tiles to support full-height movable partitions or open plan divider panels while providing other inherent advantages of modular-accessible-tile system.

All testing to date indicates individual quarry tile up to 12 inches by 12 inches (30 cm by 30 cm), which are at least ½ inch (12 mm) thick and manufactured of good quality clay, fired at a high temperature, of selected good quality, can function quite satisfactorily, provided they are installed over a horizontal-composite-assemblage-sheet floating on a horizontal-disassociation-cushioning-layer of high quality, with a foam thickness of 1/16 inch to ½ inch (1.5 mm to 12 mm), with a density at least equal to that of Omalon II Spec 3, which the manufacturer states as having a density of 4.5 lbs./square foot. Materials, such as, varieties of stone, slate, terrazzo, concrete, and the like, each have their own individual characteristics and strengths that can be adapted to use by application of the teachings of this invention. Various wood tiles can be used, with wood tiles having great strength without the brittleness inherent in masonry and ceramic tiles, in the same manner as the teachings of this invention.

Preferably, the horizontal cushioning layer is a sheet of elastic foam, being preferably about 1/16 inch to ½ inch (1.5 mm to 12 mm) thick. Any suitable elastic foam may be used. Examples of preferred resilient elastic foam which may be used include commercially available carpet foundation foam, for example, ¼ inch (6 mm) thick Omalon II (Spec 1, Spec 2, or Spec 3, Spec 2 being preferred) for the horizontal-disassociation-cushioning-layer. This material is polyurethane and is sold by the Olin Chemical Company. For thin horizontal cushioning layers, a preferred material is polyethylene foam, such as Volara #2A, 2#/CF density, ⅛ inch (3 mm) thickness, and Volara #4A, 4#/CF density, 1/16 inch (1.5 mm) thickness, both as manufactured by Voltek, a Sekisui Company. Another suitable horizontal-disassociation-cushioning-layer is Contract Life 310 EPDM carpet pad, sold by Dayco Corporation. Urethane, polyurethane, polyethylene, polystyrene, EPDM, isocyanurate, and latex foams are also suitable. Other types of elastic foam material of a variety of chemical compositions may also be used and, if desired, solid elastomeric materials may also be used for the thickness of the horizontal-disassociation-cushioning-layer. The thickness of horizontal-disassociation-cushioning-layer may be factory-manufactured rolled goods, flat or folded sheet, poured-in-place foams from jobsite pouring systems, or sprayed-in-place foams from jobsite spraying systems, as is the most convenient means, as long as it is of generally uniform thickness, durable in nature and of correct density to functionally support floor loads. Also elastic carpet pads may be used, such as, possibly rubberized animal hair, synthetic fiber, and/or India jute pads, flat sponge rubber, waffled sponge rubber, flat latex rubber, herringbone design rippled sponge rubber, waffled EPDM polymer sponge, latex foam rubber, and the like.

The standard horizontal individual tiles used in this invention may be of any desired size, commonly from 1 inch to 1 foot (2.5 cm to 30 cm) on a side or larger.

Modular accessible tiles, composite modular accessible tiles, and resilient composite modular accessible tiles may be manufactured, transported, and installed for accessibility of conductors, conduits, raceways, piping, and utilities below in sizes up to 6 feet (180 cm) on one or more sides, being manufactured, assembled, and composed of a plurality of standard horizontal individual tiles of any of the hard-surface materials disclosed herein or of similar type hard-surface materials, with a plurality of flexible joints between the horizontal individual tiles adhered to and assembled on a horizontal composite assemblage sheet for disposition in various combinations over any of the following:

One or more horizontal cushioning layers
A three-dimensional passage and support matrix
  Flexible foam
  Rigid foam
  Non-woven matting
Rigid foam insulation
Granular materials
A plurality of plinths
A plurality of junction/and or outlet boxes
Plastic or metallic support raceway systems In specialized instances, from one foreign source single horizontal-individual-tiles of ceramic/quarry tile up to 6 feet (180 cm) on one or more sides have become available for special requirements. Therefore, a single ceramic/quarry tile, selected for its levelness, may be adhered with a suitably engineered adhesive to a single large metallic horizontal-composite-assemblage-sheet, forming a structural tension composite diaphragm, provided the resulting modular-accessible-tile is installed over one of the following:

A precision, uniform thickness of horizontal-disassociation-cushioning-layer of elastic foam loose laid over a precision leveled horizontal base surface to provide uniform support A precision leveled three-dimensional passage-and-support matrix installed over a precision leveled horizontal base surface to provide uniform support.

Large size cast cementitious and epoxy-based reinforced terrazzo tiles up to 6 feet (180 cm) on one or more sides may be manufactured for installation over one of the following:

A precision, uniform thickness of horizontal-disassociation-cushioning-layer of elastic foam loose laid over a precision leveled horizontal base surface to provide uniform support A precision leveled three-dimensional passage-and-support matrix installed over a precision leveled horizontal base surface.

Wood laminations or rotary cut veneers as well as resilient plastic and rubber sheets may be manufactured of a single veneer or sheet up to 6 feet (180 cm) on one or more sides and more rapidly installed on conventional horizontal base surfaces without the precision required for single ceramic/quarry tiles, single stone or terrazzo tiles by the teachings of this invention.

The tiles typically may be of rectangular, square, hexagonal, octagonal or triangular shape, although any other shape may be used, such as, traditional shapes like Mediterranean, Spanish, Valencia, Biscayne, segmental, or oblong hexagonal. The tile may be of any commercially available material. The teachings of this invention call for use of any of the following horizontal-individual-tile material categories, referring to the drawings, for the manufacture and assembly of modular-accessible-tiles and as arrays of modular-accessible-tiles:

Ceramic tile materials, such as, ceramic mosaic tile, porcelain paver tile, quarry tile, glazed and unglazed paver tile, conductive ceramic tile, packing house tile, brick pavers, brick, and the like Stone tile materials, such as, slate tile, marble tile, granite tile, sandstone tile, limestone tile, quartz tile, and the like Hardwood tile materials, such as, white oak, red oak, ash, pecan, cherry, American black walnut, angelique, rosewood, teak, maple, birch, and the like Softwood tile materials, such as, cedar, pine, douglas fir, hemlock, yellow pine, and the like Wood tile materials, such as, irradiated, acrylic-impregnated hardwoods and softwoods Cementitious materials, such as, chemical matrices, epoxy modified cement, polyacrylate modified cement, epoxy matrix, polyester matrix, latex matrix, plastic fiber-reinforced matrices, metallic fiber-reinforced matrices, plastic-reinforced matrices, metallic reinforced matrices, and the like Terrazzo materials, such as, chemical matrices, epoxy modified cement, polyacrylate modified cement, epoxy matrix, polyester matrix, latex matrix, cementitious terrazzos, and the like Hard-surface resilient tile materials, such as, solid vinyl, cushioned vinyl, backed vinyl, conductive vinyl, reinforced vinyl, vinyl asbestos, asphalt, rubber, cork, vinyl-bonded cork, linoleum, leather, flexible elastic, polyurethane wood, fritz tile, and the like.

Composition tile may also be used, as well as any other rigid tile.

The dynamic-interactive-fluidtight-elastomeric-adhesive-sealant which is used to join the horizontal-individual-tiles as well as to join the modular accessible tiles one side to another at their adjoining sides may be any type of elastomeric adhesive sealant which provides a good adhesive bond to each tile side, is flexible when cured, is capable of taking the stress inherent within the dynamic moving action of the dynamic system, and will form a non-sticky, flexible surface coating after curing. Typically, polysulfide, silicone, butyl, silicone foam, acrylic, acrylic latex, cross-linked polyisobutylene rubber, vinyl acrylic, solvent acrylic polymer sealants, or like materials, may be used, or flexible urethane or polyurethane sealants, such as, Vulkem 116, 227 or 45 as manufactured by Mameco International, which are generally preferred. Any room-temperature curing elastomeric adhesive sealant composition or like composition, not requiring heat or pressure for curing, which exhibits the required functional characteristics may be used to form the dynamic interactive fluidtight elastomeric adhesive sealant.

The sealant may be applied between the tiles by any means, such as with a manual caulking gun or by pouring of joints. A pressurized gas pumping system for dispensing sealant from a bulk container with gas- or air-operated guns is the technique which is generally preferred.

The joint spacing between adjacent sides of adjacent horizontal individual tiles is generally adjusted to permit the formation of a strong, dynamic interactive fluidtight flexible bond between the tile sides by the sealant used. A typical spacing is between about ¼ inch to ½ inch (6 mm to 12 mm) for quarry and paver tile, while the spacing for many ceramic mosaic tiles may be as little as approximately 1/16 inch (1.5 mm). Most of such spacings also eliminate the need for thermal expansion and contraction joints.

It may be necessary to add a primer on sides of tile to insure a substantial adhesion by the elastomeric adhesive sealant to tile sides. Where a primer is required, care must be used to insure keeping primer off the face of the tile.

It is preferable for the tiles to be free of any direct mechanical attachment by any means which can serve to transmit impact sound to the horizontal base surface. In other words, the horizontal-individual-tiles or the modular-accessible-tiles, as the case may be, "float" by gravity, friction, and accumulated-interactive-assemblage on the thickness of horizontal-disassociation-cushioning-layer, being joined one to another only at all of their sides by an elastomeric adhesive sealant bond to the sides of the adjoining tile units. Thus a dynamic system is formed which dynamically responds to foot traffic or rolling loads in all of the joints between the horizontal-individual-tiles and the modular-accessible-tiles, so that the external and internal moments created by the loads, which generate tension and shear on the tiles and joints, can be dispersed through the flexible system among the various tiles by means of a continuous dynamic dissipation, much like continuous beam action which has a greater strength to size than a simple beam, between adjacent tiles, dissipating the stress in various directions from the load to the adjacent tiles.

The bonds between adjacent sides of the tiles sustain internal shear force in the joints to provide dynamic interactive flexible joints with the top of the joint in compression and the bottom of the joint in tension at one moment as a foot steps on or near the tile, and, at the next moment, the compression and tension may be reversed. However, the deflection is partially equalized, and the stresses dispersed to surrounding tiles by the system of this invention, thus greatly reducing the possibility of breakage of rigid tiles or the dynamic interactive fluidtight flexible bonds, despite their involvement in a dynamic system.

The plurality of dynamic-interactive-fluidtight-flexible-joints between the tiles combined with the thickness of horizontal-disassociation-cushioning-layer under the tiles distributes stress through "wavelike" dampening or dispersing action to the adjacent tiles, even when the tile is heavily pressed in a tilted position, in cooperation with the dynamic-interactive-fluidtight-flexible-joints, thus distributing loads to adjacent tiles and controlling the tilting of horizontal-individual-tiles and greatly reducing the possibility of snapping of tiles which are relatively brittle by nature.

Dynamic interactive fluidtight flexible joints as thin as ⅛ inch (3 mm) have been thick enough to hold tiles one to another for their functional interaction.

However, tests to date indicate a thicker joint of ¼ inch (6 mm) thickness or over is required to sustain spike heels when width of joint between tiles is sufficient to allow a spike heel to bear on dynamic interactive fluidtight flexible joints, rather than on sides of tiles. Thin joints, obviously, save expensive elastomeric adhesive sealant but require greater time to install foam rods or sand or aggregate filler. Full depth joints are faster and easier to make while giving better support to spike heels and decreasing slightly the flexible feel when walking on the installation.

Testing has shown the ease with which individual tiles may be removed from the floor to replace broken tiles, to relocate all or portions of the floor or to gain access to the horizontal base surface, cushioning-granular-substrate, utilities, conductors, and the like. A procedure for reinstalling horizontal-individual-tiles or reinstalling modular-accessible-tiles in the array of modular-accessible-tiles by allowing adhesive seal to reseal the flexible joints is as follows:

Cutting the joint down the middle with a vertical cut or sloping cut and not removing the sealant from the sides of tile. When the horizontal-individual-tile or modular-accessible-tile is ready to be reinstalled, place a bead or series of spots of gun-grade elastomeric adhesive sealant along the vertical or sloping side to reset the tile.

Cutting the joint down the middle with a vertical or sloping cut and not removing the elastomeric adhesive sealant from the sides of the tile and also cutting or routing in the joint a series of uniformly spaced vee or half-cylindrical cross cuts on one or both sides of the middle cut for receiving a series of small beads of gun-grade elastomeric adhesive sealant to hold the tile unit in place in the array of units at points of spaced vee or half-cylindrical cross cuts.

Precision casting or routing a continuous perimeter border around all sides of the perimeter of the modular-accessible-tiles with a series of uniformly spaced vee or half-cylindrical cross cuts on one or both sides of the middle cut for receiving a series of small beads of gun-grade elastomeric adhesive sealant to hold the modular-accessible-tile in place in the array of modular-accessible-tiles.

Double cutting the joint with parallel sloping cuts to form a vee open on the top side and closed on the bottom into which self-levelling or gun-grade elastomeric adhesive sealant is placed to seal the joint.

Precision casting or routing into a continuous perimeter border around the perimeter of all sides of the modular-accessible-tile a vee or oval joint open on the top side and closed on the bottom, into which self-levelling or gun-grade elastomeric adhesive sealant is placed to seal the joint.

Although foam rods work well, I have found alternative substitutes to using foam rods through further testing of my invention, which indicates that the more economical, practical way of forming the filler portion of the dynamic-interactive-fluidtight-flexible-joint between horizontal-individual-tiles or modular-accessible-tiles of my combination is by any one of the following:

Where horizontal-individual-tiles are adhered fluidtight to a horizontal-disassociation-cushioning-layer or are adhered fluidtight to a horizontal-composite-assemblage-sheet, flexible joints which are dynamic-interactive-fluidtight-flexible-joints may be very efficiently formed by placing a continuous flow of self-leveling elastomeric-adhesive-sealant for the full width and height of the dynamic-interactive-fluidtight-flexible-joint. Where horizontal-individual-tiles are not adhered fluidtight to a horizontal-disassociation-cushioning-layer or are not adhered fluidtight to a horizontal-composite-assemblage-sheet, flexible joints should be formed by first placing a continuous flow of gun-grade elastomeric-adhesive-sealant at the bottom of the flexible joints to form a fluidtight bottom seal to contain the continuous filling full of the top portion of the dynamic-interactive-fluidtight-flexible-joint with self-leveling elastomeric-adhesive-sealant for the full width and height of the dynamic-interactive-fluidtight-flexible-joint. This initial first bottom seal can beneficially hold the horizontal-individual-tiles in place against subsequent movement during the second application of the self-leveling elastomeric-adhesive-sealant.

Continuously fill the bottom portion of dynamic-interactive-fluidtight-flexible-joint with gun-grade elastomeric-adhesive-sealant, allowing this dynamic-interactive-fluidtight-elastomeric-adhesive-sealant to form a fluidtight bottom seal to contain the self-leveling elastomeric-adhesive-sealant when the top portion of the dynamic-interactive-fluidtight-flexible-joint is being filled with it.

Place a continuous bead of gun-grade elastomeric-adhesive-sealant below each tile joint as the horizontal-individual-tile is being set to hold the horizontal-individual-tiles in place and also to form a fluidtight bottom seal to contain the self-leveling elastomeric-adhesive-sealant when the top portion of the dynamic-interactive-fluidtight-flexible-joint is being filled with it.

Continuously fill the bottom portion of the joints with any type of filler, such as, perlite, talc, vermiculite, granular filler, or foam beads to a uniform height so as to provide at least ¼ inch (6 mm) or more space in the top of the joint for the elastomeric-adhesive-sealant by the following steps of placing a light coating of gun-grade elastomeric-adhesive-sealant to form an overcoat wherein a zone of intermixing of self-leveling elastomeric-adhesive-sealant will form with a fluidtight skim coat. After the skim coat becomes fluidtight, fill the joint full with self-leveling elastomeric-adhesive-sealant.

Continuously fill the bottom portion of the joint with sand or any fine granular material with a specific gravity greater than that of the self-leveling elastomeric-adhesive-sealant to a uniform height so as to provide at least ¼ inch (6 mm) or more space in the top of the joint for the elastomeric-adhesive-sealant. Either fill the rest of the joint directly with self-leveling elastomeric-adhesive-sealant or first form a skim seal coat over the sand or granular filler material and then fill the joint full with self-leveling elastomeric-adhesive-sealant.

Where horizontal-individual-tiles are adhered to a horizontal-composite-assemblage-sheet of a flexible plastic or a flexible metallic sheet with turned-up edges to form fluidtight containment for the dynamic-interactive-fluidtight-flexible-joint, continuously fill the dynamic-interactive-fluidtight-flexible-joint full with self-leveling elastomeric-adhesive-sealant to a uniform depth of at least ¼ inch (6 mm) and then brush in sand or a similar granular filler with specific gravity greater than that of the self-leveling elastomeric-adhesive-sealant at a slow enough rate for relatively uniform distribution that the sand settles, but does not bridge over, to the bottom of the dynamic-interactive-fluidtight-flexible-joint, leaving the top portion of the dynamic-interactive-fluidtight-flexible-joint full of high-grade self-leveling elastomeric-adhesive-sealant to a depth of at least ¼ inch (6 mm) or greater.

Most underlayments of plywood, particleboard, hardboard, and the like warp readily when any material is adhered to only one side or when moisture or moist vapor is exposed to only one side, making it necessary to adhere these rigid boards by adhesive to the structural subfloor or mechanically fasten these rigid boards to the structural subfloor, which forms a bridge for transmission of impact sound. By the use of a thin horizontal-composite-assemblage-sheet, it is possible to keep the flexible sheet in place by assembling the tiles into arrays on the sheet with the tiles joined together by the flexible joints. It is essential that the horizontal-composite-assemblage-sheets be relatively unsusceptible or entirely unsusceptible to moisture which causes expansion and contraction so that the unbalanced sandwich construction will, importantly, lie flat, or limp, by its relatively heavy weight to stiffness over the horizontal-disassociation-cushioning-layer, the horizontal base surface, and the three-dimensional passage-and-support matrix without adhesion to these surfaces. Generally, flexible metallic sheets and flexible plastic sheets are more inert to these moisture-induced problems, with flexible metallic sheets being generally the preferred materials for the horizontal-composite-assemblage-sheets.

The teachings of this invention also call for the use of any of the following materials:

A slip sheet is a plastic material from 0.004 inch to 0.065 inch (0.1 mm to 1.5 mm) thick, such as, spun polyolefin sheeting, thin polyethylene foam sheets, thin polyurethane foam sheets, thin polystyrene foam sheets, woven polyolefin sheeting, reinforced polyolefin sheeting, cross-laminated polyolefin sheeting, polyethylene sheeting, reinforced polyethylene sheets, polyvinyl chloride sheeting, butyl sheeting, EPDM sheeting, neoprene sheeting, Hypalon (registered trademark of DuPont) sheeting, fiberglass sheeting, reinforced fiberglass sheeting, polyester film, reinforced plastic sheeting, cross-laminated poly sheeting, scrim sheeting, and scrim fabrics The horizontal-composite-assemblage-sheet is a flexible metallic sheet modularly sized to size for one or more modular-accessible-tiles and comprises a modular flexible sheet from 0.001 inch to 0.020 inch (0.05 mm to 0.5 mm) thick, such as, hot rolled steel sheets; high strength-low alloy steel sheets; cold rolled steel sheets; coated steel sheets; galvanized, galvanized bonderized, galvannealed, electrogalvanized steel sheets; aluminized steel sheets; long terne sheets; vinyl metal laminates; aluminum sheets; and stainless steel sheets, wherein the flexible metallic sheets are, further, selected from flat galvanized metallic sheets, flat metallic sheets, rolls of galvanized metallic sheets, rolls of metallic sheets, grid-stiffened pans, deformed metallic sheets, flat metallic sheets with stiffening ribs, ribbed pans, flat laminated metallic sheets, metallic foil sheeting, expanded metal sheets, woven metal sheets, and perforated metal sheets The horizontal-composite-assemblage-sheet is modularly sized to size selected for one or more horizontal-individual-tiles and comprises a modular flexible sheet from 0.001 inch to 0.125 inch (0.05 mm to 3 mm) thick, such as, plastic polyvinyl chloride, chlorinated polyvinyl chloride, polyethylene, polyurethane, and fiberglass The horizontal-composite-assemblage-sheet is a metallic sheet modularly sized to size for one or more horizontal-individual-tiles and comprises a modular flexible sheet from 0.004 inch to 0.125 inch (0.1 mm to 3 mm) thick, such as, hot rolled steel sheets; high strength-low alloy steel sheets; cold rolled steel sheets; coated steel sheets; galvanized, galvanized bonderized, galvannealed, electrogalvanized steel sheets; aluminized steel sheets; long terne sheets; vinyl metal laminates; aluminum sheets; and stainless steel sheets, wherein the flexible metallic sheets are, further, selected from galvanized metallic sheets, flat metallic sheets, rolls of galvanized metallic sheets, rolls of metallic sheets, grid-stiffened pans, deformed metallic sheets, flat metallic sheets with stiffening ribs, ribbed pans, flat laminated metallic sheets, metallic foil sheeting, expanded metal sheets, woven metal sheets, perforated metal sheets, and woven wire sheets The horizontal-composite-assemblage-sheet is a flexible sheet from 0.125 inch to 0.500 inch (3 mm to 12 mm) thick, such as, asbestos-cement sheets, plastic sheets, plastic-reinforced cementitious sheets, metallic-reinforced cementitious sheets, glass-reinforced cementitious sheets, plastic-fiber reinforced cementitious sheets, metallic-fiber reinforced cementitious sheets, glass-fiber reinforced cementitious sheets, Finnish birch plywood, overlay plywood, plastic-coated plywood, tempered hardboard, particleboard, and plywood The horizontal-composite-assemblage-sheet is a modular board from 0.500 inch to 1.125 inch (12 mm to 2.8 cm) thick, such as asbestos-cement board, plastic board, plastic-reinforced cementitious board, metallic-reinforced cementitious board, plastic fiber-reinforced cementitious board, Finnish birch plywood, overlay plywood, plastic-coated plywood, laminated tempered hardboard, micro-lam plywood, and particleboard The horizontal-composite-assemblage-sheet has a grid of warpage relief saw kerfs, forming a grid pattern of saw kerfs to impact an inherently limp flexibility to the combination due to its mass relative to its stiffness to offset unbalanced composition of sandwich, and is a material, such as, asbestos-cement board, plastic board, plastic-reinforced cementitious board, metallic-reinforced cementitious board, plastic fiber-reinforced cementitious board, metallic fiber-reinforced cementitious board, Finnish birch plywood, overlay plywood, plastic-coated plywood, laminated tempered hardboard, micro-lam plywood, and particleboard The horizontal-composite-assemblage-sheets are assembled coplanar as an array with their sides and ends abutting one another and are cut to size to form factory-manufactured modular-accessible-tiles.

The teachings of this invention also call for the use of any of the following materials:

The slip sheet is a plastic material from 0.004 inch to 0.065 inch (0.1 mm to 1.5 mm) thick, such as, spun polyolefin sheets, thin polyethylene foam sheets, thin polyurethane foam sheets, thin polystyrene foam sheets, woven polyolefin sheeting, reinforced polyolefin sheeting, cross-laminated polyolefin sheeting, polyethylene sheeting, reinforced polyethylene sheeting, polyvinyl chloride sheeting, butyl sheeting, EPDM sheeting, neoprene sheeting, Hypalon (a registered trademark of DuPont), fiberglass sheeting, reinforced fiberglass sheeting, polyester film, reinforced plastic sheeting, cross-laminated poly sheeting, phenolic foam sheeting, scrim sheeting, and scrim fabrics The horizontal rigid foam insulation comprises a rigid foam insulation material of any functionally required thickness, such as, extruded polystyrene, expanded polystyrene, styrene bead board, phenolic foam, polyurethane, urethane, polyethylene, isocyanurate foam, polyvinyl chloride, foam glass, and perlite/urethane foam sandwich Alternatively, it may be desired to replace or add to the thickness of horizontal-disassociation-cushioning-layer of this invention by the addition of at least a ¾ inch (19 mm) or greater thickness of horizontal-rigid-foam-insulation, such as, polystyrene foam board, polystyrene bead board, urea-formaldehyde foam board, polyurethane foam board, polyisocyanurate foam board, and the like, foamed-in-place rigid urethane foam and the like, urethane pour systems and the like, separating the horizontal-individual-tiles and the horizontal base surface. The tile array shown in the drawings is adhered together by the perimeter joints between adjacent tiles and loose laid over any type of rigid-foam-insulation, such as is listed above. The dynamic-interactive-fluid-tight-flexible-joints between the tiles are still preferably used to compensate for stresses that may be generated by deflection of the relatively rigid foam which, however, still is subject to some deflection under heavy loads. An advantage of this system is that thermal insulation is provided as well as impact sound isolation. This thermal insulation can also be beneficially installed below the horizontal-disassociation-cushioning-layer.

In retrofit work the total overall thickness of the impact sound isolation combination is important so that door frames, door heads, and door hardware do not have to be reset r reworked and, hopefully, so door bottoms do not require refitting.

Also, in new work, having the impact sound isolation combination as thin as possible allows door frames to be set and fastened directly on the horizontal base surface with the use of existing conventional tolerances, as well as door undercuts, hardware clearances, and the like.

Carpet is a product in many respects like this invention. It is helpful in understanding this invention if one visualized in his mind's eye these comparisons:

Visualize each loop or fiber of a carpet as equivalent to a horizontal-individual-tile, and visualize the carpet backing as a horizontal-composite-assemblage-sheet that holds each loop or fiber in an accumulated-interactive-assemblage equivalent to the horizontal-composite-assemblage-sheet (flexible asbestos-cement or flexible plastic or metallic sheets) of this invention where the horizontal-individual-tiles ar adhered to this horizontal-composite-assemblage-sheet into an assembled horizontal-tile-array This invention goes beyond what carpet does and fills all perimeter joints around horizontal-individual-tiles with a flexible joint of dynamic-interactive-fluidtight-elastomeric-adhesive-sealant to form dynamic-interactive-fluidtight-flexible-joints, an improvement over the vast perimeter area surrounding each fiber of carpet, where dirt may accumulate and which fibers are equivalent to the horizontal-individual-tiles of this invention Like carpet, this invention remains flexible and can be loose laid over a horizontal-disassociation-cushioning-layer, provided the combination is composed in the different ways illustrated in our drawings, specification and claims Carpet is also cuttable and movable when loose laid, as this invention is cuttable and movable, allowing accessibility to the horizontal base surface and utilities and conductors as this invention does.

This invention fills the preceding needs as follows:

By producing a product not requiring pressure and heat to provide flexible joints By allowing transport of modular-accessible-tiles by pallet By allowing gravity, friction, and accumulated-interactive-assemblage to hold modular-accessible-tiles in place indefinitely as long as the Earth retains its gravity tension By allowing gravity-installed modular-accessible-tiles to be re-used, relocated and recycled in the same building and home or in new buildings and homes By providing substantially improved Impact Isolation Class (IIC) and Sound Transmission Class (STC) for finish hard-surface tile and resilient floor covering installations which are thin in thickness and can be used in retrofit and new construction By providing an array of modular-accessible-tiles with flexible joints which are cuttable, accessible, and reassembleable in order to provide access to conductors when building occupants' functional needs require a hard-surfaced flooring in retrofit of existing building and in new buildings By providing a means for installing an array of modular-accessible-tiles with flexible joints which are cuttable, accessible, and reassembleable in order to provide full top accessibility to a three-dimensional passage-and-support matrix formed to accept and accommodate varying combinations of the following:

Factory-preassembled flexible metallic conduits with factory-installed locking connector ends Factory-preassembled rated flexible plastic conduits with factory-installed locking conductor ends Plastic and metallic conduits Plastic and metallic support raceway systems Plastic and metallic supply and return fluid piping systems for chilled fluids, hot fluids, absorptive fluids, radiative fluids, and fire protection fluids Junction and outlet boxes Passage of gases through a three-dimensional passage-and-support matrix By providing a liquidtight joint that retains spilled liquids on the surface for cleanup or disposal by gravity drainage Whereas there is an abundance of prior art in connection with flat conductor cable and many existing patents showing minor improvements in flat conductor cable, connectors, and the like, there exists to the best of my knowledge no prior art for arrays of gravity-held-in-place load-bearing horizontal modular-accessible-tiles having hard-surface flooring materials as disclosed by the teachings of this invention, with modular-accessible-tiles, composite-modular-accessible-tiles, and resilient-composite-modular-accessible-tiles having cuttable, accessible, and reassembleable dynamic-interactive-fluidtight-flexible-joints for accessibility to service concealed-from-view conductor systems wherever functionally required below arrays of the gravity-held-in-place load-bearing horizontal modular-accessible-tiles of this invention.

The suspended structural load-bearing modular-accessible-units of this invention are principally for use where shallow depth with greater access to and connectivity of all types of matrix conductors and equipment conductors is desired or required for new and retrofit commercial, office, institutional, educational, warehousing, industrial manufacturing, and service industry facilities.

The thickness of the entire assembly, from the top surface of the horizontal base surface to the top surface of the modular-accessible-units is divided into ranges of thickness as follows:

Micro thickness—no less than ¼ inch (6 mm) and no more than 1 inch (2.5 cm)

Mini thickness—greater than 1 inch (2.5 cm) and no more than 3 inches (7.5 cm)

Maxi thickness—greater than 3 inches (7.5 cm) and up to any required thickness, whereas generally the thickness in many cases need be no more than 6 inches (15 cm) within the teachings of this invention Whereas the existing art points to computer access flooring of depths greater than 6 inches (15 cm), generally of depths from 12 inches (30 cm) to 36 inches (90 cm), configured as panels supported at their corners on various types of columns and generally mechanically fastened to the columns with cross bracing of the tops of the columns being necessary, with access to the conductors disposed below the computer-type access panels only by removing the panels and with no way of connecting to the below-the-floor conductors, except by making an aperture in the surface of the panel for an above-the-floor monument or a flush cover closing off the aperture in the panel, the teachings of this invention disclose arrays of modular-accessible-units with biased or unbiased corners, supported on a load-bearing three-dimensional-conductor-accommodative-passage-and-support-matrix accommodating matrix conductors.

The load-bearing three-dimensional-conductor-accommodative-passage-and-support-matrix comprises load-bearing granular materials, load-bearing flexible foam, load-bearing rigid foam, load-bearing plinths, load-bearing modular accessible node boxes or load-bearing channels, these types of matrices used singly or in combination.

The biased corners accommodate modular accessible nodes and modular accessible passage nodes of complementary shapes and sizes to fit in apertures created by the biased corners of adjacent modular-accessible-units. The modular-accessible-nodes may be load-bearing or non-load-bearing. Thus, there is no need to core, drill or cut through a modular-accessible-unit to connect equipment cordset plugs to mating compatible receptacles of the matrix conductors as is required by conventional computer access flooring systems. Connectivity is obtained between matrix conductors and a plurality of different functional types of equipment plug-in cordsets for voice, data, text, video, and power conductors, as well as fluid conductors, and the like, by means of the modular accessible nodes. The modular accessible nodes of this invention are flush and coplanar with adjacent modular-accessible-units and are generally multi-functional. For example, multi-functional office modular-accessible-nodes may conveniently provide voice, data, text, video, and power at each modular accessible node or any other such multi-functional combination. Industrial modular accessible nodes may conveniently provide power, data, voice, video or any other multi-functional combination, another example being power, hydraulic, compressed air, and control conductors provided at a single multi-functional modular accessible node.

In my U.S. Pat. No. 4,546,024, issued Oct. 8, 1985, modular-accessible-tiles are held in place by gravity, friction, and accumulated-interactive-assemblage. This invention utilizes gravity, friction, and assemblage along with registry in some cases. Registry is obtained by mating of the points of registry and bearing of a load-bearing three-dimensional-conductor-accommodative-passage-and-support-matrix comprising, for example, modularly spaced load-bearing plinths with the points of registry and bearing comprising registry apertures or indentations in the bottom of the open-faced bottom tension reinforcement containment of a modular-accessible-unit. Modular spacing of both the load-bearing plinths and the points of registry in the bottom of the open-faced bottom tension reinforcement containment assures the interchangeability of the modular-accessible-units in an array.

By the teachings of this invention, a paver floor system comprising a supporting layer and an array of modular-accessible-pavers is disposed over a base surface, typically a cushioning-granular-substrate at grade level, below grade level or slightly above grade level. The supporting layer comprises a plurality of structural bearing supports upwardly projecting from a plurality of modular structural plates to form a three-dimensional conductor-accommodative passage and foundation grid. The structural bearing supports may be integrally cast of concrete with the modular structural plates or they may be cast separately and adhered to the plates by a sealant, an adhesive, or a layer of adhesive-backed foam. The structural bearing supports have a discretely unique spacing and are positioned to provide interactive support for the modular-accessible-pavers on shortened spans along two diagonal axes or on two or more perimeter joint axes of the array of pavers. The joints in the modular-accessible-pavers and the modular structural plates may be non-aligned by an offset equal to one-half of a paver multiple to provide better bearing on the cushioning-granular-substrate when carrying heavy loads.

The cushioning-granular-substrate also functions synergistically as a distribution passage matrix for any one, part, or all of the following networks:

One or more flat conductor cables or round or ribbon insulated electrical and electronic conductors Metal and plastic conduits carrying electrical and electronic conductors Metal, plastic and fiber insulation piping for distribution of gases Metal and plastic piping for distribution of fluids, chilled fluid return and supply, hot fluid return and supply, and the like Metal or plastic pipe coil with working fluid of any functionally desired layout, disposed within a cushioning-granular-substrate reasonably close to the tile array for passage of working fluid through pipe coil to:

Transfer heat from the pipe coil with working fluid to the encapsulating cushioning-granular-substrate and then transfer of the heat to the tile array which is supported by the cushioning-granular-substrate supporting an array of horizontal-individual-tiles or an array of modular-accessible-tiles so the supported tile array is a beneficial low Delta t radiative surface for radiative heating of interior occupied spaces over large surface areas, using low Delta t heat which is more plentifully available and less costly at higher efficiencies when usable at a low differential Delta t, as permitted by the teachings of this invention, from sources such as lights, waste heat, solar sources, heat pumps, and the like, and wherein radiative floor heating gives a high degree of comfort at lower temperatures and higher humidities desired for ideal comfort relationships at lowest cost-to-benefit Transfer heat by absorbing heat from the array of horizontal-individual-tiles or the array of modular-accessible-tiles to the supporting cushioning-granular-substrate encapsulating the pipe coil with working fluid with a cooler working fluid from ground coils and ground water sources or mechanical refrigeration to beneficially absorb heat so that the tile array is an absorptive surface of low Delta t heat from electrical and electronic equipment sitting on the tile array and conducting excess waste heat from electrical and electronic equipment from heat-operating production equipment sitting on the tile array and conducting excess waste heat to tile array from excess ambient air heat from metabolic source and from heat-operating production equipment from diffuse and heat beam solar radiation transmission through vertical, sloping and horizontal transmissive surface by the greenhouse phenomenon from internal radiative vertical wall, ceiling, and furnishings sources and also from metabolic sources radiating excess heat to absorptive tile array surface wherein radiative cooling provides beneficial low Delta t heat for storage or transfer from internal areas for heating external envelope by using low Delta t heat or for pre-heating domestic hot water, and the like.

Passage of gases through voids within cushioning-granular-substrate

The cushioning-granular-substrate is utilized to

Level uneven floors or badly deflected floors

Add thermal mass for passive heating

Add thermal mass to absorb fire load

Improve impact sound isolation

Making the composite-modular-accessible-tile of a modularly sized metallic horizontal-composite-assemblage-sheet, and used in conjunction with metallic continuous-protective-strips at the joints between adjacent modular-accessible-tiles, provides protective metallic covering to protect the conductor system from physical injury, provides a non-combustible containment covering over the conductors and the horizontal-disassociation-cushioning-layer, provides continuous metallic grounding to avoid possible hazards from current carried in the conductors, provides capability for metallic horizontal-composite-assemblage-sheet to ground off stray static electric charges which are so often disruptive in highly automated computer office networks. The use of a metallic horizontal-composite-assemblage-sheet also provides independent isolated floating metallic horizontal-composite-assemblage-sheet for physically anchoring outlet-junction-boxes thereto and, where desired, for grounding networks. The use of a metallic horizontal-composite-assemblage-sheet also provides for grounding the conductor terminals without bridging the horizontal-disassociation-cushioning-layer's impact sound isolation improvements.

By the teachings of this invention, the supporting layer may also comprise a plurality of load-bearing plinths disposed over a base surface, typically a new or existing concrete slab. The plinth may be any type of polygonal solid, typically a truncated cone or truncated pyramid, as well as a cylinder or elongated cube, and comprise a plurality of polygonal segments having flat or curved sides The plinth has a flat top bearing surface and a flat bottom bearing surface The flat bottom bearing surface is adhered to the base surface by means of a sealant, an adhesive or a layer of adhesive-backed foam. The plinths are positioned in a predetermined pattern layout on the base surface by a template. The modular-accessible-pavers are supported on the flat top bearing surface.

Typically, the plinths are produced by means of any type of castable, settable mix placed in permanent, disposable or reusable molds. The permanent molds form an integral containment and may be made of metal, plastic, fiber, paper or the like. The castable mix may be cementitious concrete, polymer concrete, gypsum concrete or gypsum cement concrete. To achieve increased compressive strength and load-carrying capacity, the mix may be consolidated in the molds by vibration, pressing and vibration, or shocking. Typically, compressive strengths may be doubled or tripled by such consolidation. Polymer concrete plinths may be made by casting in a form or by die forming, extrusion or injection molding.

The plinths may also be made of any suitable metal by any metal pressure stamping, forming or casting means, dense rigid foam, dense flexible foam, any type of cast polymer or injection-molded polymer, any type of plastic, cast gypsum, any type of elastomeric material, including cast natural rubber or cast manmade rubber, embossed stamping out of wood fibers, solid or laminated woods, plywood, microlam plywood, particleboard, oriented particleboard, hardboard, and the like. The plinths may be formed individually or as part of a larger sheet or structure containing more than one plinth.

The modular-accessible-pavers are suspended structural load-bearing units comprising the following structural moldcast plates ranging in size from 6 inches by 6 inches (15 cm by 15 cm) to 24 inches by 24 inches (60 cm by 60 cm) and in thickness from 0.500 inch (12 mm) to 2 inches (5 cm)

structural cast paver plates ranging in size from 6 inches by 6 inches (15 cm by 15 cm) to 16 inches by 16 inches (40 cm by 40 cm) and in thickness from 2 inches (5 cm) to 6 inches (15 cm)

large reinforced structural cast paver plates ranging in size from 24 inches by 24 inches (60 cm by 60 cm) to 72 inches by 72 inches (180 cm by 180 cm) and in thickness from 2 inches (5 cm) to 8 inches (20 cm)

structural containment cast plates ranging in size from 8 inches by 8 inches (20 cm by 20 cm) to 72 inches by 72 inches (180 cm by 180 cm) and in thickness from 0.500 inch (12 cm) to 8 inches (20 cm)

The modular structural plates may be sized to fit one or more multiples of the modular-accessible-pavers. A cuttable spline of rubber, plastic, high density foam or the like may be inserted in the sides of the plates to align them and to keep them in place. Access to the cushioning-granular-substrate is then achieved by means of cutting through the splines and removing one or more modular-accessible-pavers. New splines are inserted when the modular structural plates are replaced.

The structural bearing supports delineate a plurality of modular-accessible-paver sites as well as potential and selected modular accessible node sites accommodated within the three-dimensional conductor-accommodative passage and foundation grid. They form corner supports for selectively configurable and reconfigurable modular accessible node boxes accommodated within the modular accessible node sites and selectively configured of interchangeable vertical side plates fitting into slots formed in the structural bearing supports. The modular accessible node sites are evolutionarily configurable and reconfigurable to modular accessible node boxes. Where a paver floor system does not have modular accessible nodes, modular accessible node sites may be located below the modular-accessible-pavers at any desired locations. Passage through the modular accessible nodes would be by means of any of the small convex, concave or biased paver corners or beveled or eased paver edges which allow the passage of single conductors or a small number of conductors.

The modular accessible node boxes are multifunctional and relocatable and may subsequently be converted back to modular accessible node sites by removing the vertical side plates. The pattern of the structural bearing supports is such that the interchangeable vertical side plates may be relocated to other groups of structural bearing supports to form new modular accessible node boxes where functionally desired. This unique feature provides complete accessibility, flexibility, reconfigurability, and recyclability to any heavy duty or medium duty industrial, warehousing, commercial or institutional floor and the ability to deal with evolutionary unfolding change in the way buildings are used over a long period of time. A novel social benefit is a substantial contribution to the elimination of the throwaway building and the throwaway building component. By accommodating evolutionary unfolding change, buildings extend their useful lives indefinitely because they can be continually renovated to meet new technological standards.

In the case of suspended structural load-bearing moldcast plates, suspended structural load-bearing cast paver plates and modular-accessible-pavers, the cast plate accommodates registry by various means, including the following:

precision casting of one or more projecting or recessed aperture registry points on the underside of the cast plate for mating to supports in the load-bearing three-dimensional-conductor-accommodative-passage-and-support-matrix, the cast plate having a wearing surface face good one side precision casting of one or more projecting or recessed aperture registry points on both faces of the cast plate for mating to supports in the load-bearing three-dimensional-conductor-accommodative-passage-and-support-matrix, the cast plate being reversible and having wearing surface faces good two sides precision casting of one or more aperture registry points all the way through the cast plate for mating to supports in the load-bearing three-dimensional-conductor-accommodative-passage-and-support-matrix, providing a cast plate which has wearing surface faces good two sides precision casting of one or more inserts in a cast plate for plates that are good one side and good two sides a threaded aperture may be integrally cast into the cast plate and a threaded or unthreaded aperture cast into the top of the supports to accommodate an externally threaded fastener an internally threaded female insert may be integrally cast into the cast plate and into the supports, separately or in combination, allowing an externally threaded rod, shaft or other fastener to provide registry and engagement by means of screwing into the threaded insert an unthreaded female insert may be integrally cast into the cast plate and into the supports, separately or in combination, allowing an unthreaded rod, shaft or other fastener to provide registry and sometimes engagement by being inserted into the insert a non-bonding, internally threaded, injection-molded insert may be cast into a modular-accessible-paver to provide a rotating bearing integrally cast into a slab, having one or more extended flanges at midpoint in its height to increase the load-carrying capacity while rotating, allowing a threaded rod, shaft or other fastener to provide registry and engagement precision drilling of one or more recessed aperture registry points on the underside of the cast plate for mating to supports in the load-bearing three-dimensional-conductor-accommodative-passage-and-support-matrix, the cast plate having a wearing surface face good one side precision drilling of one or more aperture registry points on both faces of the cast plate part way through for mating to supports in the load-bearing three-dimensional-conductor-accommodative-passage-and-support-matrix, the cast plate being reversible and having wearing surface faces good two sides precision drilling of one or more aperture registry points all the way through the cast plate for mating to supports in the load-bearing three-dimensional-conductor-accommodative-passage-and-support-matrix, providing a cast plate having wearing surface faces good two sides precision positioning of one or more applied projecting registry points on the underside of the cast plate, the applied registry points removable for use of the underside as the face of the cast plate when the cast plate is turned over and the faces are reversed, the cast plate having wearing surface faces good two sides a combination of casting, drilling and registry application may also be used.

Access to the matrix conductors is obtained by removing one or more modular-accessible-units. Access for plugging into or unplugging equipment cordsets from receptacles in activated modular accessible nodes is obtained by removing the flush decorative access covers of one or more modular accessible nodes which are disposed within the array. The flush decorative access covers may be similar in construction to composite-modular-accessible-tiles and resilient-composite-modular-accessible-tiles to achieve the structural strength to span the distance from one biased corner to another. The flush decorative access covers comprise many different types, such as, sliding covers, hinged covers, direct plug-in covers, solid covers, lift-out lay-in covers with press-in and pull-out engagement, mechanically held-in-place covers, covers held in place magnetically, covers held in place by one or more fasteners, and the like. In addition, modular-accessible-units of a proper size and of the same or contrasting colors or materials may serve as access covers for the modular accessible nodes. For use with modular accessible passage nodes where conductors merely pass through the modular accessible node from the load-bearing three-dimensional-conductor-accommodative-passage-and-support-matrix, the cover may have knockouts, breakouts, drillouts, and the like to accommodate the passage of the matrix conductors, such as, preassembled conductor assemblies, and equipment cordsets, fluid conductors, and the like, disclosed herein.

Any type of preassembled conductor assembly may be disposed within the load-bearing three-dimensional-conductor-accommodative-passage-and-support-matrix between one modular accessible node and another to provide multi-functional receptacles for plugging in compatible equipment cordsets for equipment disposed above the array of modular accessible nodes and modular accessible passage nodes. These preassembled conductor assemblies may be connected to other preassembled conductor assemblies within the load-bearing three-dimensional-conductor-accommodative-passage-and-support-matrix or to junction boxes, cluster panels, branch panels, main panels, and the like.

All types of conventional conductors and preassembled conductor assemblies accommodated within the load-bearing three-dimensional-conductor-accommodative-passage-and-support-matrix may be extended from below the modular-accessible-units through any modular accessible passage node within the array of modular-accessible-units plus modular accessible nodes and modular accessible passage nodes for direct conductor connectivity of equipment and machinery in conformance with applicable codes.

Any type of matrix conductor, conventional conductor or preassembled conductor assembly may be disposed within the load-bearing three-dimensional-conductor-accommodative-passage-and-support-matrix.

Any type of matrix conductor of conventional type may be conveniently adapted to installation within the space limitations of the load-bearing three-dimensional-conductor-accommodative-passage-and-support-matrix of this invention. Matrix conductors may have factory preassembled connectors and jobsite assembled connectors coded to meet industrial and military standards for configuration, mating, color coding, bar coding, and alphanumerical coding.

The modular-accessible-units, modular accessible node, modular accessible passage nodes, and the load-bearing three-dimensional-conductor-accommodative-passage-and-support-matrix may have periodical repetitive bar encoding to accommodate ongoing evolutionary computer-assisted status updating of all poke-through integrated floor/ceiling conductor management systems and matrix conductor components by means of hand-held or rolling bar code readers.

One or more of any type of conventional conductors and preassembled conductor assemblies may have bar encoding periodically and repetitively disposed along the entire length of the conductors disposed within the load-bearing three-dimensional-conductor-accommodative-passage-and-support-matrix to facilitate reading of conductor type, class, capacity, assigned function, and the like, for the purpose of providing ongoing evolutionary bar code reading input directed to a computer for ongoing status updating and identification in the evolutionary conductor management system of this invention.

The modular-accessible-units are arranged in a discretely selected special replicative accessible pattern layout and assembled into the array by means of an accessible flexible joint. The array of modular-accessible-units is held in place flexibly and accessibly over the load-bearing three-dimensional-conductor-accommodative-passage-and-support-matrix by gravity, friction, and assemblage and sometimes also by registry.

The pattern layouts are defined by the shapes of the modular-accessible-units, which generally are squares, rectangles, triangles, or linear planks, with or without biased corners, and the modular accessible nodes which have shapes complementary to the shapes of the modular-accessible-units and which fit into the spaces created by the adjacent intersecting biased corners of the modular-accessible-units.

All modular accessible nodes or potential modular accessible node sites may be activated or non-activated or may be merely potential modular accessible node sites for possible later use. The modular accessible nodes can be easily located because of the distinctive shape, pattern, color, material or texture of their flush decorative access covers and because of the 45 degree rotation to match the biased corners of the modular-accessible-units, which distinguish them from the modular-accessible-units in the array.

The activated and non-activated modular accessible nodes in the array of modular-accessible-units may be disposed in a multiaxial pattern in multiples of 1 to 9 in any direction, i.e., modular accessible nodes may be disposed multiaxially in every one, two, three, 4, 5, 6, 7, 8, and 9 potential modular accessible node sites. The occupying of a particular modular accessible node site by a modular accessible node may be determined by the functional prescribed needs of the user or by the evolutionary needs of the user as personnel and equipment are added, deleted or moved.

The potentially selectable modular accessible node sites may accommodate modular accessible nodes
modular accessible passage nodes
modular accessible poke-through nodes
modular accessible plank nodes
modular accessible device nodes
modular accessible sensor nodes
modular accessible connection nodes
modular accessible juncture nodes.

The modular accessible nodes and modular accessible node boxes may be compartmentalized so that different types of utility services may be separated if required or desired. Two or more compartments in a single modular accessible node or modular accessible node box effectively separate power conductors, for example, from voice conductors, data conductors, text conductors, video conductors, fiber optic conductors, environmental control conductors, signal conductors, fluid conductors, and the like, providing personal, conductor, and equipment safety and electromagnetic interference and radio frequency interference benefits.

Modular accessible nodes may be located at various depths within the assembly. Some possibilities are:

entirely above the load-bearing three-dimensional-conductor-accommodative-passage-and-support-matrix and entirely within the depth of the modular-accessible-units, the top of the modular accessible nodes being flush with the top surface of the modular-accessible-units partially within the depth of the load-bearing three-dimensional-conductor-accommodative-passage-and-support-matrix and partially within the entire depth of the modular-accessible-units, the top of the modular accessible nodes being flush with the top surface of the modular-accessible-units partially within the depth of the modular-accessible-units and partially above the modular-accessible-units partially within the depth of the load-bearing three-dimensional-conductor-accommodative-passage-and-support-matrix, partially within the entire depth of the modular-accessible-units, and partially above the modular-accessible-units entirely within the depth of the load-bearing three-dimensional-conductor-accommodative-passage-and-support-matrix.

Modular accessible node boxes may be made of pressure stamped or formed metal, may be cast of cementitious concrete or polymer concrete, factory- or site-manufactured of cut and glued cementitious board or polymer concrete board, and the like. The sides provide for cutout, knockout, and punchout holes to accommodate receptacles or conductor passage. A variety of different types of modular accessible node boxes, made of the above described types of construction and materials, may be used, such as:

factory-manufactured load-bearing modular accessible node boxes factory-manufactured non-load-bearing modular accessible node boxes site-assembled non-load-bearing modular accessible node electrical enclosure components, the components for each enclosure comprising interchangeable vertical side plates having cutout, knockout and punchout locations for receptacles and for passage of matrix conductors with or without connectors preassembled onto the matrix conductors through vertical side plates, the sides of corner plinths vertically slotted to receive the vertical side plates, the horizontal base surface providing the bottom for the enclosure site-assembled non-load-bearing modular accessible node electrical enclosure components, the components for each enclosure comprising a bottom closure plate, the interchangeable vertical side plates having cutout, knockout and punchout locations for receptacles and for passage of matrix conductors through the vertical side plates, and the sides of corner plinths slotted to receive the vertical side plates besides being a straight plate, the vertical side plate may have an inward-facing leg to accommodate the bottom closure plate other versions include vertical side plates with an outward-facing leg or a double T-shaped leg facing both inward or outward the bottom plate may be fastened to the vertical side plates by any number of methods, such as, mechanical fastening by screws, pins, and the like adhesive, sealant, or adhesive-backed foam riveting or welding magnets uniaxial load-bearing three-dimensional-conductor-accommodative-passage-and-support-matrix having interchangeable vertical side plates on all sides of an electrical enclosure, the height of the vertical side plates equal to the approximate depth of the load-bearing three-dimensional-conductor-accommodative-passage-and-support-matrix a biaxial load-bearing three-dimensional-conductor-accommodative-passage-and-support-matrix having interchangeable vertical side plates on one or more sides of an electrical enclosure, the height of the vertical side plates equal to the approximate depth of the load-bearing three-dimensional-conductor-accommodative-passage-and-support-matrix, and having interchangeable vertical side plates on two or more sides of the electrical enclosure, the height of the vertical side plates equal to one half the approximate depth of the load-bearing three-dimensional-conductor-accommodative-passage-and-support-matrix, the vertical sides having cutout, knockout and punchout locations to accommodate receptacles and the passage of the matrix conductors through the vertical side plates a multiaxial load-bearing three-dimensional-conductor-accommodative-passage-and-support-matrix having on the first axis interchangeable vertical side plates on one or more sides of a modular accessible node, the height of the vertical side plates equal to the approximate depth of the load-bearing three-dimensional-conductor-accommodative-passage-and-support-matrix, having on the second axis interchangeable vertical side plates on one or more sides of the modular accessible node, the height of the vertical side plates equal to two-thirds the approximate depth of the load-bearing three-dimensional-conductor-accommodative-passage-and-support-matrix, and having interchangeable vertical side plates along a third axis equal to one-third the approximate depth of the load-bearing three-dimensional-conductor-accommodative-passage-and-support-matrix, the vertical sides having cutout, knockout and punchout locations to accommodate the passage of the matrix conductors through the vertical side plates.

The modular accessible nodes and node boxes may have any polygonal shape, the preferred shapes being squares, rectangles, linear rectangles, triangles, hexagons, and octagons, and may be of various sizes suitable for use in the spaces formed by the adjacent intersecting biased corners of the modular-accessible-units and at the ends of modular-accessible-planks.

Modular accessible nodes may also be round in shape. For cast, molded, and cut units, the corners of the modular-accessible-units may be segmentally configured in plan view to have a partial circular blockout in the open-faced bottom tension reinforcement containment or temporary mold to form round apertures to accommodate the complementary shape of the round modular accessible nodes when the intersecting adjacent circular corner segments are assembled. Other special shapes may be similarly configured.

The cast plate of a modular-accessible-paver may have many configurations. In plan view, one or all the corners may be square, may be rounded to produce small convex or concave passages for single or multiple conductors, may be rounded to produce large convex or concave conductor passages, may be biased by cutting diagonally at a 45 degree angle to produce small conductor passages and accommodation for full-size modular accessible nodes. The modular-accessible-pavers may also have beveled or eased edges top and bottom to provide a more even appearance to the finished floor.

The accessible flexible joints between the modular-accessible-pavers may be a dynamic-interactive-fluidtight-flexible-joint comprising an elastomeric sealant an unfilled, fractionally spaced-apart butt joint a fractionally spaced-apart butt joint filled with an elastomeric sealant a spaced-apart butt joint between adjacent modular-accessible-pavers, each having a layer of foam adhered to two sides of the paver, such that a single layer of foam fills each joint a spaced-apart joint between adjacent modular-accessible-pavers, each having a layer of foam adhered to all sides of the paver, such that a double layer of foam fills each joint a spaced-apart butt joint ranging in width from 0.065 inch (1.5 mm) to 0.250 inch (6 mm) accommodating the passage of return air and supply air through a linear insert in the joint for personalized comfort control For convenience, it is preferred that the sides created by the biased corners be of equal length and that the remaining sides also be of equal length, but not necessarily equal to the length of the sides created by the biased corners. For example, where a square modular-accessible-unit has biased corners, resulting in an octagon, the modular accessible node is a square with the sides equal to the sides created by the biased corners of the modular-accessible-unit. Where a triangular modular-accessible-unit has biased corners, resulting in a hexagon, the modular-accessible-unit is a hexagon with the sides equal to the sides created by the biased corners of the modular-accessible-unit.

To have biased corners producing sides of unequal length would make it difficult and impractical, except by means of computer-assisted flexible automated factory manufacturing, to work out a pattern with complementary sides matching the sides of the unequal biased corners. The drawings show some of the typical discretely selected special replicative accessible pattern layouts claimed by the teachings of this invention.

Not all corners of the modular-accessible-unit must be biased. For example, this invention describes a workable pattern developed by having triangular modular-accessible-units with only two biased corners, resulting in pentagonally shaped modular-accessible-units. The resulting pattern shows 6 5-sided modular-accessible-units clustered around a junction point having no modular accessible node while 6 hexagonally shaped modular accessible nodes are located at the outer perimeter of the cluster. The pattern is repeated throughout the array.

Although this invention includes equilateral octagons and hexagons produced, respectively, by biasing the corners of squares or triangles, where the modular-accessible-units are large the modular accessible nodes become so large as to be impractical in many ordinary applications. For example, if the crosswise width span of an equilateral octagon is 24 inches (60 cm), the sides of the resulting modular accessible node are almost 10 inches (25 cm) in length, which would generally provide an excessive amount of accessibility space for most conductor passage and connection situations, except in special situations in manufacturing plants, research facilities, and the like.

Therefore, it is generally preferred that the sides of the hand access openings in the modular accessible nodes range in length from 4 inches (10 cm) to 8 inches (20 cm). Modular accessible node boxes may be the same size as the modular accessible node hand access openings or 2 inches (5 cm) to 6 inches (15 cm) greater in size than the modular accessible node hand access openings.

Where the modular accessible nodes are merely to provide an opening for passage of conductors from below the load-bearing three-dimensional-conductor-accommodative-passage-and-support-matrix to equipment disposed above the array of modular-accessible-units with no modular accessible node box to be located in the modular accessible node site, the modular accessible node may be even smaller, generally no smaller than 1 inch (2.5 cm) on a side although, for passage of a single small conductor, ⅜ inch (10 mm) on a side is feasible. Modular accessible plank nodes are generally 1 inch (2.5 cm) to 4 inches (10 cm) in width and with no real limit as to length when used with modular-accessible-plank floors.

The teachings of this invention provide functionally important and desirable combinations of this invention as in the following illustrated examples:

modular-accessible-units with biased corners of 4-inch (10 cm) length plus corresponding 4 inch by 4 inch (10 cm by 10 cm) modular accessible nodes plus 4 inch by 4 inch (10 cm by 10 cm) modular accessible passage nodes for the functional desirable flexibility of having connectivity for cordsets and conductor passage nodes at any functionally required potential modular accessible node site within the array of modular-accessible-units modular-accessible-units with biased corners of 4-inch (10 cm) length plus corresponding 4 inch by 4 inch (10 cm by 10 cm) modular accessible nodes plus 4 inch by 4 inch (10 cm by 10 cm) modular accessible passage nodes plus 4 inch by 4 inch (10 cm by 10 cm) modular accessible poke-through nodes for the functionally desirable flexibility of having connectivity for cordset nodes, conductor passage nodes, and poke-through nodes at any functionally required potential modular accessible node site within the array of modular-accessible-units.

The modular-accessible-units may include any of the following:

modular-accessible-tiles, which also include modular-accessible-laminates and modular-accessible-carpets modular-accessible-planks modular-accessible-pavers modular-accessible-matrix-units.

The modular-accessible-units may have any polygonal shape having three or more sides, which complements and accommodates the shape of the modular accessible nodes which are disposed in the spaces created by adjacent intersecting biased corners of the modular-accessible-units.

The modular-accessible-units have varying width-to-length ratios and thicknesses as follows:

modular-accessible-tiles—width-to-length ratio of 1 to 1 or greater and less than 1 to 2 and a thickness of 1 percent to 20 percent of the greater span modular-accessible-planks—width-to-length ratio of 1 to 2 or greater and less than 1 to 60 and a thickness of 1 percent to 20 percent of the shorter span modular-accessible-pavers—width-to-length ratio of 1 to 1 or greater and less than 1 to 2 and a thickness of 10 percent to 50 percent of the greater span modular-accessible-matrix-units—width-to-length ratio of 1 to 1 or greater and less than 1 to 60 and a thickness of 1 percent to 10 percent of the shorter span.

The modular-accessible-units may comprise suspended structural load-bearing cast plates which are tightly abutted and which may be joined at their edges by a spaced-apart accessible flexible joint. The spaced-apart accessible flexible joint may be an elastomeric sealant or an unfilled butt joint. The cast plates may be supported at external points of bearing which may be the perimeter sides of the cast plate, the adjacent intersecting biased corners of the cast plates, or a combination of the perimeter sides and adjacent intersecting biased corners of the cast plates in a single simple span without cantilevers. Each suspended structural load-bearing cast plate must have at least three external points of bearing.

The cast plates may be adapted to accommodate any of the following types of spans:

A single simple span without biased corners

A single simple span with biased corners

A single simple span with cantilevers and without biased corners

A single simple span with cantilevers and with biased corners

A multiple continuous span without biased corners a multiple continuous span with biased corners A multiple continuous span with cantilevers and without biased corners A multiple continuous span with cantilevers and with biased corners.

It is obvious that a basic cast plate modular-accessible-tile of this invention would be a square, rectangular or triangular cast plate modular-accessible-tile without the biased corners illustrated in the drawings.

The suspended structural load-bearing cast plates are divided into ranges of thickness as follows:

Micro thickness—up to and including ½ inch (12 mm)

Mini thickness—greater than ½ inch (12 mm) and less than 1 inch (2.5 cm)

Maxi thickness—greater than 1 inch (2.5 cm) and no greater than 8 inches (20 cm)

The cast plates are manufactured by filling an open-faced bottom tension reinforcement containment with an uncured concrete matrix having bonding characteristics for developing a permanent, structural bond between the open-faced bottom tension reinforcement containment and the concrete matrix when cured, forming thereby a suspended structural load-bearing monolithic dimensionally stable composite cast plate.

The uncured concrete matrix is placed in the open-faced bottom tension reinforcement containment for curing. The required permanent structural bond is obtained between the concrete matrix and the open-faced bottom tension reinforcement containment once curing has taken place by one or more means, such as, the following:

By texturing the inner surfaces of the open-faced bottom tension reinforcement containment by sandblasting, scarifying, texturing, embossing, perforating, or otherwise roughening By selecting the concrete matrix from one of the following:

cementitious concrete additive-enhanced cementitious concrete, one or more additives being selected from silica fume, latex, acrylic, latex-acrylic, polyester, epoxy, organic and inorganic colorings, and the like bond-enhancing, additive-modified cementitious concrete to which one or more bond enhancers and additives have been added, such as, silica fume, latex, acrylic, latex-acrylic, polyester, epoxy, and the like polymer concrete By formulating the cementitious concrete mix of aggregates and binders to produce normal weight concrete, lightweight concrete, insulating concrete, foam concrete, and the like, in the light of the desirability of using as light a weight of concrete as possible, consistent with durability, strength, bond, and appearance By formulating the cementitious concrete mix with any type of binder cement, such as, pozzolan cement, portland cement, portland-pozzolan cement, integrally colored cement, and the like Optimally grading and selecting the aggregates to fill the pores between the larger aggregates in the concrete matrix, such as, river sand, silica sand, gravel, slag pumice, perlite, vermiculite, expanded shale, crushed stone, marble chips, marble dust, metallic filings, calcium carbonate, ceramic microspheres, plastic microspheres, and the like By formulating a polymer concrete mix with any type of resin, such as, polyester, polyester-styrene, styrene, epoxy, vinylester, vinyl, methyl methacrylate, urethane, furan, and the like, as well as any new type of resin not specifically named herein since new resins are continually being developed It is generally accepted that polymer concrete comprises a mix wherein the water used in conventional cementitious concrete mixes is replaced with the polymer resin and catalyst and absolutely dry aggregates are used. However, polymers may also be used as additives in cementitious concrete mixes and this method is disclosed herein. Also new polymer concrete mixes are being developed wherein the dry aggregates are not required to be absolutely dry, and this method is usable in the teachings of this invention.

The cast plates may also be manufactured by placing an uncured concrete matrix in a temporary mold as in single mold casting. The uncured concrete matrix may be densified in the mold by one or more methods, such as, vibration, shocking, adding metallic filings, and the like. Special mechanized casting methods may also be used, such as, multiple mold dewatered casting, multiple eggcrate mold casting, the use of heavy duty hydraulic presses, mechanical presses, air pod presses, and the like. These methods are particularly appropriate for manufacturing suspended structural load-bearing mold-cast plates and cast paver plates where a permanent bottom tension reinforcement containment is not desired. After demolding and curing, the cast plates form a monolithic, dimensionally stable load-bearing unit. The uncured concrete matrix may be further enhanced:

The top surface of the cast plate seeded with decorative aggregate

The cast plate seeded with decorative aggregate throughout its entire depth

Forming or routing of a grid pattern in one or both faces of the cast plate and filling with a decorative accent material or reinforcement Forming of a grid pattern in the wearing surface layer of the cast plate by placing reinforcing bars or mesh in the wearing surface layer and bonding the reinforcing to the cast plate by means of a surface tension reinforcing layer comprising a coating in sufficient thickness to embed, adhere and permanently cover the reinforcing The coating may be applied in more than one layer and in different colors so that the wearing off of the top layer through use may be visually detected and the top layer of the coating reapplied Forming a grid by forming or routing grooves in one or both surfaces of a cast plate to accommodate reinforcing bars or mesh and bonding the reinforcing to the cast plate by means of a tension reinforcing layer comprising a coating in sufficient thickness to embed, adhere and permanently cover the reinforcing in the groove and, additionally, cover the entire face of the cast plate The integral wearing surface embossed by means of roll-in pressure, press-in pressure, embossed pattern hand press-in pressure, roll-in and press-in pressure, mechanical press pressure, air pod press pressure, hydraulic press pressure, and the like, to provide improved slip resistance, crack resistance, and appearance The addition of retarders to produce exposed aggregate cast units for receiving after curing a coated wearing surface, the coating producing a uniform flush height to the units.

NOTE: The coating comprising the tension reinforcing layer and the coated wearing surface described in the preceding three paragraphs may be urethane, polyester, vinyl, vinylester, acrylic, melamine, epoxy, furan, and the like.

A cast plate modular-accessible-plank is made in the same manner as other cast plate modular-accessible-units. It may have a flat bottom or the deformed generally hat shape described for other cast plate modular-accessible-units of this invention. Its long linear shape makes it suitable for multiple continuous spans on the long axis and for simple spans on the short axis, with and without cantilevers, to fit the linear nature of conductor runs for access in corridors and aisles between office and manufacturing equipment, partitions, counters, desks, and the like, in office, commercial, educational, manufacturing facilities, and the like.

The cast plate modular-accessible-planks are arranged in a pattern layout with several corresponding modular accessible node types. The modular-accessible-planks may be of uniform or random lengths and of uniform or random widths. The ends of the modular-accessible-planks may be lined up in a soldier pattern, may be staggered at midpoint in the plank or may be randomly staggered in their discretely selected special replicative accessible pattern layout wherein the nodes are correspondingly disposed as dictated by evolutionary functional needs.

The potential node sites and the nodes accommodated by modular-accessible-planks are of several types. Modular accessible nodes, modular accessible passage nodes, and modular accessible poke-through nodes are accommodated in any array of modular-accessible-planks by means of biased corners or notches in the perimeter sides on either the long or short axis. Modular accessible plank nodes are narrow nodes disposed at the spaced-apart ends of the modular-accessible-planks. As with other types of cast plate modular-accessible-units, cast plate modular-accessible-planks are disposed over matrix conductors accommodated within a load-bearing three-dimensional-conductor-accommodative-passage-and-support-matrix.

The open-faced bottom tension reinforcement containment is formed by any means, such as, die stamping, rollforming, precision cutting, vacuum forming, injection molding, and the like, to obtain a replicative, precision-sized, permanent mold, thus producing a precision-sized self-forming cast plate. The open-faced bottom tension reinforcement containment is made of any suitable material, such as, metal, plastic, fiber-reinforced cementitious board, polymer concrete, multi-layer scrims impregnated with cement, multi-layer scrims impregnated with resin, hardboard, and the like. The materials may be conductive or non-conductive.

The conductive materials are discretely selected and assembled to provide modular-accessible-units having electric resistance in conformance with applicable provisions of National Fire Protection Association Standard 99 so that conductive wearing surface materials, when combined with the open-faced bottom tension reinforcement containment and the reinforcement in the reinforced cementitious concrete and reinforced polymer concrete materials, provide singularly or in combination one or more the following benefits:

electromagnetic interference radio frequency interference electrostatic discharge electromagnetic interference drainoff grounding means radio frequency interference drainoff grounding means electrostatic discharge drainoff grounding means.

The open-faced bottom tension reinforcement containment may be generally flat rectangular in cross-sectional profile or generally inverted-hat-shape. The use of a deformed bottom or an inverted-hat-shape profile provides increased weight reduction while retaining strength and stiffness at the points of maximum moment, permanent mechanical bonding of the concrete matrix to the open-faced bottom tension reinforcement containment, and increased conductor passage below the perimeter edge zone of the cast plate. The inverted-hat-shaped modular-accessible-unit cross-sectional profile offers equally beneficial structural, weight, and cost advantages for modular-accessible-planks with a long linear accessible shape corresponding to the inherently long linear nature of many of the matrix conductors accommodated in the load-bearing three-dimensional-conductor-accommodative-passage-and-support-matrix.

The bottom of the open-faced bottom tension reinforcement containment may be deformed for greater strength of the resulting cast plate and to allow the use of cross-sectional shapes which are lighter in weight as a result of using less concrete than conventional flat shapes with rectangular cross-sectional profiles. By the teachings of this invention, the deformed bottom may also have a star, grid, dimple, perforated pattern or the like.

The open-faced bottom tension reinforcement containment for the modular-accessible-unit has a cross-sectional shape configured to fit three different structural zones within the cast plate, which include the following:

The center zone of greatest internal moment and thicker depth

The intermediate zone of intermediate internal moment and shear, which is smaller in thickness than either the center zone of greatest internal moment or the perimeter edge zone The perimeter edge zone which includes alternating perimeter bearing zones at perimeter sides abutting the perimeter bearing zones at perimeter sides of adjacent cast plates and perimeter bearing zones at biased corners which coincide with the biased corners of the cast plates, the perimeter edge zone providing greater shear strength to the suspended structural load-bearing cast plate.

The open-faced bottom tension reinforcement containment for the modular-accessible-unit may also have a cross-sectional shape configured to fit five different structural zones within the cast plate, which include the following:

The center zone of greatest internal moment and thicker depth

The intermediate sloping transition zone between the shallow depth zone and the center zone The shallow depth zone The outer sloping transition zone between the shallow depth zone and the outer load-bearing zone of thicker depth and greatest internal shear The outer load-bearing zone of thicker depth and greatest internal shear The internal moment and shear stress in the shallow depth zone are medium, permitting reduction of the cast plate modular-accessible-unit by a shallower depth which, by deforming the bottom of the containment, also stiffens the open-faced bottom tension reinforcement containment and in part increases the bond between the concrete matrix and the inside face of the containment.

The open-faced bottom tension reinforcement containment has tightly formed corners to properly contain the uncured concrete matrix. The open-faced bottom tension reinforcement containment may be constructed as follows:

an open-faced bottom tension reinforcement containment comprising a bottom and three or more integral sides an open-faced bottom tension reinforcement containment comprising a bottom and three or more integral sides with inward-extended flanges an open-faced bottom tension reinforcement containment comprising a bottom and three or more integral sides with outward-extended flanges an open-faced bottom tension reinforcement containment comprising a bottom and three or more integral sides with inward-extended flanges horizontally engaged in perimeter linear protective edge reinforcement strips with a cushion-edge shape an open-faced bottom tension reinforcement containment created by affixing a channel to each of the sides of a flat sheet, the bottom surface of the bottom flange of the channel affixed to the top surface of the flat sheet an open-faced bottom tension reinforcement containment created by affixing a channel to each of the sides of a flat sheet, the top surface of the bottom flange of the channel affixed to the bottom surface of the flat sheet an open-faced bottom tension reinforcement containment created by affixing a channel to each of the sides of a flat sheet, the top surface of the bottom flange of the channel affixed to the bottom surface of an offset in the side of the flat sheet to form a flat coplanar bottom surface for the open-faced bottom tension reinforcement containment an open-faced bottom tension reinforcement containment created by affixing a channel to the top surface of each of the sides of a flat sheet, the bottom flange of the channel horizontally engaged in a perimeter linear protective edge reinforcement strip with a cushion-edge shape an open-faced bottom tension reinforcement containment created by affixing an angle to each of the sides of a flat sheet, the bottom surface of the horizontal leg of the angle affixed to the top surface of the flat sheet an open-faced bottom tension reinforcement containment created by affixing an angle to each of the sides of a flat sheet, the top surface of the horizontal leg of the angle affixed to the bottom surface of the flat sheet an open-faced bottom tension reinforcement containment created by affixing an angle to each of the sides of a flat sheet, the top surface of the horizontal leg of the angle affixed to the bottom surface of an offset in the side of the flat sheet to form a flat coplanar bottom surface for the open-faced bottom tension reinforcement containment an open-faced bottom tension reinforcement containment created by affixing an angle to each of the sides of a flat sheet, the vertical leg of the angle vertically engaged in perimeter linear protective edge reinforcement strips with a cushion-edge shape an open-faced bottom tension reinforcement containment created by affixing a perimeter linear protective edge reinforcement strip with a cushion-edge shape to each of the sides of a flat sheet, the perimeter linear protective edge reinforcement strip becoming an integral laminated edge when the uncured concrete matrix is cured.

The channels and angles forming the sides of the open-faced bottom tension reinforcement containment may be affixed to the flat sheets forming the bottom of the open-faced bottom tension reinforcement containment by any means including the following:

mechanically affixed
mechanically fastened
adhesively affixed
thermoplastically adhered
thermoplastically fused
thermoplastically welded
metallically welded
ultrasonically welded
engagement affixed
containment engagement affixed
interlocking engagement affixed
interlocking engagement containment affixed.

The sides of the open-faced bottom tension reinforcement containment may be generally vertical, sloping inward or sloping outward.

The perimeter linear protective edge reinforcement strips of the open-faced bottom tension reinforcement containment may be made of any type of vinyl, rubber, metal, wood, plastic, laminated high-pressure laminates, laminated melamine, natural stone, manmade stone, and the like. The protective edge reinforcement strips may have hard edges, resilient edges, cushion edges. They may be extruded, pultruded, injection molded, cast, and the like.

Where the open-faced bottom tension reinforcement containment is made of metal, the turned-up perimeter edges can be any of the following, those illustrated in the drawings, or the like:

an edge integrally formed with the open-faced bottom tension reinforcement containment and having an inward-extending horizontal flange, the top surface of the concrete matrix being flush with the top surface of the flange a separate edge piece forming the turned-up perimeter edge attached to a flat sheet forming the bottom of the containment, the edge folded over to form a double edge with a horizontal flange extending horizontally into the cast plate approximately at midheight an edge integrally formed with the containment and folded to form an inwardly extending, double-thickness horizontal flange an edge integrally formed with the containment and folded to form an inwardly extending horizontal flange and a second downwardly and outwardly extending flange, the edge providing a stiffened and embedded edge with a greater bond with the concrete matrix to be placed in the containment an edge integrally formed with the containment and folded to form an inwardly extending horizontal flange and a second downwardly extending and generally vertical flange, the edge providing a stiffened and embedded edge with greater bond with the concrete matrix to be placed in the containment an edge integrally formed with the containment and folded to form an outwardly extending horizontal flange between adjacent modular-accessible-tiles an edge integrally formed with the containment and folded to form an outwardly extending horizontal double flange between adjacent modular-accessible-units an edge integrally formed with the open-faced bottom tension reinforcement containment and having a flange extending horizontally or vertically into a slot prepared in a perimeter linear protective edge reinforcement strip with a cushion-edge shape at approximately one-half the height of the concrete matrix, the perimeter linear protective edge reinforcement strip made of one or more rigid, semi-flexible or flexible materials selected from the group consisting of plastic, rubber, vinyl, elastomeric, wood, and metal an inward-facing metal angle affixed to a flat sheet forming the open-faced bottom tension reinforcement containment, the top surface of the concrete matrix being flush with the top surface of the generally vertical leg of the angle, the metal angle affixed to the flat sheet by any of the following, or the like:

the bottom surface of the horizontal leg of the angle being affixed to the top surface of the flat sheet the top surface of the horizontal leg of the angle being affixed to the bottom surface of the flat sheet the top surface of the horizontal leg of the angle being affixed to the bottom surface of an offset in the side of the flat sheet to form a flat coplanar bottom surface for the open-faced bottom tension reinforcement containment an inward-facing metal channel affixed to the top surface of a flat sheet forming the open-faced bottom tension reinforcement containment, the top surface of the concrete matrix being flush with the top surface of the channel, the metal channel being affixed to the flat sheet by the following, or the like:

the bottom surface of the bottom flange of the channel being affixed to the top surface of the flat sheet the top surface of the bottom flange of the channel being affixed to the bottom surface of the flat sheet the top surface of the bottom flange of the channel being affixed to the bottom surface of an offset in the side of the flat sheet to form a flat coplanar bottom surface for the open-faced bottom tension reinforcement containment the bottom flange of the channel horizontally engaged in a perimeter linear protective edge reinforcement strip with a cushion-edge shape.

Exposed-to-wear edges may beneficially be covered with an enduring metal facing or an enduring facing of rubber, vinyl, other plastic or the like. Metals may be bronze, brass, stainless steel, zinc, aluminum, and the like. Durable coatings and paints, such as, epoxy, urethane, vinyl, acrylic, vinyl-acrylic, polyester, and the like, may also be used to coat the exposed-to-wear surfaces of the metal edge of the open-faced bottom tension reinforcement containment.

The open-faced bottom tension reinforcement containment forming the cast plate of a modular-accessible-tile or a modular-accessible-paver has a crosswise width span equal to unity or multiples thereof and a foreshortened diagonal width span ranging from unity to 1.4 times unity correspondingly proportionate to the crosswise width span. The foreshortened diagonal width span is obtained by biasing the corners of the modular-accessible-units to accommodate the modular accessible nodes. The diagonal width span is foreshortened to obtain a number of synergistic multi-functional results, such as:

the accommodation of the modular accessible nodes in the space created by adjacent intersecting biased corners the support of each modular-accessible-unit at the external points of bearing, such as the perimeter sides of the cast plate, the biased corners of the cast plate, a combination of the perimeter sides and the biased corners of the cast plate the provision of hand aperture access openings for plugging in and disconnecting equipment cordsets and for servicing receptacles for multiple utility services in the modular accessible nodes disposed in the spaces created by the adjacent intersecting biased corners of the cast plates access to the matrix conductors accommodated in the load-bearing three-dimensional-conductor-accommodative-passage-and-support-matrix below the array of modular-accessible-units without having to make cutouts through the cast plates to accommodate connectivity devices, air supply and return grilles, and the like, as is prevalent in the known art interchangeability of one modular-accessible-unit for another is a prominent feature of this invention the necessity of cutting apertures in the computer access floor panels of the existing art and installing connectivity boxes in the panels makes interchangeability of the panels and access to the conductors below the panels difficult.

The structural open-faced bottom tension reinforcement containment provides the structural reinforcement required by the suspended structural load-bearing cast plate when the cast plates are loaded as single simple spans, single simple spans with cantilevers, multiple continuous spans, and multiple continuous spans with cantilevers.

In a single simple span, the foreshortening of the diagonal width span results in the proportionate reduction of the internal moment, external moment, deflection, internal stress, and shear generally by a factor approaching or equal to unity divided by the square root of 2. The reduction provides a cast plate of lighter weight, greater cost effectiveness, and the following characteristics:

the cast plate having its greatest thickness determined by the maximum moment occurring within the center zone of greatest moment portion of the resulting crosswise width span the cast plate having its least thickness to reduce weight determined by the lower intermediate internal moment and lower intermediate shear at the intermediate zone surrounding the center zone of greatest moment of the resulting crosswise width span the cast plate having the thickness of its perimeter edge zone increased an amount sufficient to carry the shear which is greatest at the external points of bearing the foreshortened diagonal width span being an amount equal to unity, greater than unity or less than 1.4 times unity the crosswise width span being equal to unity the full corner-to-corner diagonal width span shortened to the foreshortened diagonal width span to accommodate the modular accessible nodes in the spaces created by the adjacent intersecting biased corners the balanced diagonal width span extending from one biased corner diagonally to another biased corner.

In a single simple span for a cast plate having an equilateral octagon shape with a balanced diagonal width span without cantilevers, the foreshortening of the diagonal width span results in the proportionate reduction of the internal moment, external moment, deflection, internal stress, and shear generally by a factor approaching or equal to unity divided by the square root of 2. The reduction provides a cast plate of lighter weight, greater cost effectiveness, and the following characteristics:

the cast plate having its greatest thickness determined by the maximum moment occurring within the center zone of greatest moment portion of the resulting crosswise width span the cast plate having its least thickness to reduce weight determined by the lower intermediate internal moment and lower intermediate shear at the intermediate zone surrounding the center zone of greatest moment of the resulting crosswise width span the cast plate having the thickness of its perimeter edge zone increased an amount sufficient to carry the shear which is greatest at the external points of bearing the foreshortened diagonal width span being an amount equal to unity and equal to the crosswise width span the crosswise width span being equal to unity and equal to the foreshortened diagonal width span the full corner-to-corner diagonal width span shortened to the foreshortened diagonal width span to accommodate the modular accessible nodes in the spaces created by the adjacent intersecting biased corners the balanced diagonal width span extending from one biased corner diagonally to another biased corner.

The cast plate may beneficially be reinforced by any suitable means at the following points:

The open-faced bottom tension reinforcement containment

Bond reinforcement between the concrete matrix and the open-faced bottom tension reinforcement containment Supplementary bottom reinforcement to provide bottom tension reinforcement inherent to the open-faced bottom tension reinforcement containment when also using the enhanced bond of the concrete matrix to the open-faced bottom tension reinforcement containment Top tension reinforcement of the concrete matrix General fiber reinforcement throughout the concrete matrix to enhance cast plate ductility and cast plate wearing surface ductility Reinforcement of the top wearing surface.

The open-faced bottom tension reinforcement containment is preferably structural, forming the bottom tension reinforcement of the cast plate by the bonding of the concrete matrix to the open-faced bottom tension reinforcement containment and forming an integral containment form for the ingredients of the concrete matrix which harden to structurally bond to the open-faced bottom tension reinforcement containment and form an integrally bonded load-bearing compression plate with a top wearing surface with limited ability to carry cantilevers.

Increasing the bond between the cementitious concrete matrix and the open-faced bottom tension reinforcement containment adds material bottom tension reinforcement to the cast plate since cementitious concrete is weak in tension. A bond-enhancing, additive-modified cementitious concrete may be used containing one or more bond enhancers and additives, such as, silica fume, latex, acrylic, latex-acrylic, polyester, epoxy, and the like, to increase the bond between the cementitious concrete matrix and the open-faced bottom tension reinforcement containment.

By the teachings of this invention, a cast plate, typically a modular-accessible-paver, has one or more tension reinforcement layers externally applied. A number of methods are used, all benefitting from proper surface preparation. A moldcast compression and filler core has its two opposing faces and all sides cleaned of all laitance and other surface impurities by abrasive sanding, shot blasting, abrasive blasting, all with dust removal, or by an acid wash followed by a thorough cleaning rinse and drying. All surfaces receive a primer coat.

A resin bonded protective wearing layer ranging in thickness from 0.002 inch to 0.250 inch (0.05 mm to 6 mm) is bonded to the moldcast core, providing enhanced structural and protective resin encapsulation, serving as an externally applied tension reinforcement layer, and producing a modular-accessible-paver that is good two sides.

High tension resin reinforcing grooves may be formed in the opposing faces of the moldcast compression and filler core. When the grooves are filled with the material forming the resin bonded protective wearing layer which is bonded to the face of the moldcast core, additional external reinforcement is provided, resulting in a high tension reinforcement layer being applied.

The high tension resin reinforcing grooves also may accommodate additional reinforcing, such as, metal or plastic round reinforcing bars, round deformed bars, square bars, rectangular bars, flat bars, U-shaped bars, T-shaped bars, strands and fibers, plastic strands and fibers, ceramic strands and fibers, or mineral strands and fibers. These types of reinforcing may be used singly or in combination. A tension reinforcement resin layer which fills the high tension resin reinforcing grooves and bonds to the opposing faces and all sides of the moldcast core may also be provided. The tension reinforcement resin layer also bonds the reinforcing to the faces of the moldcast core by way of the grooves. The tension reinforcement resin layer ranges in thickness from 0.010 inch to 0.250 inch (0.25 mm to 6 mm). A resin bonded protective wearing layer is then bonded to the top surface of the tension reinforcement resin layer to produce additional external reinforcement. To increase bond between the two layers, the tension reinforcement resin layer may be sanded before the resin bonded protective wearing layer is applied.

The resin binders, used singly or in combination, may be any available resins which will form a tough, durable protective encapsulation, such as, polyester, polyester-styrene, styrene, epoxy, vinylester, vinyl, methyl methacrylate, urethane or furan. To provide additional reinforcing and greater economy, one or more types of fibers may be combined with the resin binders, such as, plastic, fiberglass, metal, wood, mineral or organic fibers. Granular filler material may also be added to the resin binders, such as, graded sand, glass beads, ceramic beads, carborundum or conductive powders.

Internal reinforcement may be provided for the moldcast compression and filler core. Two layers of reinforcement are spaced in equidistantly from the surface of the opposing faces at the surface or as close to the surface or to the grooves as possible.

The tension reinforcement resin layer and the resin bonded protective wearing layer may beneficially be provided in different colors so that the user may more easily see when the wearing layer has begun to wear off, signaling the need for repair, renewal or replacement of the wearing layer or reversing the good-two-sides modular-accessible-paver.

Conductive fillers may be added to the resin bonded protective wearing layer for grounded electrostatic discharge of the two opposing faces of the moldcast core through the sides of the modular-accessible-paver to provide a quality drainoff ground for each modular-accessible-paver by contact with a grounded metallic supporting layer.

The resin bonded protective wearing layer, the tension reinforcement resin layer, and the filling for the high tension resin reinforcing grooves may be applied by a number of methods, including electrostatic powder deposit, spraying, laying and spraying, casting, rolling, brushing and the like. Application may be by automated or manual methods.

A preformed permanent perimeter edge may be applied by adhesion, mechanical fastening or integral casting with the moldcast compression and filler core.

The perimeter edge may be formed of any material, such as vinyl, natural and synthetic rubbers, acrylic, nylon, polyethylene, polyolefin, ABS, metal and the like. It may be formed, cast, extruded, pultruded, injection molded, vacuum heat formed, rollformed, press formed, and the like. The perimeter edge may be a high density hard edge, a medium density hard edge, a low density soft edge, an impact-resistant edge, a cushion edge, a flexible edge, and the like. It may have holes to accommodate mechanical fastening to the sides of the moldcast plate.

The perimeter edge is generally fractionally deeper than the sides of the moldcast core and provides a very shallow containment to receive successive applications of the tension reinforcement resin layer and the resin bonded protective wearing layer. It may have various configurations, including the following:

a channel shape a channel shape with two short legs, the legs having edges beveled inward or outward to increase bond with the tension reinforcement resin layer and the resin bonded protective wearing layer a T-shaped cross section formed by a projection at midpoint in its depth, the projection fitting into a groove made in the sides of the moldcast core and helping to align and bond the perimeter edge in place a T-shaped channel formed by a projection at midpoint in its depth, the projection fitting into a groove made in the sides of the moldcast core and helping to align and bond the perimeter edge in place.

The teachings of this invention allow for the combination of any tension reinforcement layers, reinforcement types, perimeter edges, and materials in any thickness or configuration. Where a modular-accessible-paver does not have a preformed permanent perimeter edge, the sides of the moldcast core may be ground, sanded, joined or numerically control routed or sawn to produce a straighter, truer side.

Whereas most of the above disclosure refers to a moldcast compression and filler layer made of concrete, the teachings of this invention also show the moldcast core to be of other virgin or recycled materials, such as, solid metal, perforated metal, any type of metal pressure stamping or forming means or metal casting means, dense rigid foam, dense flexible foam, any type of cast polymer or injection-molded polymer, any type of plastic, cast gypsum, any type of elastomeric material, including cast natural rubber or cast manmade rubber, embossed stamping out of wood fibers, solid or laminated woods, plywood, microlam plywood, particleboard, oriented particleboard or hardboard. Concrete may include any type of cementitious concrete, polymer concrete or gypsum concrete, and the like.

This process produces a durable wearing layer for use in industrial buildings, warehouses, commercial and institutional installations, especially suitable for use where forklift trucks require a strong, durable finish and automatic guided vehicles benefit from accessible floors. The process also provides a modular-accessible-paver that is good two sides, giving the user in harsh industrial and commercial environments a floor having longer life, greater economy, balanced construction, recyclability, renewability, higher performance for high technology environments requiring heavy loading, accessibility and reconfigurability. Selected solid wastes may also be beneficially used.

As well as producing other enhancements, such as, ductility and strength, polymer concrete has good inherent bonding properties and may also be used to achieve an enhanced bond between the polymer concrete matrix and the open-faced bottom tension reinforcement containment and to reinforce the cast plate.

The open-faced bottom tension reinforcement containment may have the bottom or sides reinforced to enhance bond, increase bottom tension reinforcement beyond the amount provided by the open-faced bottom tension reinforcement containment, and enhance composite interaction by one or more of the following means:

two or more uniaxial coplanar reinforcing bars welded, fused or adhered to the bottom of the open-faced bottom tension reinforcement containment two or more uniaxial deformed reinforcing bars welded, fused or adhered to the bottom of the open-faced bottom tension reinforcement containment two biaxial coplanar layers of reinforcing bars, the first layer placed in one direction and welded, fused or adhered to the bottom of the open-faced bottom tension reinforcement containment the second layer placed on top of and crosswise to the first layer and welded, fused or adhered to the first layer a two-way lay-in grid of woven wire cloth deformed to be periodically spot welded, fused or adhered to the open-faced bottom tension reinforcement containment and spaced fractionally above the bottom of the open-faced bottom tension reinforcement containment to enhance bond a two-way lay-in grid of expanded material deformed to be periodically spot welded, fused or adhered to the open-faced bottom tension reinforcement containment and spaced fractionally above the bottom of the open-faced bottom tension reinforcement containment to enhance bond a two-way lay-in grid of perforated material deformed to be periodically spot welded, fused or adhered to the open-faced bottom tension reinforcement containment and spaced fractionally above the bottom of the open-faced bottom tension reinforcement containment to enhance bond a two-way lay-in grid of hardware cloth deformed to be periodically spot welded, fused or adhered to the open-faced bottom tension reinforcement containment and spaced fractionally above the bottom of the open-faced bottom tension reinforcement containment to enhance bond a two-way lay-in grid of wire mesh deformed to be periodically spot welded, fused or adhered to the open-faced bottom tension reinforcement containment and spaced fractionally above the bottom of the open-faced bottom tension reinforcement containment to enhance bond a two-way lay-in grid of lathing supported above the bottom of the open-faced bottom tension reinforcement containment a two-way lay-in grid of reinforcing fabric resting on upwardly disposed projections on the bottom of the open-faced bottom tension reinforcement containment a plurality of upwardly disposed perforations in the bottom of the open-faced bottom tension reinforcement containment for maximizing bond a plurality of inwardly disposed perforations in the sides of the open-faced bottom tension reinforcement containment for maximizing bond a plurality of upwardly disposed perforations in the bottom and inwardly disposed perforations in the sides of the open-faced bottom tension reinforcement containment for maximizing bond When the open-faced bottom tension reinforcement containment has large perforations, a thin layer of fluidtight paper or plastic may beneficially be applied externally to the open-faced bottom tension reinforcement containment to contain the concrete matrix. In most cases, however, the concrete matrix mix is sufficiently stiff not to require this exterior encapsulation.

When the cast plate is a single simple span with cantilevers or a multiple continuous span with or without cantilevers, the concrete matrix of the cast plate may have top tension reinforcement placed beneficially just below the top of the concrete matrix on legs, chairs or the like attached to the bottom of the top tension reinforcement by tying, welding, fusing or adhering by any suitable means to properly position the top reinforcement just below the top of the concrete matrix, thereby increasing the ability of the cast plate to handle negative internal moments created by multiple continuous spans and cantilevers.

The top tension reinforcement of the concrete matrix of the cast plate may be any suitable reinforcement means, such as, hardware cloth, welded wire fabric, woven wire cloth, metallic reinforcing mesh, steel reinforcing bars, deformed steel reinforcing bars, plastic reinforcing bars, deformed plastic reinforcing bars, steel fibers, plastic fibers, polymer reinforcing mesh, glass fibers, fiberglass reinforcing mesh, organic plant fibers, and the like.

In general, the cast plate requires reinforcing, except where the thickness-to-span ratio is less than 1 to 8. The top and bottom tension reinforcement near the top and bottom exterior faces comprises one or more means, such as:

two or more uniaxial coplanar reinforcing bars two or more uniaxial deformed reinforcing bars two biaxial coplanar layers of reinforcing bars, the first layer placed in one direction, and the second layer placed on top of and crosswise to the first layer and welded, fused, adhered or tied to the first layer a two-way lay-in grid of woven wire cloth a two-way lay-in grid of expanded material a two-way lay-in grid of perforated material a two-way lay-in grid of hardware cloth a two-way lay-in grid of wire mesh a two-way lay-in grid of lathing a two-way lay-in grid of reinforcing fabric.

General fiber reinforcement throughout the concrete matrix of the cast plate may be used by itself or in combination with any of the other types of reinforcement disclosed herein. In addition to general reinforcement of the cast plate, the cast plate ductility and the ductility of the wearing surface of the cast plate are enhanced. Steel fibers, plastic fibers, glass fibers, and the like are dispersed throughout the concrete matrix by one or more of the following means:

uniform dispersement of the reinforcement, followed by vibrating and shocking into place uniform dispersement and pressure troweling the reinforcement into position pressing and compacting into place placing the concrete matrix in layers, alternating with uniformly dispersed layers of reinforcement fibers.

The top wearing surface of the cast plate may be reinforced by means of placing additional reinforcement, such as, steel fibers, steel fiber mats, plastic fibers, plastic fiber mats, glass fibers, glass fiber mats, metallic filings, and the like, in the top portion of the concrete matrix, generally in the top ⅛ inch (3 mm) to ½ inch (13 mm) of the cast plate. The reinforcement may be added by any means, such as, one or more of the means discussed above for general reinforcement.

The ingredients in the uncured concrete matrix for the cast plates are thoroughly blended by any of a number of existing mix methods and equipment and then placed in the open-faced bottom tension reinforcement containment which serves as a permanent mold. The ingredients may be placed in the container all at the same time and mixed. Alternatively, two or more ingredients may be placed in the container and mixed, any remaining ingredients added to the mixture one or more at a time and mixed. These known methods work equally well for the cementitious concrete mixes and for the polymer concrete mixes, and the order in which ingredients are added to the mix may vary. With some polymer concrete resins, benefits result from holding placement of the catalysts until the latest stage possible.

Percolation may be used in polymer concrete mixes and entails the placement of the dry ingredients in the open-faced bottom tension reinforcement containment, dispersement spraying or pouring the polymer resin and catalyst over the dry ingredients which have been well blended, and allowing the polymer resin and catalyst to percolate or filter down through the dry ingredients to form a blended mix. A first application of polymer resin and catalyst may be made to the inside of the open-faced bottom tension reinforcement containment prior to placement of the dry ingredients therein. The order in which the polymer resin and catalyst is applied may also be reversed. Percolation may be utilized in one or more succeeding layers.

To assist in obtaining a cohesive, thoroughly compacted mix and eliminating voids in the cured concrete matrix, the open-faced bottom tension reinforcement containment containing the cementitious concrete mix or polymer concrete mix, whether mixed or percolated, may be vibrated, shocked, vibrated and shocked, or shocked and vibrated.

Curing of the cementitious concrete cast plates of this invention is obtained by means of enclosed steam curing, enclosed wet saturation curing, enclosed wet saturation and heat curing, curing in a super-insulated envelope, or by a combination of two or more of these methods. Curing of polymer concrete cast plates of this invention is accomplished quickly by conventional room-temperature curing means and by supplementary heat or radiation curing of the known art.

The suspended structural load-bearing cast plates have a number of wearing surfaces. An integral wearing surface may be produced by open-faced casting in the open-faced bottom tension reinforcement containment, the cast plate and the integral wearing surface being any of the following, or the like:

a cast plate of cementitious concrete having an integral wearing surface a terrazzo cast plate of cementitious concrete having selected aggregates and an integral wearing surface, the cured terrazzo cast plate being precision ground for flatness of the integral wearing surface, precision gauged to thickness, and precision fine ground and polished for appearance grade and functional wearing surface a cast plate of polymer concrete having an integral wearing surface a terrazzo cast plate of polymer concrete having selected aggregates and an integral wearing surface, the cured terrazzo cast plate precision ground for flatness of the integral wearing surface, precision gauged to thickness, and precision fine ground and polished for appearance grade and functional wearing surface.

Selected aggregates, such as, washed gravel, natural stone chips, manmade stone chips, and the like, may be included in the integral wearing surface of the terrazzo cast plates.

A densified wearing surface may be applied integrally into the top surface of the uncured concrete matrix at the time of casting. The densified wearing surface may include any type of resin or cementitious cement with bonded metallic filings. The bonded metallic filings are troweled into position to form the densified wearing surface.

A coating wearing surface may be applied to the cured top surface of the concrete matrix. Suitable coatings are urethane, polyester, vinyl, vinylester, furan, acrylic, melamine, epoxy, and the like.

An applied wearing surface may be applied by adhesive means to the top surface of the concrete matrix of the cast plates after full curing has taken place. Suitable materials include rubber, vinyl, linoleum, cork, leather, high-pressure laminate, composition, ceramic tile, quarry tile, brick, paver, stone, hardwoods, softwoods, metal, carpet, and the like.

The cast plates may have an applied wearing surface applied integrally just after casting into the top surface of the uncured concrete matrix placed in the open-faced bottom tension reinforcement containment. The applied wearing surface may be ceramic tiles, quarry tiles, cementitious concrete tiles, polymer concrete tiles, stone tiles, brick tiles, marble tiles, granite tiles, treated hardwood tiles, and treated softwood tiles, and the like. To enhance bond, a bonding agent may be rolled, poured, sprayed or curtain coated on one or both surfaces—the under side of the applied wearing surface and the uncured concrete matrix. The bonding agent may be any material compatible with the concrete matrix, such as, acrylic, latex, latex-acrylic, polyester, vinylester, vinyl, epoxy, urethane, furan, styrene, polyester-styrene, other resins, natural and manmade elastomers, and the like.

An alternate method of integrally applying the applied wearing surface to the uncured concrete matrix is to use the open-faced bottom tension reinforcement containment in part as a conventional mold or form. The applied wearing surface face is placed face down on a platen. The open-faced bottom tension reinforcement containment is placed open-face-down over the applied wearing surface and the uncured concrete matrix is placed in the open-faced bottom tension reinforcement containment through two or more holes in the upturned bottom of the open-faced bottom tension reinforcement containment on top of the applied wearing surface. The casting is allowed to cure and the cured cast plate is formed as a single composite finished product comprising an open-faced bottom tension reinforcement containment, a concrete matrix core, and an applied wearing surface. A bonding agent as previously disclosed may be applied to the top surface of the uncured concrete matrix or to the under side of the applied wearing surface, or to both. A bond breaker or release agent may be applied by any means to the surface of the platen to assure the release of the cured cast plate. The cast plates may beneficially be compressed and compacted to increase their load-carrying capability by means of gravity hand pressure, roller pressure, hydraulic pressure, compressed air pressure, and the like.

The treatment of the hardwood and softwood tiles is selected from the known art from applied finishes, preservative impregnation, monomer impregnation followed by polymerization by means of the introduction of a catalyst, monomer impregnation followed by polymerization by means of irradiation, and vacuum monomer impregnation followed by polymerization by means of vacuum irradiation.

The vitreous, semi-vitreous, concrete, and natural stone applied wearing surfaces may also be treated to obtain a penetrating, durable finish by the same means described for the monomer impregnation and polymerization of hardwood and softwood tiles. The materials must be treated prior to application of the applied wearing surfaces to the cast plates. The preferred method of treatment for these materials and the wood materials is by vacuum monomer impregnation followed by polymerization by means of vacuum irradiation.

According to known art, drying or semi-drying oils may be impregnated into the pores of the applied wearing surfaces to produce stain-resistant qualities after they have been impregnated with a monomer and the monomer has been polymerized. The oils which may be used are linseed, tung, lemon, tall, perilla, soybean, sunflower, cottonseed, gunstock, oitica, dehydrated castor oil, and the like.

The cast plates may have accent joints routed in the wearing surface and filled with accent strips of wood, vinyl, rubber or elastomeric sealant. Alternatively, the accent strips for modular-accessible-units of micro thickness may be disposed directly in the open-faced bottom tension reinforcement containment and the concrete matrix cast around the accent strips. Accent strips in modular-accessible-units of mini or maxi thickness may have the wearing surface laminated to a core filler of alternative materials to accommodate the greater thickness of the concrete matrix. The accent strips may be aligned and held in place by means of stiffening ribs, strips of perforations or barbs, and the like in the bottom of the open-faced bottom tension reinforcement containment. Accent strips of metal, such as, T-shapes, angles, channels, and the like may be integrally cast face up or cast face down against alignment and positioning jigs. All accent joints may be attached to the top tension reinforcement and cast face up or cast face down.

The polygonally-shaped suspended structural load-bearing cast paver plates are disposed over a load-bearing three-dimensional-conductor-accommodative-passage-and-support-matrix comprising coplanar spaced-apart load-bearing assembly bearing pads. Matrix conductors are accommodated by the assembly bearing pads and in the spaces between the assembly bearing pads. A flexible modular positioning layer, typically a flexible sheet and sometimes comprising a vapor barrier, may be disposed over the horizontal base surface, which may be a cushioning-granular substrate or a new or existing concrete slab. A granular substrate layer may be placed between the horizontal base surface and the flexible modular positioning layer. Finally, the suspended structural load-bearing cast paver plates are disposed over the assembly bearing pads.

A fluidtight membrane having perimeter sides and penetrations thereof turned up from 0.500 inch (12 mm) to 6 inches (15 cm) may be installed to prevent leakage of fluids through the floor and the ceiling below to spaces below. This feature prevents fluids from toilet and sink overflows and from functioning and malfunctioning automatic sprinkler systems leaking through the floor/ceiling system and causing damage in lower floors.

A predetermined pattern layout of assembly bearing pad bearing points may be marked on the top surface of the flexible modular positioning layer to position the assembly bearing pads. The assembly bearing pads may be disposed loose laid on the markings. A foam horizontal-disassociation-cushioning-layer may be loose laid above or below the flexible modular positioning layer at least at the bearing point markings to provide cushioning and enhanced impact sound isolation. Further, the foam horizontal-disassociation-cushioning-layer may have adhesive on both its faces, typically a peel-off, self-stick adhesive type, and may adhere the bottom of the assembly bearing pads to the pattern layout on the flexible modular positioning layer.

Alternatively, the assembly bearing pads may be positioned in a predetermined pattern layout on a concrete slab by template and adhered to the slab by a sealant, an adhesive or a layer of adhesive-backed foam.

The assembly bearing pads may be rigid assembly registry bearing pads, elastomeric assembly registry bearing pads, rigid assembly engagement registry bearing pads, and the like. The assembly bearing pads may have registry points which coincide with mating registry points on the underside of the cast paver plates.

The assembly bearing pads may be replicatively manufactured of a number of materials, such as, dense flexible foam, dense rigid foam, any type of cast cementitious concrete or cast polymer concrete, any type of cast gypsum or cast gypsum concrete, any type of cast natural rubber or cast manmade rubber, any type of cast polymer or injection-molded polymer, or any type of metal pressure stamp forming means or metal casting means, and of any virgin or recycled plastic, rubber or metal materials.

The assembly bearing pads are loaded in a single simple span mode or single span with cantilevers mode to limit inherently the internal balancing moment tension stress to a range between 5 percent and 30 percent of the cured compressive strength of the cast pave plate and to an amount less than the load-to-span induced internal moment tension stresses when the cast paver plate is arranged in a selected replicative accessible pattern layout.

Moldcast plates may be replicatively manufactured of a number of materials, such as, dense flexible foam, dense rigid foam, any type of cast cementitious concrete or cast polymer concrete, any type of cast gypsum or cast gypsum concrete, any other type of material made with resin binders and cement binders, any type of cast natural rubber or cast manmade rubber, any type of cast polymer or injection-molded polymer, or any type of metal pressure stamp forming means or metal casting means. Other acceptable methods include cutting out to shape, heat and pressure forming, and embossed stamping out of wood fibers, solid woods laminated, plywood, microlam plywood, particleboard, oriented particleboard, and hardboard. Moldcast plates may be assembled into patterns by scrim layers, plastic and rubber single-ply or multi-ply laminated sheets, uniaxis strips, crosswise strips formed into grids, or any type of plastic, metal, cementitious, or wood-based sheet.

The unreinforced moldcast plates and the unreinforced cast paver plates have a span-to-thickness ratio ranging from to 1 to 1 to 8 to 1 and also a thickness and a span-to-load ratio sized to limit the internal balancing moment tension stresses to a range between 5 percent and 30 percent of the cured compressive strength of the units and to an amount less than the load-to-span induced external moment tension stress. The cast plates are precision sized, identically replicated for complete interchangeability. When the corners of the cast plates have biased corners, modular accessible nodes are accommodated at the intersecting adjacent corners.

A flexible spline along one axis may join the edges of the moldcast plates. The combination of sloped abutting edges, eased edges, and flexible splines allows the removal of one or more moldcast plates by means of a hinging action along one side of the plate and lifting up the plate without damaging the edges.

The horizontal base surface may be any horizontal-base-surface previously disclosed in my previous patents, such as, a suspended structural floor, a concrete slab at grade or below grade, a granular substrate at grade or below grade, and the like, or may be one of the horizontal-base-surfaces disposed and positioned as follows:

above-grade-level suspended structural floor system
grade-level base floor system
grade-level suspended floor system
grade-level suspended structural floor system
below-grade-level base floor system
below-grade-level suspended floor system
below-grade-level suspended structural floor system
flat structural base surface
structural three-dimensional-conductor-accommodative-passage-and-support-matrix forming a part of a time/temperature fire-rated floor/ceiling assembly when combined with beams and girders and accommodating one or more layers of matrix conductors in one or more directions and utilizing a coordinated layout for accommodating poke-through devices.

The suspended structural horizontal base surface for the poke-through integrated floor/ceiling conductor management system of this invention, disclosed hereinafter, with which the load-bearing three-dimensional-conductor-accommodative-passage-and-support-matrix is integrated, may be any one of the following suspended horizontal base surfaces:

concrete flat one-way slab
concrete ribbed one-way slab
concrete corrugated one-way slab
concrete joists with integrally cast concrete slab
concrete two-way joists forming waffle flat slabs with integrally cast concrete slab
concrete one-way flat slab with fireproofed steel beams and girders
concrete two-way flat slab
concrete two-way flat slab with drop panels
concrete two-way flat slab with fireproofed steel beams and girders
precast single and multiple cellular shapes, such as, tees, multiple tees with linear open tops, I's, W's, M's, rotated C's with linear open tops, rotated E's with linear open tops
precast hollow-core slab
precast cellular slab
precast ribbed slab
precast flat slab
precast flat slab panels with reinforced metal edges
precast concrete joists and cast-in-place flat slab
precast concrete joists and precast flat slab
precast concrete joists and precast flat slab panels with reinforced metal edges
precast concrete beams and cast-in-place flat slab
precast concrete beams and precast flat slab
precast concrete beams and precast flat slab panels with reinforced metal edges.

The matrix conductors may be any power, electronic, fiber optic, fluid, power superconductivity, power semiconductivity, electronic superconductivity, and electronic semiconductivity conductors produced in any form, such as, the following:

flat conductor cable
ribbon conductor cable
round conductor cable
multi-conductor cable
oblong multi-conductor cable
oval conductors
round multiple conductors
composite conductor cable
jacketed conductor cable
EMI jacketed conductor cable
RFI jacketed conductor cable
coaxial cable
twisted pair cable
fiber optic cable
control monitoring cable
drain-off grounding conductors
fluid conductors serving
plumbing piping systems
plumbing fixture systems
fluid systems
working fluid systems
refrigerant systems
exhaust systems
hydraulic systems
compressed air systems
vacuum systems
life safety systems
sprinkler systems
fire suppression systems
standpipe systems
low Delta t hot and cold supply and return systems
hot and chilled water supply and return systems
steam supply and return systems The teachings of this invention describe poke-through integrated floor/ceiling conductor management systems including arrays of suspended structural load-bearing modular-accessible-units, arrays of suspended structural load-bearing modular-accessible-units plus modular accessible nodes, modular accessible passage nodes and modular accessible poke-through nodes, and arrays of suspended structural load-bearing modular-accessible-matrices disposed over matrix conductors of all types which are accommodated within a load-bearing three-dimensional-conductor-accommodative-passage-and-support-matrix which is disposed over a suspended structural horizontal base surface. The load-bearing three-dimensional-conductor-accommodative-passage-and-support-matrix accommodates one or more matrix conductors. To improve sound isolation, a horizontal-disassociation-cushioning-layer of elastic foam or the like is disposed at all points of bearing on at least one coplanar level. The load-bearing three-dimensional-conductor-accommodative-passage-and-support-matrix is adhered to the suspended structural horizontal base surface or, alternatively, the load-bearing three-dimensional-conductor-accommodative-passage-and-support-matrix is loose laid over the top surface of the suspended structural horizontal base surface.

The poke-through integrated floor/ceiling conductor management systems for new construction have time/-temperature fire-rated poke-through devices previously known to the art precision located and modularly disposed at potential modular accessible poke-through node sites. Each modular accessible poke-through node of the poke-through integrated floor/ceiling conductor management system communicates through the suspended structural horizontal base surface by means of the time/temperature fire-rated poke-through device from a floor modular accessible poke-through node to a ceiling modular accessible poke-through node to accommodate the passage of matrix conductors from within the load-bearing three-dimensional-conductor-accommodative-passage-and-support-matrix.

The floor modular accessible poke-through node comprises one of the following:

a junction box for the modular accessible poke-through node disposed below the center area of a modular-accessible-unit and accommodated within the load-bearing three-dimensional-conductor-accommodative-passage-and-support-matrix and communicating with selected types of matrix conductors a modular accessible poke-through node disposed between adjacent modular-accessible-units of the array and disposed within the load-bearing three-dimensional-conductor-accommodative-passage-and-support-matrix and communicating with selected types of matrix conductors.

The ceiling modular accessible poke-through node comprises one of the following:

a ceiling modular accessible poke-through node communicating to and terminating to an outlet box for communicating with a single exposed-to-view fixture for lighting, speakers, detectors, sensors, and the like, with the outlet box concealed by trim and the single fixture one or more ceiling modular accessible poke-through nodes communicating to and terminating to an exposed-to-view uniaxial, biaxial or triaxial single cell or multi-cell raceway channel matrix with termination concealed by trim of the channel matrix one or more ceiling modular accessible poke-through nodes communicating to and terminating to an exposed-to-view uniaxial, biaxial, triaxial integrated fluorescent channel fixture having a combination conductor passage channel and fixture channel matrix accommodating power, lighting, sensors, and detection conductors, and the like.

In new work, the elements making up the poke-through integrated floor/ceiling conductor management system are modularly disposed and coordinated before the potential modular accessible poke-through node sites to accommodate the poke-through devices are cast or cut. The potential modular accessible poke-through node sites are selectively integrated and coordinated as to their positions with the modular position, spacing, and size of the modular-accessible-units, the modular-accessible-units plus modular accessible nodes and modular accessible passage nodes, or the modular-accessible-matrix-units so they are disposed in a discretely selected special replicative accessible pattern layout which is integrated to the size and modularly coordinated spacing of top and bottom reinforcement in the joists, beams and girders of the suspended structural horizontal base surface and the location of utilities, electrical and electronic conductors, mechanical and electrical equipment, the load-bearing three-dimensional-conductor-accommodative-passage-and-support-matrix, and the ceiling below the suspended structural horizontal base surface. Precision-sized apertures for accommodating modular accessible poke-through nodes are cast into the suspended structural horizontal base surface or cut through the suspended structural horizontal base surface at the potential modular accessible poke-through node sites.

In retrofit work, the discretely selected special replicative accessible pattern layout is modularly coordinated by means of metallic-sensing equipment, exploratory investigations, as-built drawings, original drawings, and field observation with the position of the existing beams, the existing top and bottom reinforcing in the suspended structural horizontal base surface, the existing utilities, services, and conductors.

An important distinction between the teachings of this invention and the known art is that each poke-through device is accessed and connected to from above through a modular-accessible-unit, a modular accessible node or a modular-accessible-unit plus modular accessible node, rather than from below as in the conventional manner of the known art. The poke-through device may also be accessed from below the suspended structural horizontal base surface. The poke-through devices have their power and electronic connectivity supplied from above the suspended structural horizontal base surface by the matrix conductors accommodated in the load-bearing three-dimensional-conductor-accommodative-passage-and-support-matrix, rather than from below as in the known art.

The discretely selected special replicative accessible pattern layout of modular-accessible-units, modular-accessible-units plus modular accessible nodes, modular accessible passage nodes or modular accessible poke-through nodes, and modular-accessible-matrix-units must have a size and a pattern which facilitates the coordination of the potential modular accessible poke-through node sites for the placement of the poke-through devices relative to the spacing of the top and bottom reinforcement in and the spacing of beams, joints in the suspended structural horizontal base surface, and top and bottom reinforcement of the suspended structural horizontal base surface. Modularly coordinated spacing of the elements in uniaxial, biaxial or triaxial parallel patterns of straight rows accommodates the passage of matrix conductors and permits accessibility to the poke-through devices and matrix conductors so the poke-through devices can be activated, deactivated, initially installed, and later installed in the modular accessible poke-through nodes. The poke-through devices are connected to the matrix conductors accommodated within the load-bearing three-dimensional-conductor-accommodative-passage-and-support-matrix and are accessed from above through the modular-accessible-units, the modular-accessible-units plus modular accessible nodes or the modular-accessible-matrix-units. The poke-through devices may be accessed from below, either through the integral ceiling formed by the suspended structural horizontal base surface or through a ceiling disposed below the suspended structural horizontal base surface.

The modular-accessible-units, modular accessible nodes, modular accessible passage nodes, modular accessible poke-through nodes, and the load-bearing three-dimensional-conductor-accommodative-passage-and-support-matrix may have periodical repetitive bar encoding to accommodate ongoing evolutionary computer-assisted status updating of all poke-through integrated floor/ceiling conductor management systems and matrix conductor components.

One or more of any type of conventional conductors and preassembled conductor assemblies may have bar encoding periodically and repetitively disposed along the entire length of the conductors disposed within the load-bearing three-dimensional-conductor-accommodative-passage-and-support-matrix to facilitate reading of conductor type, class, capacity, assigned function, and the like, for the purpose of providing ongoing evolutionary bar code reading input directed to a computer for ongoing status updating and identification in the evolutionary conductor management system of this invention.

One or more horizontal-disassociation-cushioning-layers may be disposed at points of bearing to provide increased sound isolation.

EMBODIMENTS

Figure 1:
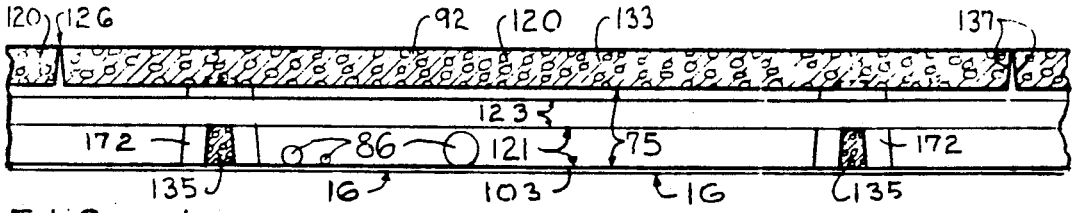
FIG. 1 is an enlarged, transverse, sectional view of the suspended structural load-bearing moldcast plate of this invention.

NOTE: Where I have indicated like reference numerals, the elements have the same designation, meaning, and function as described in previous or subsequent embodiments.

THE FIRST EMBODIMENT OF THIS INVENTION

Referring to the drawings, FIGS. 1–4 show cross-sectional views of the suspended structural load-bearing moldcast plates 120 of this invention for use as light duty, medium duty, and heavy duty industrial floors providing accessible conductor accommodation and conductor management.

Figure 2:
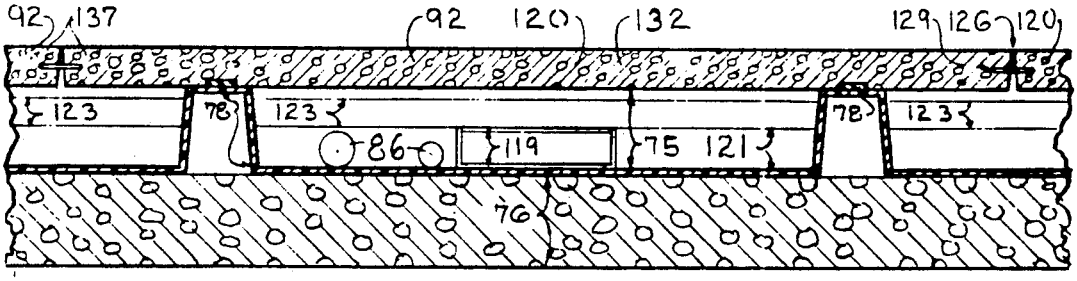
FIG. 2 is an enlarged, transverse, sectional view of the suspended structural load-bearing moldcast plate of this invention.
Figure 3:
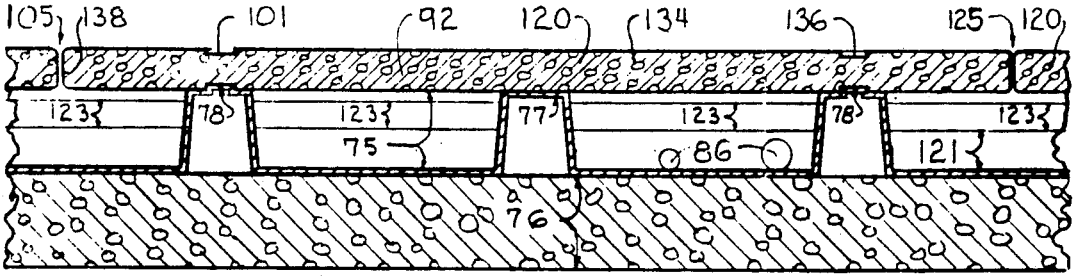
FIG. 3 is an enlarged, transverse, sectional view of the suspended structural load-bearing moldcast plate of this invention.
Figure 4:
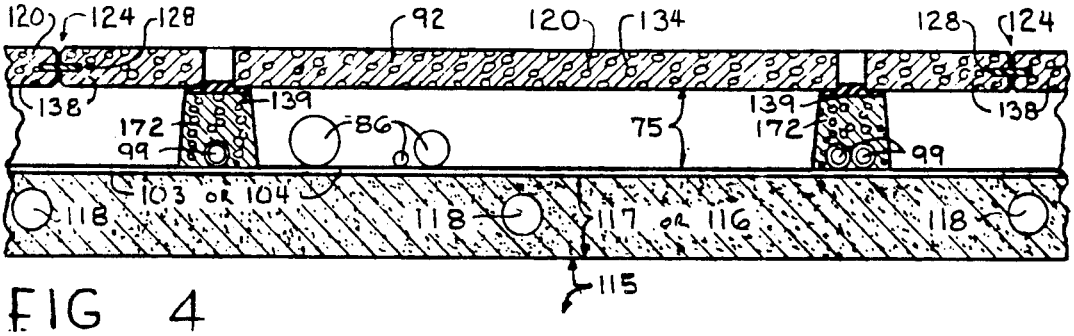
FIG. 4 is an enlarged, transverse, sectional view of the suspended structural load-bearing moldcast plate of this invention.
Figure 5:
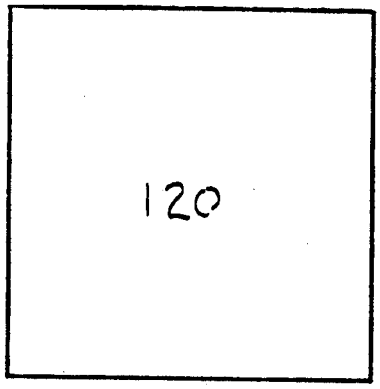
FIG. 5 is a top plan view of the suspended structural load-bearing moldcast plate of this invention.
Figure 6:
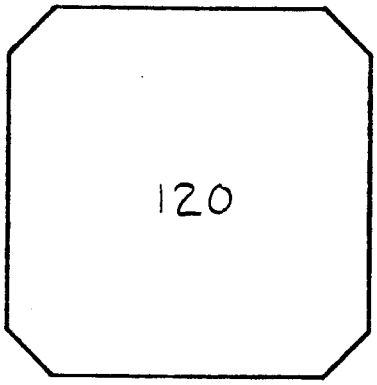
FIG. 6 is a top plan view of the suspended structural load-bearing moldcast plate with biased corners of this invention.

FIG. 1 and FIG. 2 are taken as cross sections through FIG. 5 and FIG. 6 or cross sections through polygonal shapes. FIG. 3 and FIG. 4 are taken as cross sections through FIG. 7 and FIG. 8 or cross sections through other polygonal shapes.

FIG. 1 shows a horizontal-base-surface 16 covered by a flexible modular positioning layer 103. Over the flexible modular positioning layer 103 is disposed a load-bearing three-dimensional-conductor-accommodative-passage-and-support-matrix 75 comprising matrix conductors 86, a lower layer of lay-in and pull-under matrix conductors 121, an upper layer of lay-in matrix conductors 123 disposed crosswise to the lower layer 121 and supported by a partial-height support rail 135 which is disposed along the same axis as the lower layer 121. Modular-accessible-units 92 comprising suspended structural load-bearing moldcast plates 120 are disposed over plinths 172. The moldcast plates 120 have sloped abutting sides 137, are good one side 133, and have accessible flexible-assembly-joints with eased edges 126.

The flexible modular positioning layer 103 and its related version comprising a vapor barrier 104 can be integrated into the assembly in various ways. It may be disposed over a horizontal base surface 76 or a granular substrate layer 116 or a granular underdrain substrate layer 117. A horizontal-disassociation-cushioning-layer 18 may be placed above or below the flexible modular positioning layer 103 or 104, providing cushioning and enhanced impact sound isolation. A horizontal-disassociation-cushioning-layer 17 may be placed above or below the flexible modular positioning layer 103, 104 at the bearing points of the assembly bearing pads 100, conductor channels 119, cross-type assembly bearing pads with points of registry 141, clustered-type plinth assembly bearing pads 142, and other types of load-bearing supports. The flexible modular positioning layer 103 may have markings placed on its top surface at predetermined locations to assist in properly positioning the assembly bearing pads 100 and other load-bearing supports. The assembly bearing pads 100 and other load-bearing supports may be affixed to the flexible modular positioning layer by means of an adhesive layer on both faces of the horizontal-disassociation-cushioning-layer 17 placed below the supports.

FIG. 2 shows a horizontal base surface 76 covered by a load-bearing three-dimensional-conductor-accommodative-passage-and-support-matrix 75. Disposed within the load-bearing three-dimensional-conductor-accommodative-passage-and-support-matrix 75 are conductor channels 119, illustrated points of registry and bearing 78, matrix conductors 86, a lower layer of lay-in and pull-under matrix conductors 121, and an upper layer of lay-in matrix conductors 123 disposed crosswise to lower layer 121. Modular-accessible-units 92 comprising suspended structural load-bearing moldcast plates 120 with sloped abutting sides 132 to facilitate removal of modular-accessible-units 92 by lifting up two adjacent units, and which have one good wearing surface, are disposed over the load-bearing three-dimensional-conductor-accommodative-passage-and-support-matrix 75. The moldcast plates 120 have registry apertures on the underside for mating with the points of registry and bearing 78. The moldcast plates 120 have sloped abutting sides 137 and accessible flexible-assembly-joints with eased edges 126. A flexible spline 129 along one axis joins the edges of the moldcast plates 120. The combination of sloped abutting sides 137 and flexible splines 129 allows the removal of one or more modular-accessible-units 92 by means of a hinging action along one side of the modular-accessible-unit 92 without damaging the edges of the modular-accessible-unit 92.

FIG. 3 shows a horizontal base surface 76 over which is disposed a load-bearing three-dimensional-conductor-accommodative-passage-and-support-matrix 75 comprising matrix conductors 86, a lower layer of lay-in and pull-under matrix conductors 121, an upper layer of lay-in matrix conductors 123 disposed crosswise to lower layer 121 and supported on a partial-height support rail 135 disposed along the same axis as the lower layer 121, illustrated points of bearing 77 without registry, and illustrated points of registry and bearing 78. Modular-accessible-units 92 comprising suspended structural load-bearing moldcast plates 120 which are good two sides 134 are disposed over the load-bearing three-dimensional-conductor-accommodative-passage-and-support-matrix 75. The moldcast plates 120 have vertical abutting sides 138 and accessible flexible-assembly-joints 105 with bullnose edges 125. The moldcast plates 120 have registry points 101 cast in both faces of the moldcast plates 120, the registry points 101 mating with the points of registry and bearing 78. On the top face of the moldcast plate 120, an insert plug 136 is fitted into the registry points 101. The insert plug 136 is removed when the moldcast plate 120 is reversed and is inserted in the registry points 101 of the new face of the moldcast plate 120.

FIG. 4 shows a subgrade 115 over which is disposed a granular substrate layer 116 (or a granular underdrain substrate layer 117 accommodating underdrains 118.) A flexible modular positioning layer 103 or a flexible modular positioning layer comprising a vapor barrier 104 is disposed over the substrate layer 116, 117. Over the flexible modular positioning layer 103, 104 is disposed a load-bearing three-dimensional-conductor-accommodative-passage-and-support-matrix 75 accommodating matrix conductors 86. FIG. 4 illustrates conductors running along a single axis in contrast to the conductors running on multiple axes as illustrated in FIGS. 1-3.

Also accommodated are fluid conductors 99 which transfer heat or cooling working fluids to the array of modular-accessible-units 92 comprising moldcast plates 120 so the array of moldcast plates 120 becomes a low Delta t radiative surface for radiative heating or cooling of interior occupied spaces over large surface areas. The array of moldcast plates 120 also becomes an absorptive surface of low Delta t heat from electrical and electronic equipment sitting on the array of moldcast plates 120 as well as from excess waste heat derived from production equipment, from diffuse and heat beam solar radiation transmission through vertical, sloping and horizontal transmissive surfaces by the greenhouse phenomenon, from internal radiative vertical wall, ceiling, and furnishings sources, and from body heat of people occupying the interior spaces, returning this waste heat to the fluid conductors 99.

In FIG. 4, the moldcast plates 120 are good two sides 134 and are disposed over the load-bearing three-dimensional-conductor-accommodative-passage-and-support-matrix 75. The moldcast plates 120 have registry apertures in both faces to mate with elastomeric registry wafers, blanks, coins or washers 139 applied to the top of the load-bearing plinths 172. The moldcast plates 120 have vertical abutting sides 138 and accessible flexible-assembly-joints with beveled edges 124. The moldcast plates 120 have short intermittent flexible end insertion splines 128 inserted in the edges along all axes. The flexible and insertion splines 128 are inserted into and removed from the vertical sides 138 of the moldcast plates 120 from within the modular accessible node located at each end of adjacent vertical sides of the moldcast plates 20.

FIG. 5 shows a top plan view of a suspended structural load-bearing moldcast plate 120 without biased corners. FIG. 6 shows a top plan view of a moldcast plate 120 with biased corners to accommodate modular accessible nodes at the adjacent intersecting corners of adjacent plates.

Figure 7:
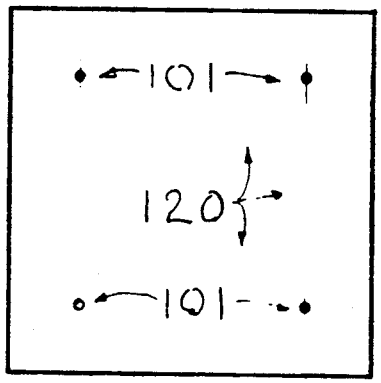
FIG. 7 is a top plan view of the suspended structural load-bearing moldcast plate of this invention.
Figure 8:
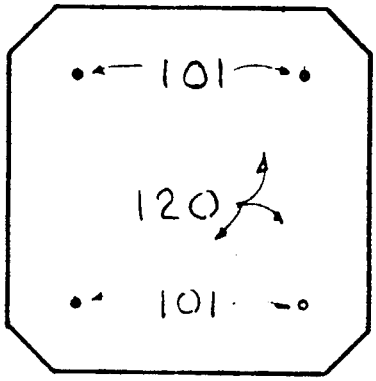
FIG. 8 is a top plan view of the suspended structural load-bearing moldcast plate with biased corners of this invention.

FIG. 7 shows a top plan view of a moldcast plate 20 with a typical arrangement of registry points 101 on the top face. FIG. 8 shows a top plan view of a moldcast plate 120 with biased corners to accommodate modular accessible nodes at the adjacent intersecting corners of adjacent plates. Also shown is a typical arrangement of registry points 101 on the top face.

THE SECOND EMBODIMENT OF THIS INVENTION

Referring to the drawings, FIGS. 9-12 show top plan views which illustrate several polygonally-shaped suspended structural load-bearing cast paver plates 98 of this invention The cast paver plates 98 may be any type of polygonal shape. Although the cast paver plates 98 illustrated are approximately 16 inches by 16 inches (400 mm by 400 mm) and 4 inches (100 mm) in thickness, many other sizes and thicknesses are disclosed and may be suitable for specific applications within the scope of this invention.

Figure 9:
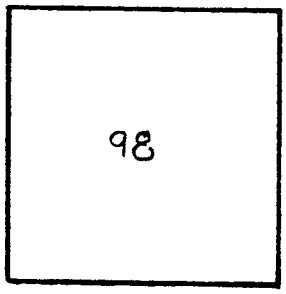
FIG. 9 is a top plan view of the suspended structural load-bearing cast paver plate of this invention.
Figure 10:
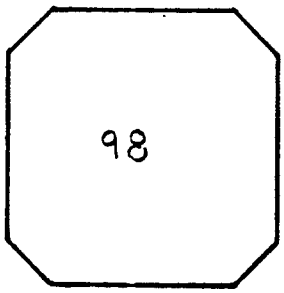
FIG. 10 is a top plan view of the suspended structural load-bearing cast paver plate with biased corners of this invention.
Figure 11:
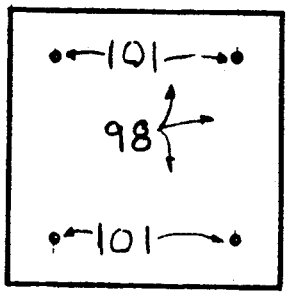
FIG. 11 is a top plan view of the suspended structural load-bearing cast paver plate of this invention.
Figure 12:
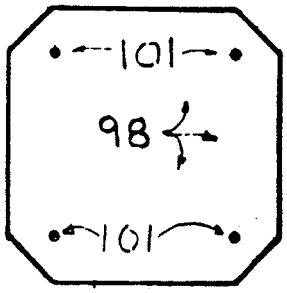
FIG. 12 is a top plan view of the suspended structural load-bearing cast paver plate with biased corners of this invention.

FIG. 9 shows a cast paver plate 98 without biased corners. FIG. 10 shows a cast paver plate 98 with biased corners 63 which accommodate modular accessible nodes 90. FIG. 11 shows a cast paver plate 98 without biased corners, which shows a typical arrangement of registry points 101 on the top surface of the plate 98. The registry points 101 may indicate the location of the points of registry and bearing 78 on the underside of the cast paver plate. They may also be cast indentations on a cast paver plate 98 which is good two sides and which are filled with an insert plug, the plug being removed to provide the required registry aperture when the cast paver plate 98 is turned over and the reverse side exposed to view and wear. FIG. 12 shows a cast paver plate 98 with biased corners and a typical arrangement of registry points 101 on the top surface of the plate 98.

The cast paver plates 98 and modular-accessible-pavers 187 of this invention are different than all other existing pavers in that they offer accommodation and accessibility to a matrix of conductors disposed below them and inherently form the load-bearing three-dimensional-conductor-accommodative-passage-and-support-matrix 75 which enables the passage of the accessible matrix conductors 86. Small-sized units may be laid by hand, and medium-sized and large-sized units may be laid by means of paver-laying machines, fork lifts, and the like. The modular-accessible-pavers 187 have a width-to-length ratio of 1 to 1 or greater and less than 1 to 2 and a thickness of 1 percent to 50 percent of the greater span.

The assembly bearing pads 100 are loaded in a single simple span mode or single span with cantilevers mode to limit inherently the internal balancing moment tension stress to a range between 5 percent and 30 percent of the cured compressive strength of the cast paver plate 98 and to an amount less than the load-to-span induced internal moment tension stresses when the cast paver plate 98 is arranged in a selected replicative accessible pattern layout.

The cast paver plates 98 and the moldcast plates 120 have a thickness and a span-to-load ratio sized to limit the internal balancing moment tension stresses to a range between 5 percent and 30 percent of the cured compressive strength of the units and to an amount less than the load-to-span induced external moment tension stress.

Figure 13:
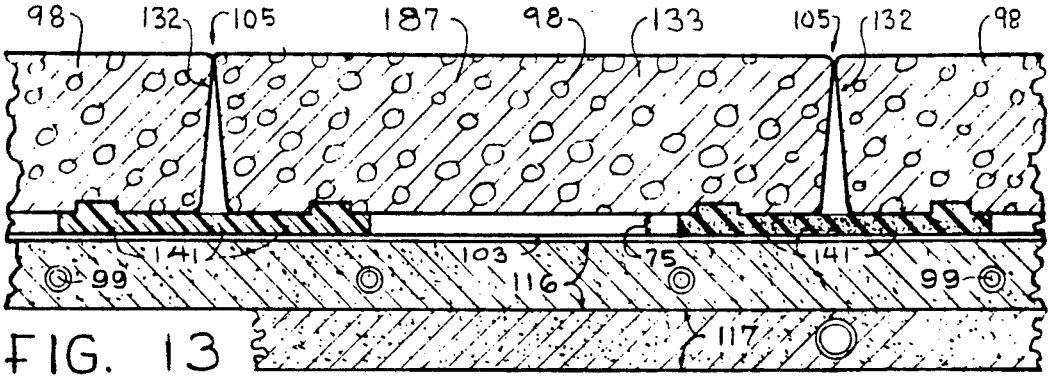
FIG. 13 is an enlarged, transverse, sectional view of the suspended structural load-bearing cast paver plate of this invention.
Figure 14:
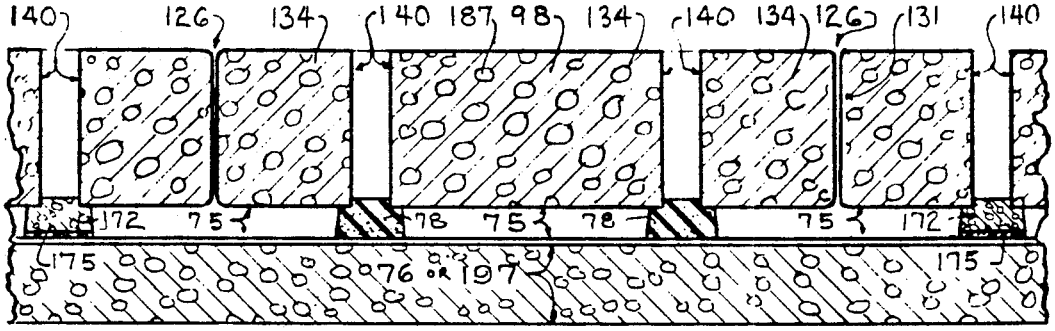
FIG. 14 is an enlarged, transverse, sectional view of the suspended structural load-bearing cast paver plate of this invention.
Figure 15:
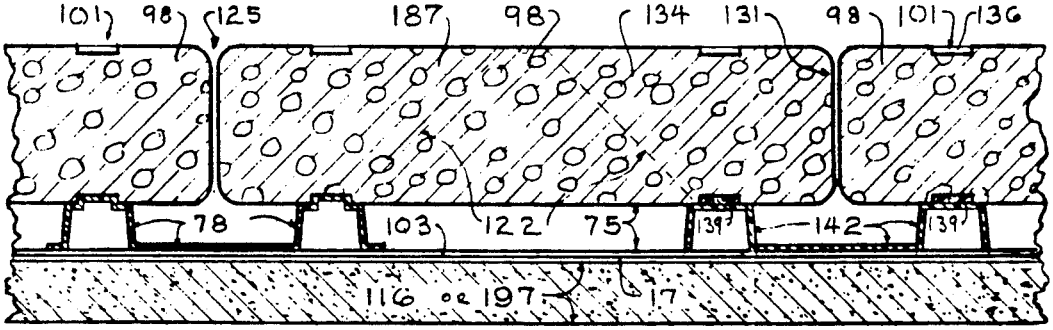
FIG. 15 is an enlarged, transverse, sectional view of the suspended structural load-bearing cast paver plate of this invention.
Figure 16:
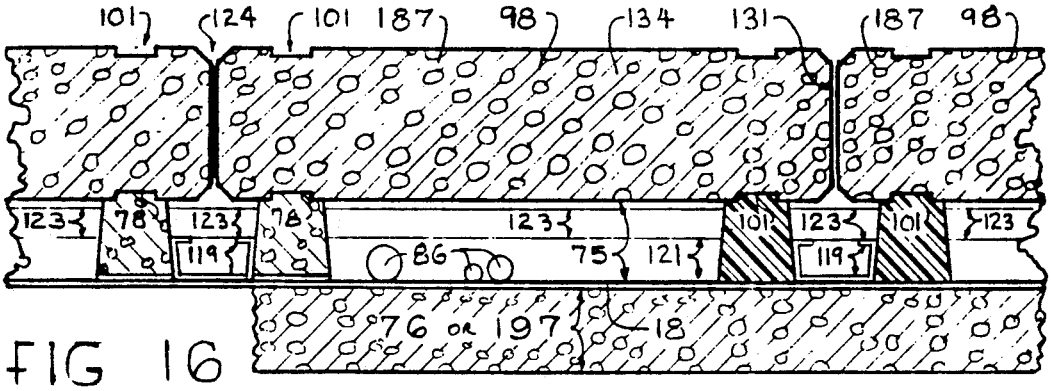
FIG. 16 is an enlarged, transverse, sectional view of the suspended structural load-bearing cast paver plate of this invention.

FIGS. 13-16 show cross-sectional views of suspended structural load-bearing cast paver plates 98. For illustrative purposes, points of registry and bearing 78 are shown differently in each succeeding view. In FIG. 13, the spacing of the bearing points of the cross-type assembly bearing pad with points of registry 141 is wider under the modular-accessible-pavers 187 and closer together under the mating cantilever ends. This gives slightly less flexibility but greater stability against tipping. In FIG. 14, the spacing of the bearing points is equal throughout the assembly. This gives the important advantage of being able to shift the modular-accessible-pavers 187 universally in either axis, but some tipping may occur if they are not laid tightly against adjoining units. In FIG. 15, the spacing of the bearing points is similar to the spacing in FIG. 13, giving the increased stability against tipping. In FIG. 16, even greater stability against tipping is achieved since the bearing points are spaced farther apart.

The flexible-assembly-joints 105 between adjoining cast paver plates 98 and moldcast plates 120 may be unfilled butt joints, cuttable and resealable elastomeric sealant joints, or the cuttable and resealable dynamic-interactive-fluidtight-flexible-joints of my previous three patents.

FIG. 13 illustrates a horizontal base surface 76 or a granular substrate layer 116 covered by a flexible modular positioning layer 103. A load-bearing three-dimensional-conductor-accommodative-passage-and-support-matrix 75 comprising cross-type assembly bearing pads with points of registry 141 is disposed over the flexible modular positioning layer 103, providing registry points to mate with registry points on the underside of the cast paver plate 98.

A modular-accessible-paver 187 comprising a polygonally-shaped suspended structural load-bearing cast paver plate 98 having one good wearing surface 133 is disposed over the cross-type assembly bearing pads with points of registry 141. The cast paver plates 98 have sloped abutting edges 132 to facilitate the removal of the pavers by lifting up two adjacent units, and a flexible-assembly-joint 105 joins the cast paver plates 98 one to another.

FIG. 14 illustrates a horizontal base surface 76 or a concrete slab at grade or below grade 197. A load-bearing three-dimensional-conductor-accommodative-passage-and-support-matrix 75 comprising load-bearing plinths 172 disposed over a flexible modular positioning layer 103. An optional sealant, adhesive or layer of adhesive-backed foam 175 is disposed below each plinth 172. Points of registry and bearing 78 are illustrated. Registry apertures 140 are shown penetrating all the way through the cast paver plates 98. The modular-accessible-pavers with vertical abutting sides 131 have two good wearing surfaces 134 and have accessible flexible-assembly-joints with eased edges 126.

FIG. 15 illustrates a flexible modular positioning layer 103 disposed over an optional horizontal-disassociation-cushioning-layer 17, which, in turn, is disposed over a granular substrate layer 116 or concrete slab at grade or below grade 197. Disposed over the flexible modular positioning layer 103 is a load-bearing three-dimensional-conductor-accommodative-passage-and-support-matrix 75 comprising clustered-type plinth assembly bearing pads 142 and illustrating points of registry and bearing 78. Elastomeric registry wafers, blanks, coins or washers 139 are applied to the top of the plinth supports of the plinth assembly bearing pads 142. The modular-accessible-pavers 187 comprising polygonally-shaped suspended structural load-bearing cast paver plates 98 is disposed over the load-bearing three-dimensional-conductor-accommodative-passage-and-support-matrix 75. The modular-accessible-pavers with vertical abutting sides 131 have two good wearing surfaces 134, have accessible flexible-assembly-joints with bullnose edges 125, have registry points 101 on both faces which mate with the flexible modular registry layers 139 disposed over the plinth supports of the plinth assembly bearing pads 142, insert plugs 136 placed in the registry apertures on the faces of the cast paver plates 98.

FIG. 15 also shows the outline of the bridging pyramid-shaped kern 122 with the principal compressive stress and the materially reduced bending stress in the polygonally-shaped suspended structural load-bearing cast paver plate 98.

FIG. 16 shows a horizontal base surface 76 or a concrete slab at grade or below grade 197 over which is disposed a flexible modular positioning layer and horizontal-disassociation-cushioning-layer 18 and a load-bearing three-dimensional-conductor-accommodative-passage-and-support-matrix 75 comprising matrix conductors 86, a lower layer of lay-in and pull-under matrix conductors 121, an upper layer of lay-in matrix conductors 123 disposed crosswise to the lower layer 121 and supported on a partial-height support rail 135 (not shown in FIG. 16) disposed along the same axis as the lower layer 121, and conductor channels 119 The modular-accessible-pavers with vertical abutting sides 131 have two good wearing surfaces 134 and have accessible flexible-assembly-joints with beveled edges 124. The cast paver plates 98 have registry points 101 on both faces which mate with illustrated points of registry and bearing 78.

Figure 17:
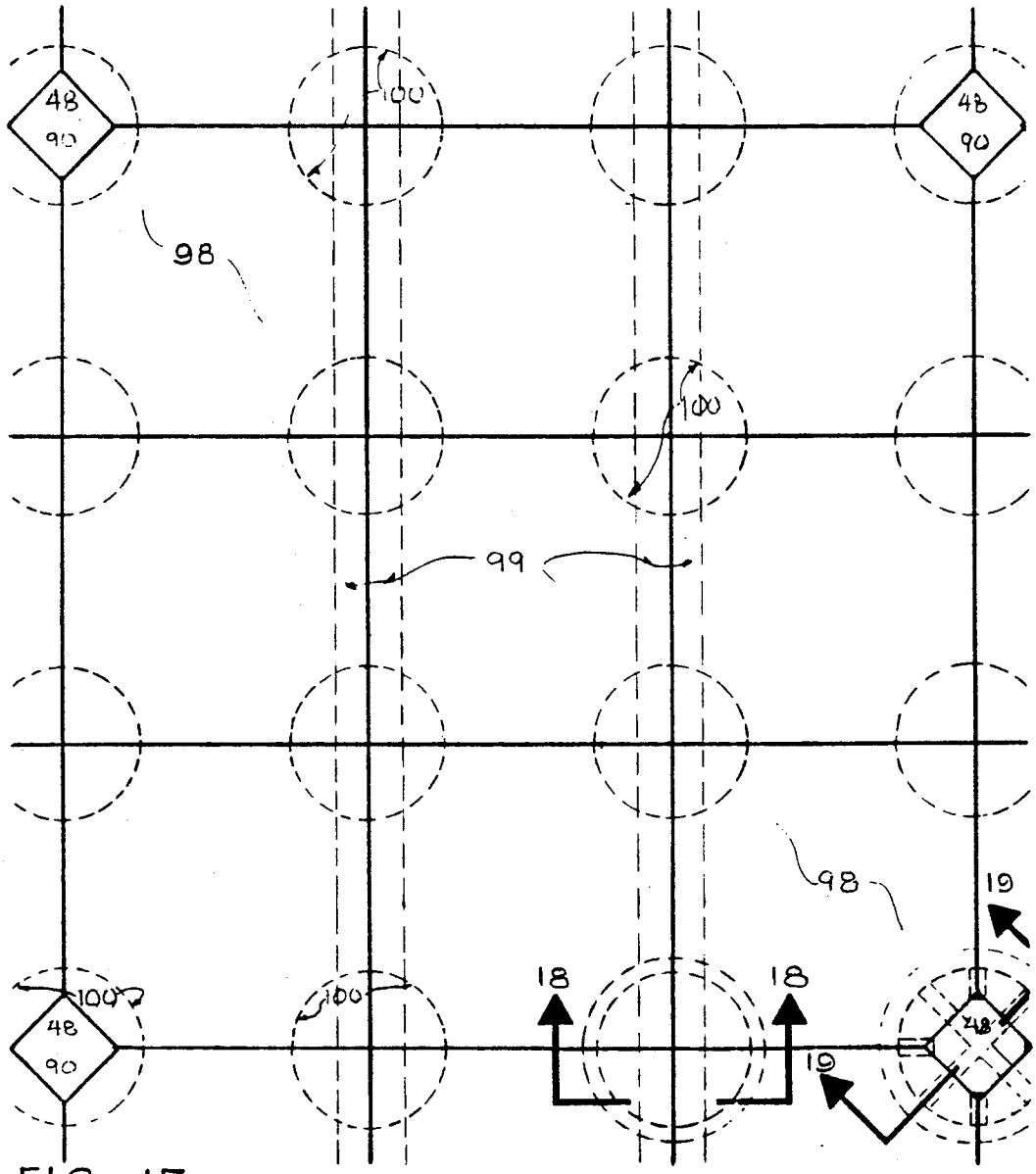
FIG. 17 is a top plan view of the array of suspended structural load-bearing cast paver plates of this invention, accommodating modular accessible nodes.

FIG. 17 shows a top plan view of an array of suspended structural load-bearing cast paver plates 98, illustrating typical biased corners accommodating modular accessible nodes 90 with access covers 48. Indicated by single and double concentric dash lines are the assembly bearing pads 100 supporting the array of cast paver plates 98. Fluid conductors 99 within the load-bearing three-dimensional-conductor-accommodative-passage-and-support-matrix below the array of cast paver plates 98 are shown by dash lines.

Figure 18:
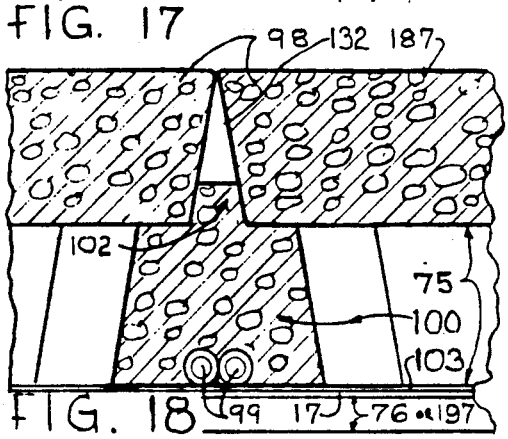
FIG. 18 is a transverse, sectional view of the suspended structural load-bearing cast paver plate of this invention as illustrated in FIG. 17.

FIG. 18 shows a cross-sectional view of the load-bearing three-dimensional-conductor-accommodative-passage-and-support-matrix 75 and array of cast paver plates 98 of FIG. 17, the load-bearing three-dimensional-conductor-accommodative-passage-and-support-matrix 75 disposed over a flexible modular positioning layer 103 which is disposed over an optional horizontal-disassociation-cushioning-layer 17, in turn disposed over a horizontal base surface 76 or a concrete slab at grade or below grade 197. The assembly bearing pad 100 has positioning projecting elements 102 on which the cast paver plates 98 bear. The load-bearing three-dimensional-conductor-accommodative-passage-and-support-matrix 75 accommodates the fluid conductors 99 described in detail for FIG. 4 under the First Embodiment Of This Invention. The modular-accessible-paver 187 has sloped abutting sides 132 to facilitate the removal of the modular-accessible-paver 187 by lifting up two adjacent modular-accessible-pavers 187. The joints may have splines joining the adjacent units although FIG. 18 does not illustrate this feature.

Figure 19:
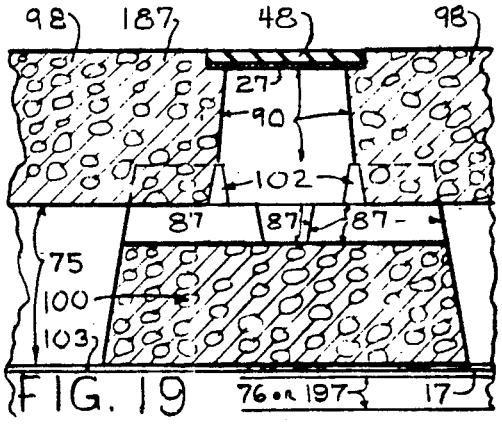
FIG. 19 is a transverse, sectional view of the suspended structural load-bearing cast paver plate of this invention as illustrated in FIG. 17.

FIG. 19 illustrates a cross-sectional view of the load-bearing three-dimensional-conductor-accommodative-passage-and-support-matrix 75 and the array of cast paver plates 98 of FIG. 17, the load-bearing three-dimensional-conductor-accommodative-passage-and-support-matrix 75 disposed over a flexible modular positioning layer 103 which is disposed over an optional horizontal-disassociation-cushioning-layer 17. The cast paver plates 98 are shown bearing on positioning projecting elements 102 of the assembly bearing pad 100. A modular accessible node 90 with access cover 48 is accommodated by the biased corners of intersecting adjacent corners of the modular-accessible-pavers 187. Matrix conductor passages 87 intersect below the modular accessible node 90.

Figure 20:
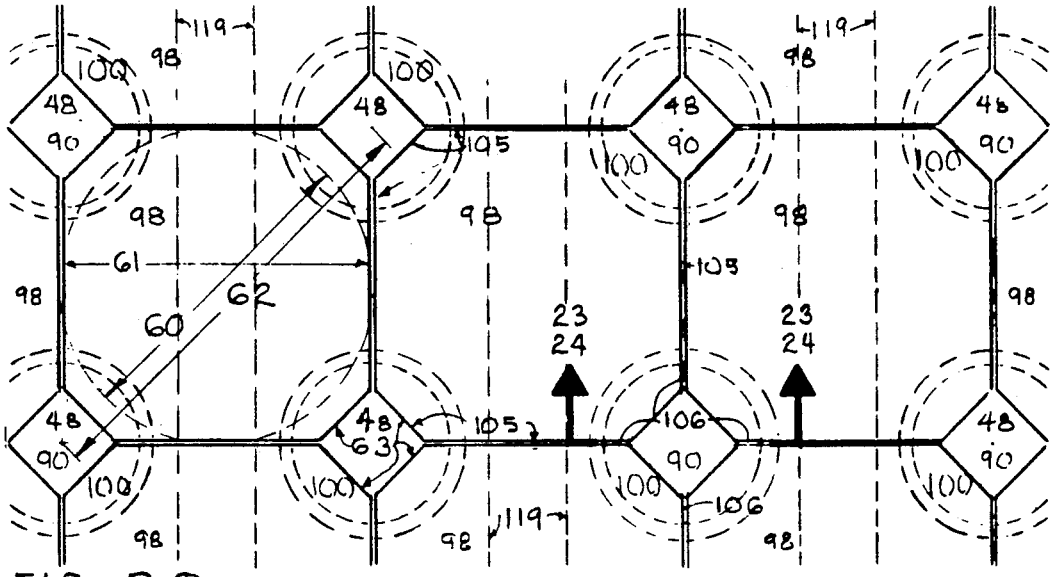
FIG. 20 is a top plan view of the array of suspended structural load-bearing cast paver plates of this invention, accommodating modular accessible nodes.

FIG. 20 illustrates a top plan view of an array of polygonally-shaped suspended structural load-bearing cast paver plates 98. In this view the cast paver plates 98 depict square units with biased corners 63 accommodating an array of modular accessible nodes 90 having access covers 48 although any polygonal shape may be used. FIG. 20 illustrates a cast paver plate 98 having a crosswise width span 61 equal to unity, a foreshortened diagonal width span 60 equal to the crosswise width span 61, and a full corner-to-corner diagonal width span 62. Illustrated by two concentric dash lines are the outline of the assembly bearing pads 100 which support the array of cast paver plates 98 below the modular accessible nodes 90. Conductor channels 119 below the array of cast paver plates 98 are shown by two parallel dashed lines. The accessible flexible-assembly-joints 105 with insert-type positioning splines 106 are shown between adjacent cast paver plates 98 and between the cast paver plates 98 and the access covers 48 of the modular accessible nodes 90.

Figure 21:
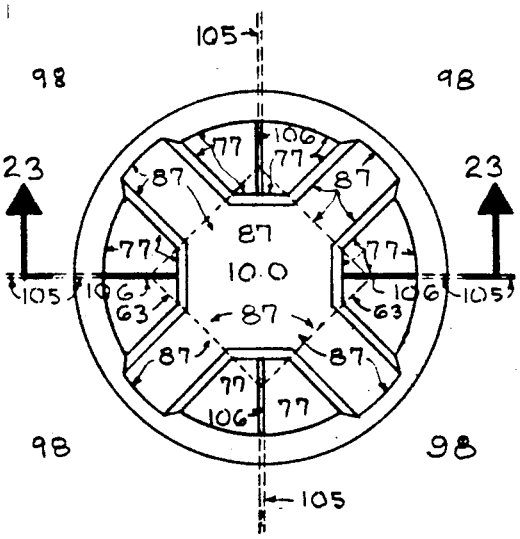
FIG. 21 is a top plan view of the assembly bearing pad of this invention as illustrated in FIG. 20 by two concentric circles having dash lines.

FIG. 21 is a top plan view of an assembly bearing pad 100, illustrated as round in this view. It shows matrix conductor passages 87 positioned at right angles to the biased corners 63 and illustrates the points of bearing 77. The accessible flexible-assembly-joints 105 are shown. Insert-type positioning splines 106 are inserted vertically into slots in the top of the matrix conductor passages 87 to assist in the alignment of the cast paver plates 98 at intersecting corners.

Figure 22:
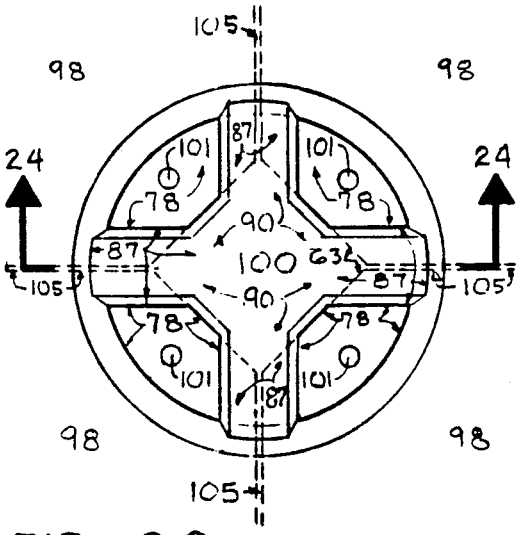
FIG. 22 is a top plan view of the assembly bearing of this invention as illustrated in FIG. 20 by two concentric circles having dash lines.

FIG. 22 is a top plan view of an assembly bearing pad 100, similar to FIG. 21, except that the matrix conductor passages 87 are positioned to align with the diagonal axes of the modular accessible nodes 90. Illustrative points of registry and bearing 78 and registry points 101 are shown which align the cast paver plates 98 and keep them from moving. Accessible flexible assembly joints 105 are shown.

Figure 23:
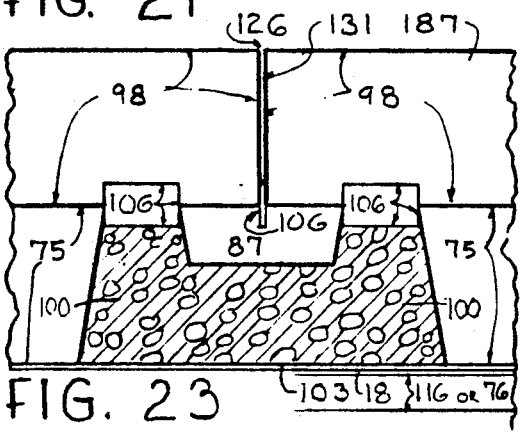
FIG. 23 is an enlarged, transverse, sectional view of the suspended structural load-bearing cast paver plates of this invention as illustrated in FIG. 20.

FIG. 23 is a cross-sectional view of a load-bearing three-dimensional-conductor-accommodative-passage-and-support-matrix 75 comprising the assembly bearing pad 100 of FIG. 21, taken at the point of intersection of four adjacent cast paver plates 98. A matrix conductor passage 87 is shown below the intersection of the adjacent cast paver plates 98, along with vertical insert-type positioning splines 106 for alignment of the intersecting cast paver plates 98. The assembly bearing pad 100 may optionally bear on a horizontal-disassociation-cushioning-layer 18 which provides cushioning and enhanced impact sound isolation. The horizontal-disassociation-cushioning-layer 18 is disposed over a flexible modular positioning layer 103 which is disposed over a horizontal base surface 76 or a granular substrate layer 116. The modular-accessible-pavers 187 have vertical abutting sides 131 and accessible flexible-assembly-joints with eased edges 126.

Figure 24:
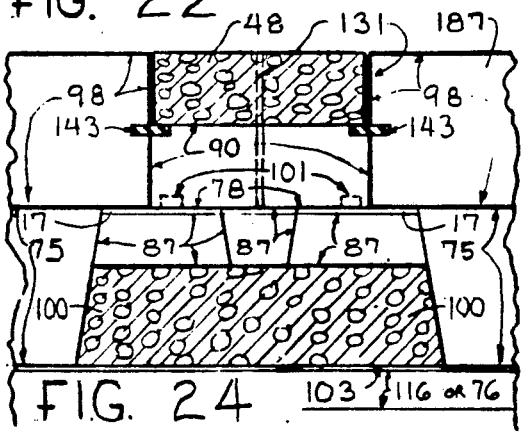
FIG. 24 is an enlarged, transverse, sectional view of the suspended structural load-bearing cast paver plates of this invention as illustrated in FIG. 20.

FIG. 24 shows a cross-sectional view of a load-bearing three-dimensional-conductor-accommodative-passage-and-support-matrix 75 comprising the assembly bearing pad 100 of FIG. 22. It shows the intersecting matrix conductor passages 87, the modular accessible node 90 and access cover 48 accommodated by the biased corners of four intersecting cast paver plates 98 having vertical abutting edges 131. A horizontal-disassociation-cushioning-layer 17 may optionally be disposed over the matrix conductor passages 87 at the bearing points below the cast paver plates 98. The illustrative points of registry and bearing 78 mate with registry points 101 shown in FIG. 22 to keep the cast paver plates 98 in alignment and to keep them from moving. The modular accessible node 90 is created by the space formed by the intersecting of the biased corners of adjacent modular-accessible-pavers 187, eliminating the need for an electrical box. Load-bearing horizontal projecting insert splines 143 support the load-bearing cast concrete access cover 48. Notches or recesses are cast or cut into the side of the cast paver plates 98 to receive the load-bearing horizontal projecting insert splines 143.

THE THIRD EMBODIMENT OF THIS INVENTION

Figure 25:
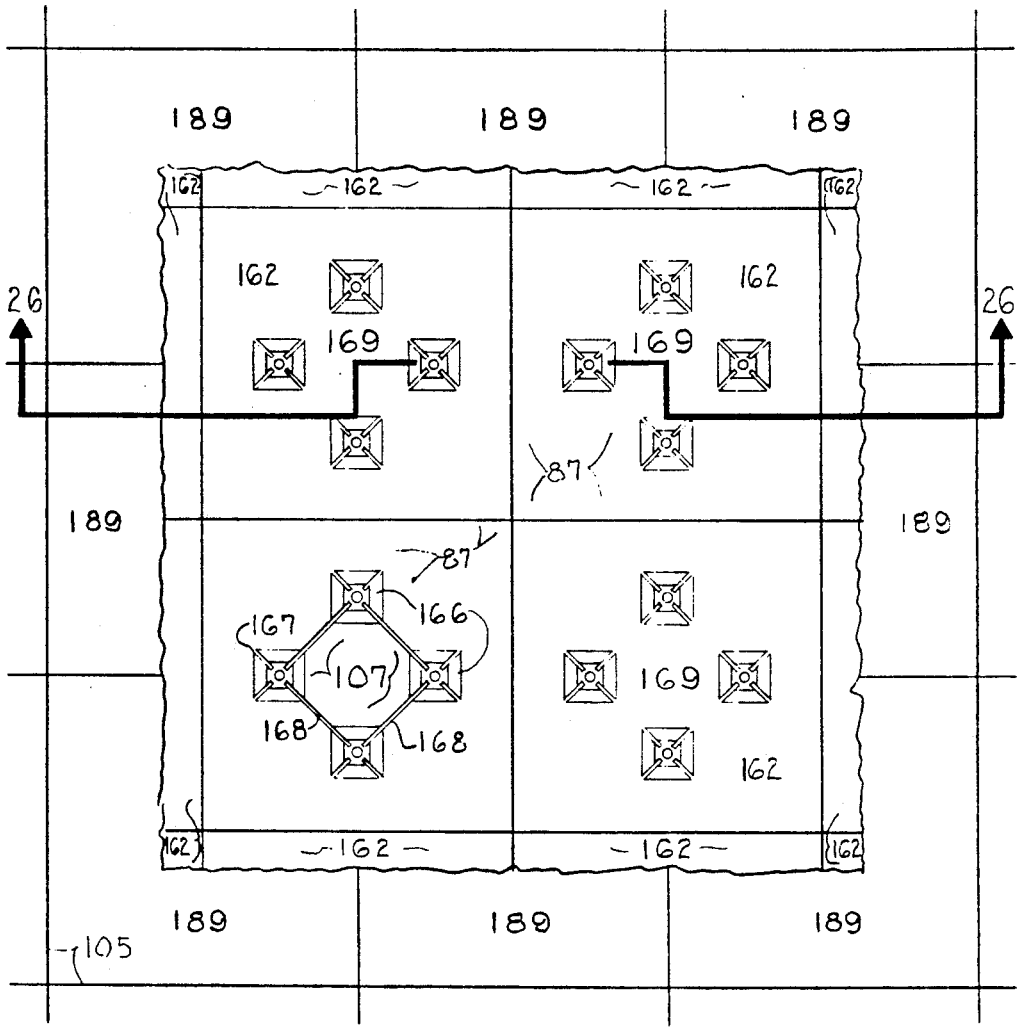
FIG. 25 is top plan view of the array of modular-accessible-pavers and the supporting layer of this invention.

Referring to the drawings, FIG. 25 shows a top plan view of an array of suspended structural load-bearing modular-accessible-pavers having two good wearing surfaces 189 with a cuttable and resealable flexible assembly joint 105. The cutaway illustrates a plurality of modular structural plates 162, modular accessible node sites 169, and matrix conductor passages 87. Clusters of four truncated pyramid structural bearing supports 166 are disposed, delineating the modular accessible node sites 169 and forming corner supports for the modular accessible node boxes 107. The structural bearing supports 166 have slots 167 to receive interchangeable vertical side plates 168 which form the modular accessible node box 107. Joints 105, 182 and 183 are non-aligned with the joints in the modular structural plates 162 to better distribute heavy loads on the floor.

Figure 26:
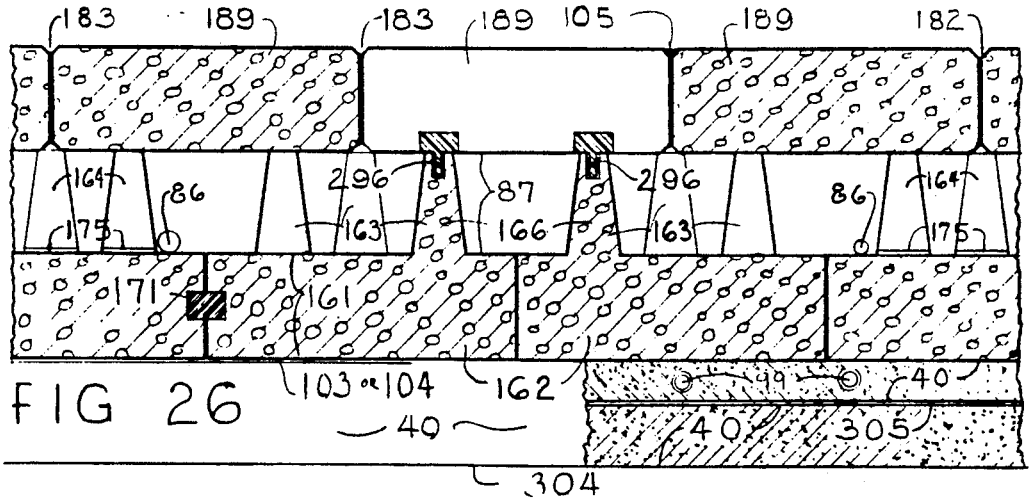
FIG. 26 is an enlarged, transverse, sectional view of the suspended structural load-bearing modular-accessible-pavers and the supporting layer of this invention as illustrated in FIG. 25.

FIG. 26 shows a cross section of the modular-accessible-pavers having two good wearing surfaces 189 of FIG. 25 and illustrates a cuttable and resealable flexible assembly joint 105, a tight butt joint 182, and a fractionally spaced-apart butt joint 183. The supporting layer comprises a three-dimensional conductor-accommodative passage and foundation grid 161 which includes a plurality of modular structural plates 162 joined by a cuttable spline 171 over a cushioning-granular-substrate 40 disposed over an earth base 304. At one side of the drawing a flexible modular positioning layer 103 or a flexible modular positioning layer comprising a vapor barrier 104 is shown interposed between the modular structural plates 162 and the cushioning-granular-substrate 40. At the other side of the drawing fluid conductors for low Delta t heat 99 are shown interposed between the modular structural plates 162 and disposed within the granular-cushioning-substrate 40. A vapor barrier 305 is placed within the granular-cushioning-substrate 40. A plurality of integrally cast structural bearing supports 163 is supported on the modular structural plates 162. Also shown are separately cast structural bearing supports 164 which are adhered to the modular structural supports 162 with a sealant, adhesive or a layer of adhesive-backed foam 175. Matrix conductors 86 and matrix conductor passages 87 are also accommodated within the foundation grid 161. Registry insert 296 with a central shaft, concentric rings, and a two-winged spacer head to fit in the joint is shown.

Figure 27:
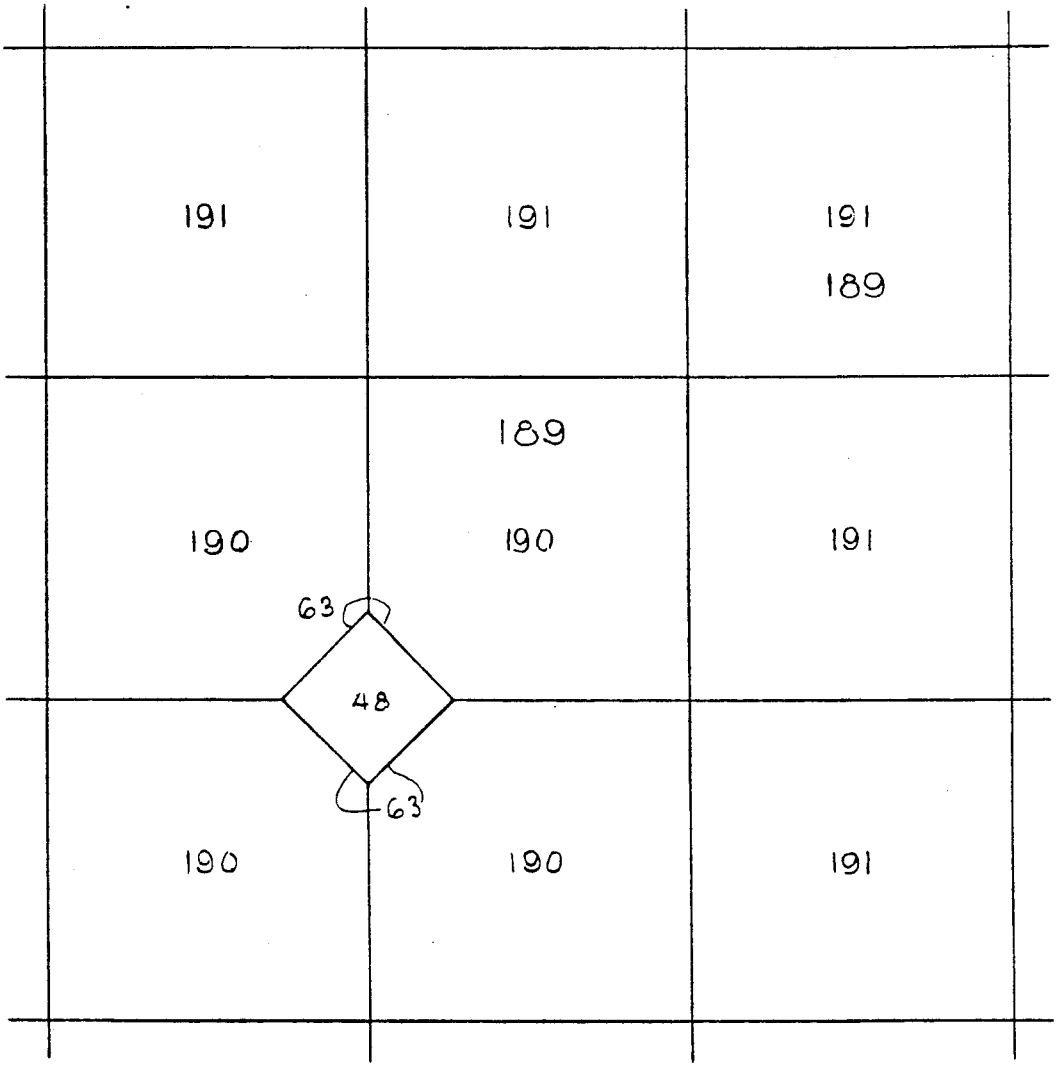
FIG. 27 is a top plan view of the array of modular-accessible-pavers of this invention.

FIG. 27 shows a top plan view of an array of modular-accessible-pavers having two good wearing surfaces 189, including modular-accessible-pavers with one biased corner 190 and modular-accessible-pavers with all square corners 191 in combinations of 1 to 9 units between the pavers with one biased corner 190. A decorative wearing surface load-bearing access cover 48 is positioned at the biased corners 63 of modular-accessible-pavers 190. FIG. 27 is an overlay for FIG. 25.

Figure 28:
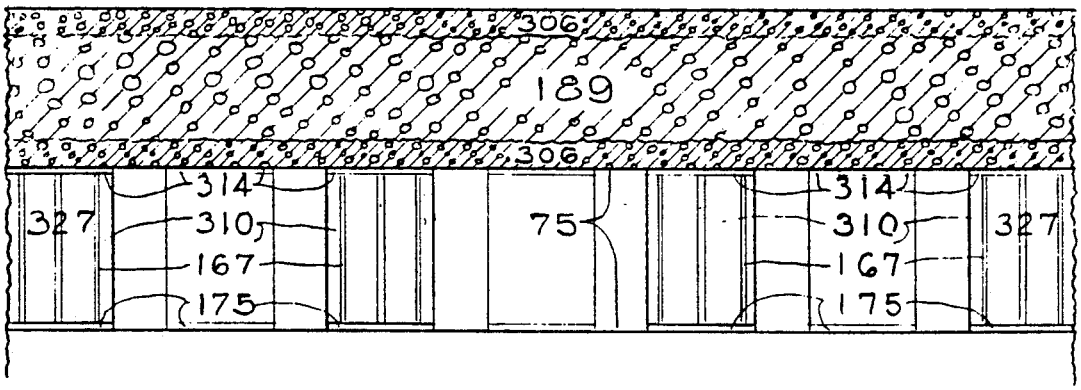
FIG. 28 is an enlarged, transverse, sectional view of the array of modular-accessible-pavers and the supporting layer of this invention.

FIG. 28 shows a cross sectional view of a uniaxial supporting layer 327. Pavers having two good wearing surfaces 189 are supported by extruded load-bearing plinths 310 having straight sides and slots 167 to receive the side plates to form a node box 107. The plinths 310 are adhered to the base surface by a sealant, an adhesive or a layer of adhesive-backed foam 175. A disassociation cushioning layer 314 is disposed between the top of the plinths 310 and the bottom of the pavers 189. The pavers 189 have a layer of metallic filings in at least the outer ⅛ inch (3 mm) at both wearing surfaces to give additional strength to the pavers.

Figure 29:
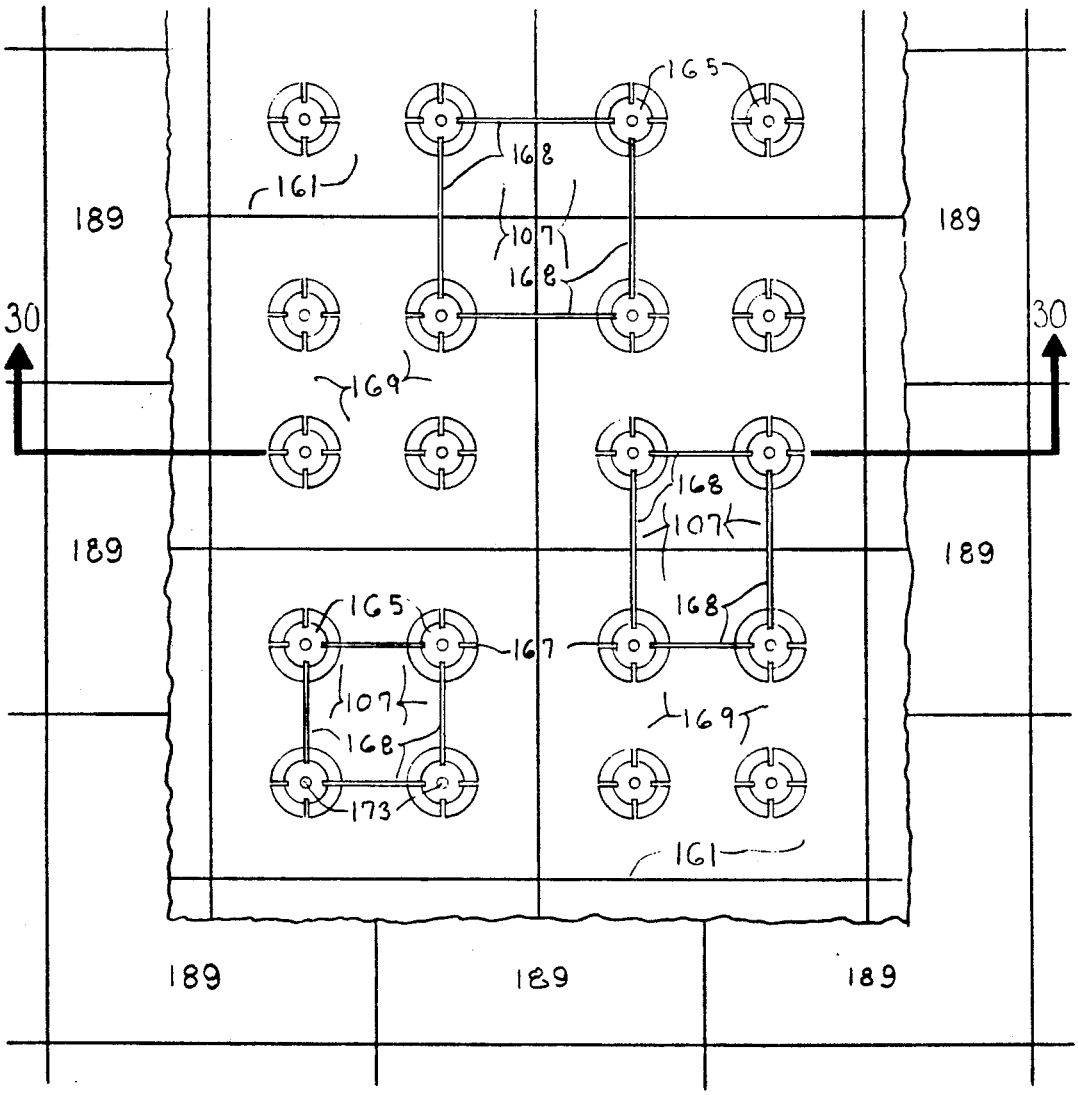
FIG. 29 is a top plan view of the array of modular-accessible-pavers and the supporting layer of this invention.

FIG. 29 shows an array of suspended structural load-bearing modular-accessible-pavers having two good wearing surfaces 189. The cutaway illustrates a three-dimensional conductor-accommodative passage and foundation grid 161 comprising a plurality of truncated cone structural bearing supports 165 having slots 167 to receive interchangeable vertical side plates 168 which form the modular accessible node boxes 107 and also delineate the modular accessible node sites 169 which can be reconfigured into modular accessible node boxes 107 whenever desired. The pattern layout of structural bearing supports 165 illustrates various sizes and locations of the reconfigurable modular accessible node sites 169 and modular accessible node boxes 107.

Figure 30:
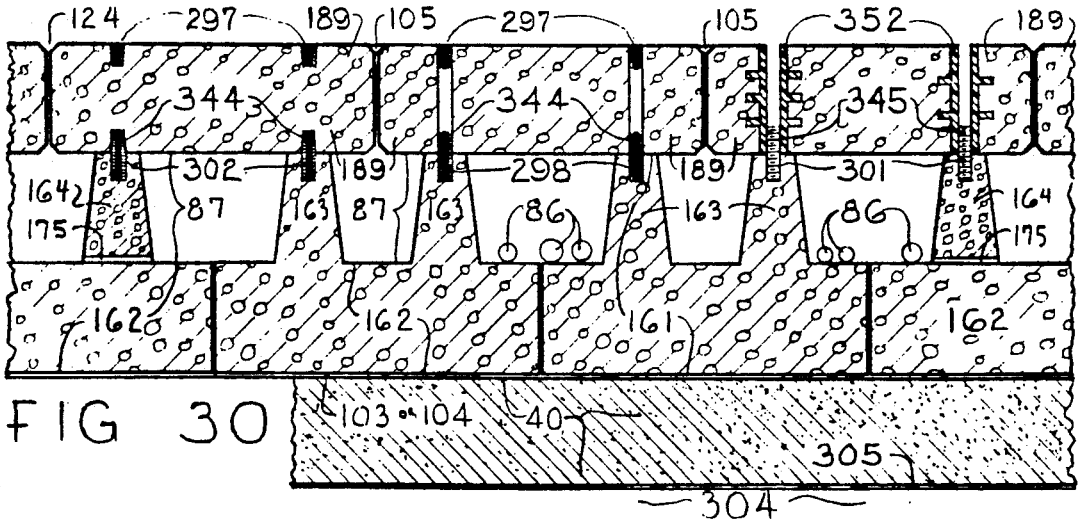
FIG. 30 is an enlarged, transverse, sectional view of the suspended structural load-bearing modular-accessible-pavers and the supporting layer of this invention as illustrated in FIG. 29.

FIG. 30 shows a cross sectional view of the modular-accessible-pavers of FIG. 29, illustrating a beveled accessible flexible joint 124 and a cuttable and resealable flexible assembly joint 105 in an array of modular-accessible-pavers having two good wearing surfaces 189. The three-dimensional conductor-accommodative passage and foundation grid 161 is shown having integrally cast structural bearing supports 163 bearing on the modular structural plates 162 as well as separately cast structural bearing supports 164 adhered by a sealant, adhesive or layer of adhesive-back foam 175 to the modular structural plates 162. A flexible modular positioning layer 103 or a flexible modular positioning layer with vapor barrier 104 is interposed between the foundation grid 161 and a cushioning granular substrate 40, which is disposed over a vapor barrier 305 which is placed over an earth base 304. Matrix conductors 86 and matrix conductor passages 87 are also shown. Several fasteners are shown. A registry insert 298 has a central shaft and concentric rings, the lower half fitting into a female registry aperture in the top of the bearing support 163 and the upper half fitting into the female registry aperture which runs the entire depth of the paver 189. The paver 189 also serves as a cover 344 held in place mechanically A registry insert 302 has a central shaft and concentric rings, the lower half fitting into a female registry aperture in the top of the bearing support 164 and the upper half fitting into the aperture on the underside of the paver 189. A filler plug 297 fits flush into the top of the aperture in the paver 189 and has a central shaft, concentric rings, and a head that fits into the aperture. A registry insert 301 has a threaded central shaft, the lower half fitting to a female registry aperture in the top of a bearing support 163 or 164 and the upper half fitting into an internally threaded insert tube 352 with one or more bond rings cast into the full depth of the paver 189. The paver 189 also serves as a cover 345 held in place by one or more fasteners.

Figure 31:
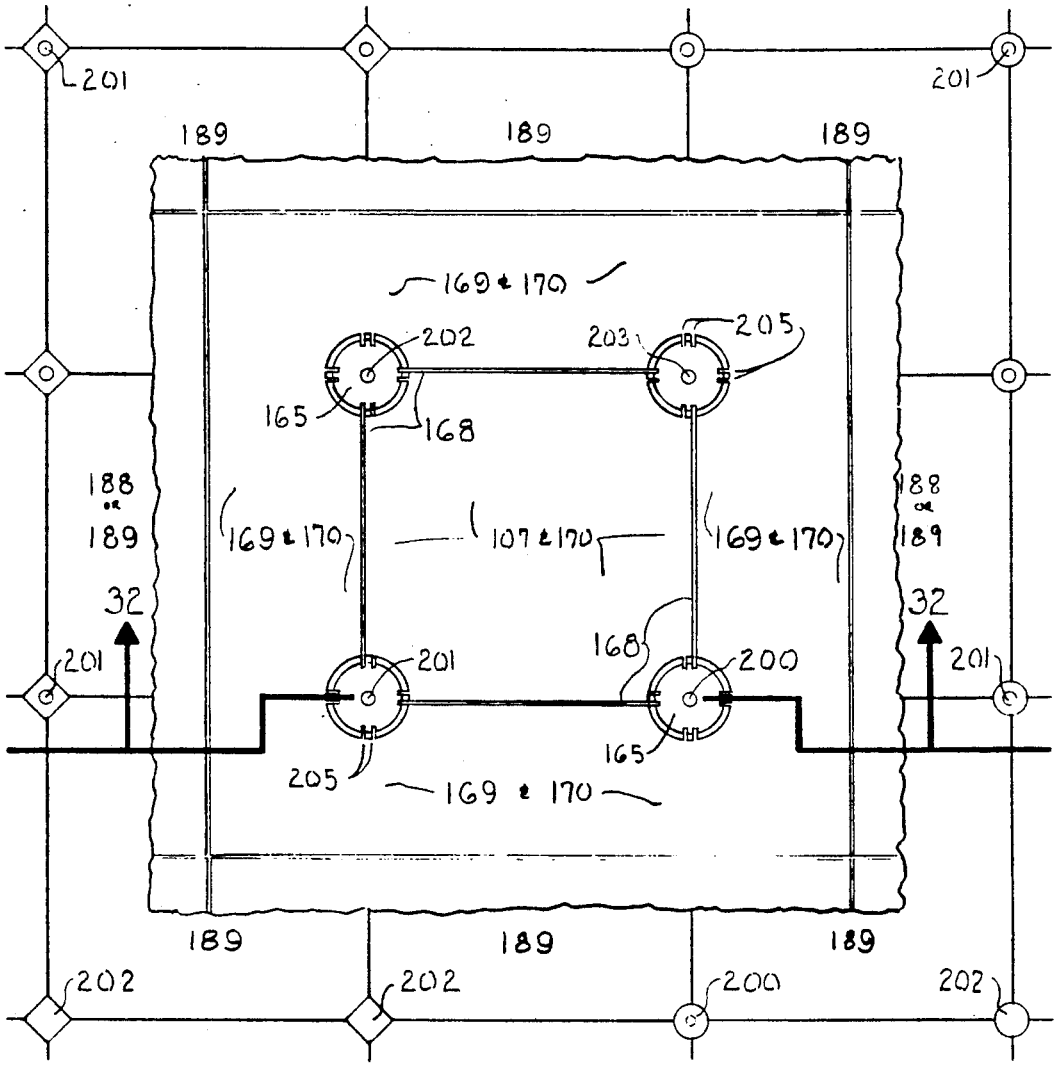
FIG. 31 is a top plan view of the array of modular-accessible-pavers and the supporting layer of this invention.

FIG. 31 is a top plan view and a cutaway view of an array of modular-accessible-pavers having one good wearing surface 188 or two good wearing surfaces 189. Various mechanical holddown fasteners 200, 201, 202 and 203 are shown for providing registry and engagement of the modular-accessible-pavers 188 and 189. Mechanical screw-in-and-out holddown fastener 200 has an integral round head joined to a shaft with external thread for registry engagement and holddown with an internally threaded aperture in the structural bearing support 165 and provides mechanical torquing means in the head, such as, hexagonal, phillips or slotted. Mechanical screw-in-and-out holddown fastener 201 has a holddown head of a polygonal shape, with a countersunk aperture in the holddown head to accommodate a fastener with a countersunk head to provide a flush wearing surface. External threading on the opposite end of the shaft provides registry engagement and holddown within an internally threaded vertical aperture 173 in the structural bearing support 165. Mechanical push-in-and-out holddown fastener 202 has an integral holddown head joined to a shaft with concentric rings at the opposite end of the shaft to provide registry engagement. The outer diameter of the concentric rings are slightly greater than the inner diameter of the female aperture to provide a desired withdrawal resistance due to the arching of the concentric rings upon insertion. Modular-accessible-paver winged registry insert 203 has four crosswise upward-extending wings radially extended from a central shaft at 90 degree angles to registry position paver between extending wings of winged registry inserts disposed within the adjacent corner joints of adjacent pavers over structural bearing supports having three or more concentric rings for insertion into female registry engagement aperture in the center of the structural bearing support. The outer diameter of the concentric rings is slightly greater than the inner diameter of the female aperture to provide a desired withdrawal resistance due to the arching of the concentric rings upon insertion. Modular accessible node sites 169 and modular-accessible-paver sites 170 are shown. Also shown is a modular accessible node box 107 with double grooves 205 provided in the structural bearing supports 165 to accommodate insertion and removal of the interchangeable vertical side plates 168 while removing only one paver 188, 189.

Figure 32:
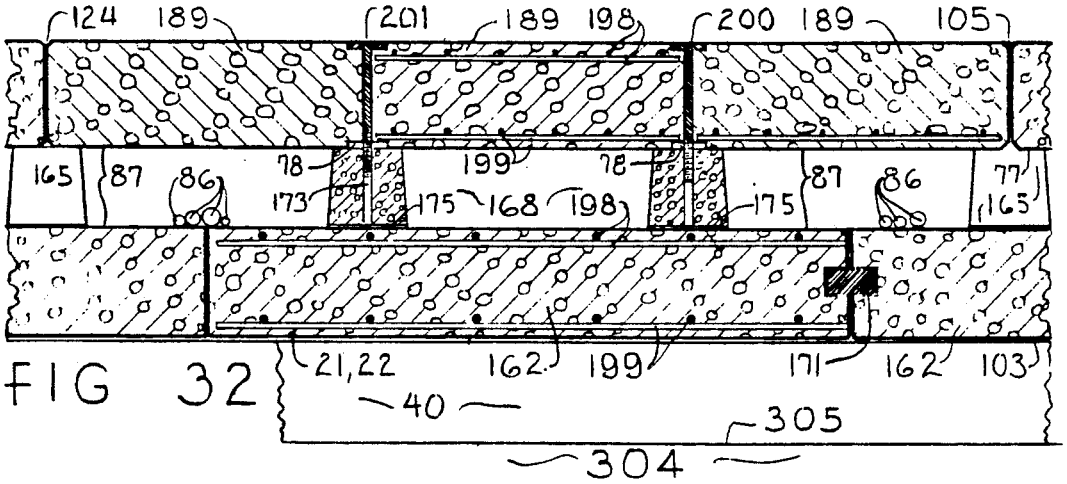
FIG. 32 is an enlarged, transverse, sectional view of the suspended structural load-bearing modular-accessible-pavers and the supporting layer of this invention, with a section cut through the structural bearing supports as illustrated in FIG. 31.

FIG. 32 shows a cross sectional view cut through the structural bearing supports 165 of FIG. 31. Fasteners 200 and 201, each with a vertical apertures 173 to receive a vertical shaft are shown. The modular structural plates 162 are shown with top reinforcement on two or more axes 198 and bottom reinforcement on two or more axes 199 and are aligned with a cuttable spline 171. The structural bearing supports 165 are adhered to the plates 162 with a sealant, adhesive or layer of adhesive-backed foam 175 and show points of bearing 77 and points of registry and bearing 78. A beveled accessible flexible joint 124 and a cuttable and resealable flexible assembly joint 105 is shown with the pavers having two good wearing surfaces 189. Matrix conductor passages 87 are shown. A flexible modular positioning layer 103 and, alternatively, slip sheets 21,22 are shown interposed between a cushioning-granular-substrate 40 and the plates 162. A vapor barrier 305 is also shown disposed over an earth base 304.

Figure 33:
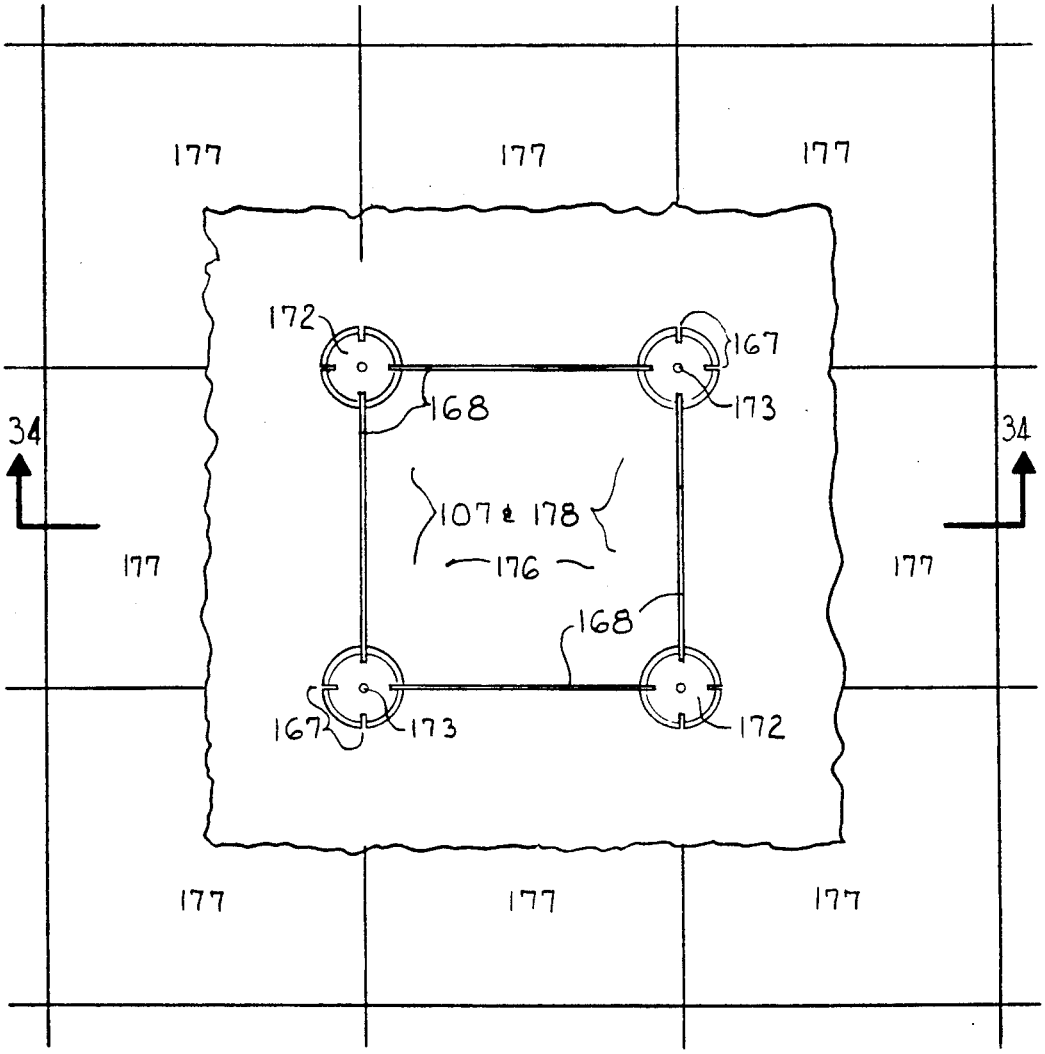
FIG. 33 is a top plan view of the array of containment-cast modular-accessible-pavers and supporting layer of this invention.

FIG. 33 is a top plan view of an array of containment-cast modular-accessible-pavers with flat bottoms 176 and deformed bottoms 177, the flat-bottomed paver 176 being disposed over a modular accessible node box 107. The cutaway view shows a modular accessible node box 107 comprising four load-bearing plinths 172 with vertical apertures to receive a registry shaft 173 and slots 167 to receive interchangeable vertical side plates 168. The vertical side plate 168 has an inward-facing bottom leg to receive the bottom plate 181 of the modular accessible node box 107.

Figure 34:
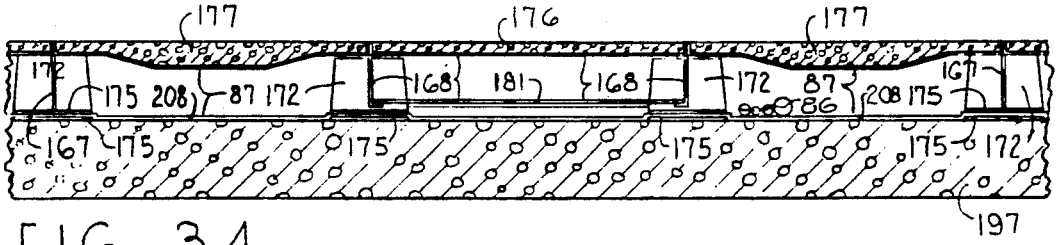
FIG. 34 is an enlarged, transverse, sectional view of the suspended structural load-bearing containment-cast modular-accessible-pavers and the supporting layer of this invention, with a section cut through the modular accessible node box as illustrated in FIG. 33.

FIG. 34 is a cross sectional view of the modular-accessible-pavers 176, 177 of FIG. 33, showing load-bearing plinths 172 with vertical slots 167 adhered by a sealant, an adhesive or a layer of adhesive-backed foam 175 to a concrete slab 197. The interchangeable vertical side plates 168 and bottom plate 181 of the modular accessible node box 107, matrix conductors 86, matrix conductor passages 87, and a fluidtight membrane 208 are shown.

Figure 35:
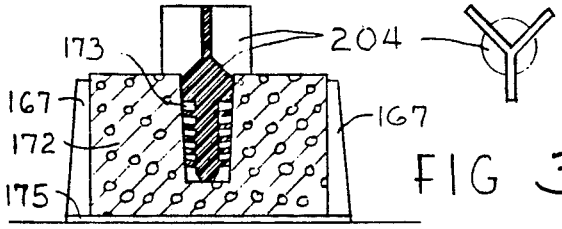
FIG. 35 is an enlarged, transverse, cross sectional view of a winged registry insert of this invention.

FIG. 35 is a cross sectional view of a winged registry insert 204 having three upward-extending wings radially extended from a central shaft at 135, 90 and 135 degrees to registry position the modular accessible node 90 and the modular-accessible-paver good two sides 189 between the wings of the winged registry inserts 204 disposed within the adjacent center joints of adjacent modular-accessible-pavers 189 and modular accessible nodes 90 over the plinths 172 with the end of the central shaft having three or more concentric rings for insertion into a female registry engagement aperture 173 in the center of the plinth 172. The outer diameter of the concentric rings are slightly greater than the inner diameter of the female aperture 173 in the center of the plinths 172 to provide a desired withdrawal resistance due to the arching of the concentric rings upon insertion. The vertical slots 167 and sealant, adhesive or layer of adhesive-backed foam 175 are also shown.

Figure 36:
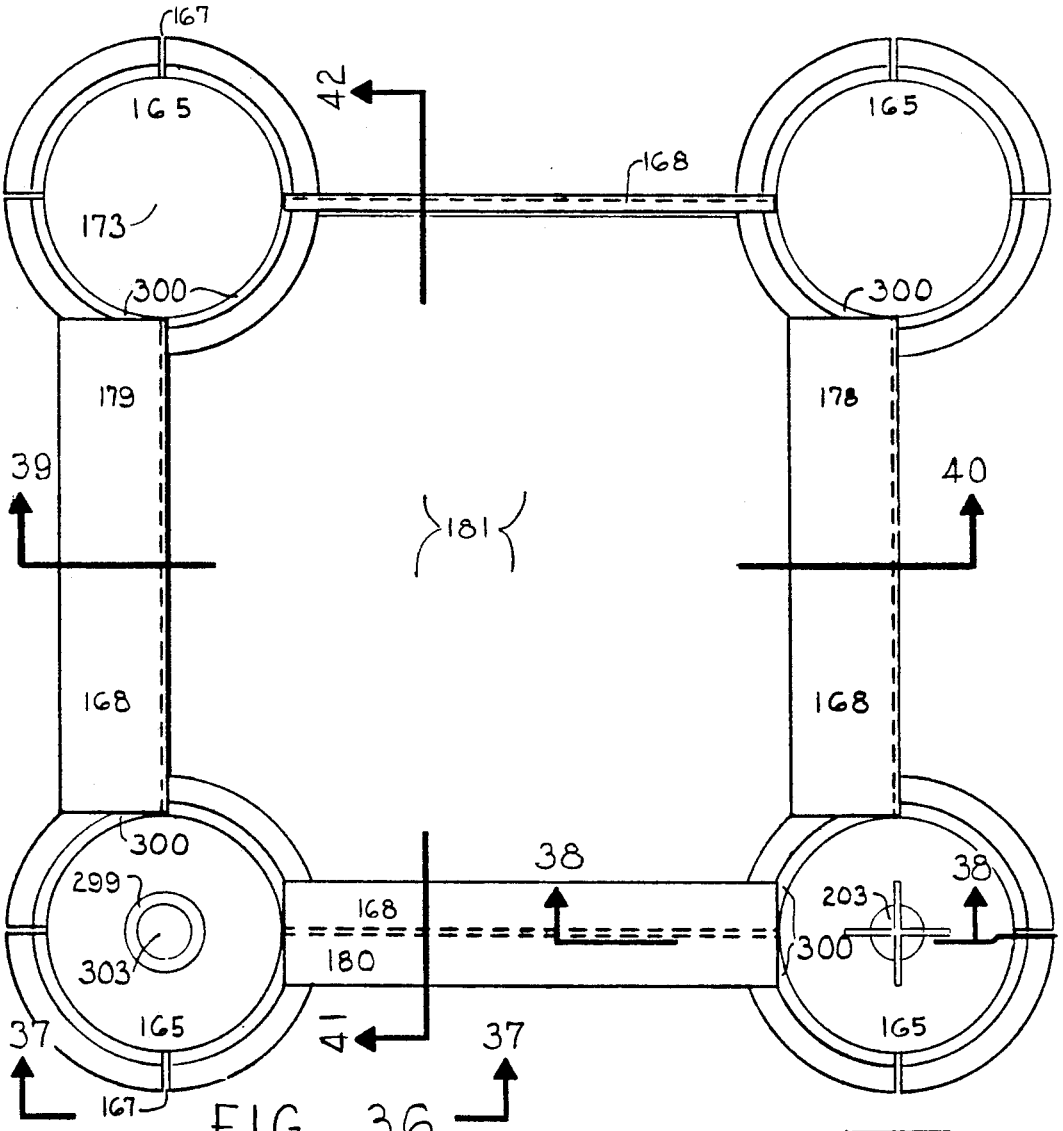
FIG. 36 is an enlarged top plan view of the modular accessible node box of this invention, illustrating variations in the interchangeable vertical side plates.

FIG. 36 is an enlarged top plan view of a modular accessible node box comprising truncated cone structural bearing supports 165 with slots 167 to receive interchangeable vertical side plates 168 having an inward-facing bottom leg 178, an outward-facing bottom leg 179, an inward-facing and outward-facing bottom leg 180, and a legless plate 168. The bearing support 165 shows a concentric ring or thread 299 surrounding a central shaft 303 of a registry insert and an offset shoulder 300 to support the flange of the side plate 168. A registry insert 203 having four wings is also shown.

Figure 37:
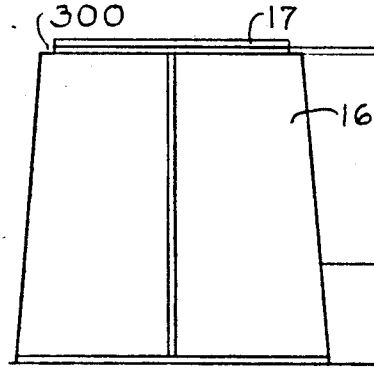
FIG. 37 is an enlarged, transverse, sectional view of the load-bearing plinth forming the corner support for the modular accessible node box of this invention as illustrated in FIG. 36.
Figure 38:
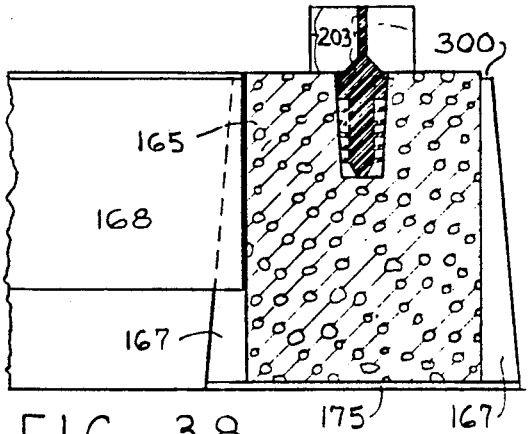
FIG. 38 is an enlarged, transverse, sectional view of the load-bearing plinth forming the corner support for the modular accessible node box of this invention as illustrated in FIG. 36.

FIG. 37 shows an elevation of the structural bearing support 165 of FIG. 36, showing a slot 167 to receive an interchangeable vertical side plate 168 and an offset shoulder 300 to support the flange of the side plate 165. A horizontal-disassociation-cushioning-layer 17 is shown on top of the bearing support 165. FIG. 38 is a cross section cut through the structural bearing support 165 of FIG. 36 and illustrates a winged registry insert 203 having four crosswise upward-extending wings radially extended from a central shaft at 90 degree angles to registry position the modular-accessible-paver 188, 189 between extending wings of the inserts disposed within the adjacent corner joints of adjacent modular-accessible-pavers 188, 189 disposed over the structural bearing supports 165. The winged registry insert 203 has three or more concentric rings for insertion into a vertical aperture 173 to receive a registry shaft centered in the structural bearing support 165. The outer diameter of the concentric rings is slightly greater than the inner diameter of the female aperture to provide a desired withdrawal resistance due to the arching of the concentric rings upon insertion. Also shown are the slots 167 to receive the interchangeable vertical side plate 168 and an offset shoulder 300 to support the flange of the side plate 168. The bearing support 165 is adhered at its base to the bearing surface on which it rests by means of a sealant, an adhesive, or a layer of adhesive-backed foam 175.

Figure 39:
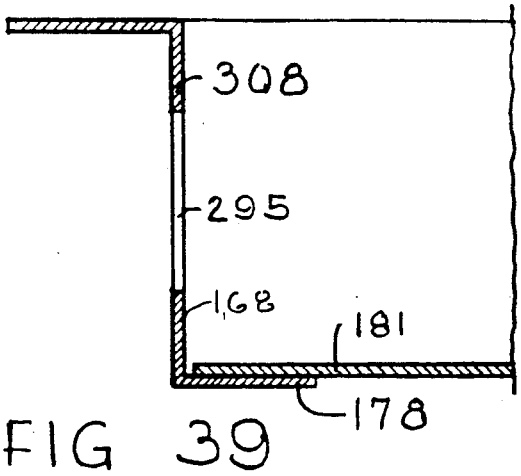
FIG. 39 is an enlarged, transverse, cross sectional view of an interchangeable vertical side plate for a modular accessible node box of this invention.
Figure 40:
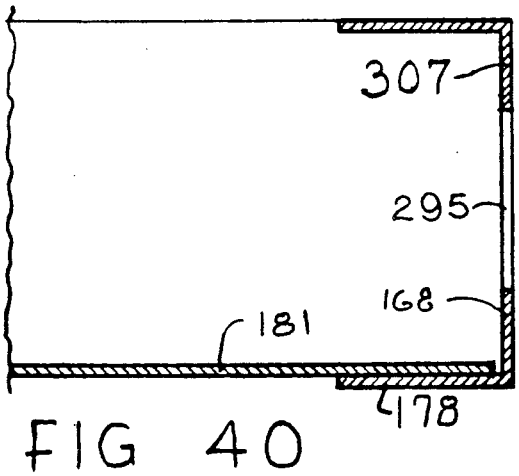
FIG. 40 is an enlarged, transverse, cross sectional view of an interchangeable vertical side plate for a modular accessible node box of this invention.
Figure 41:
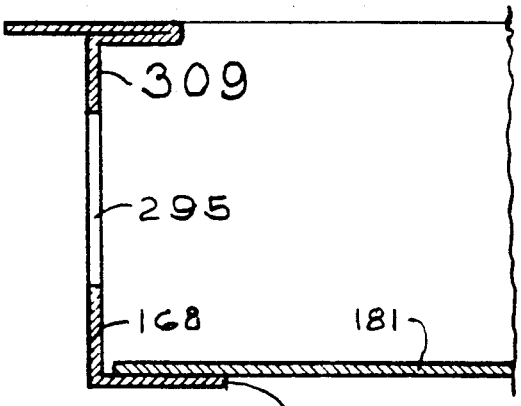
FIG. 41 is an enlarged, transverse, cross sectional view of an interchangeable vertical side plate for a modular accessible node box of this invention.
Figure 42:
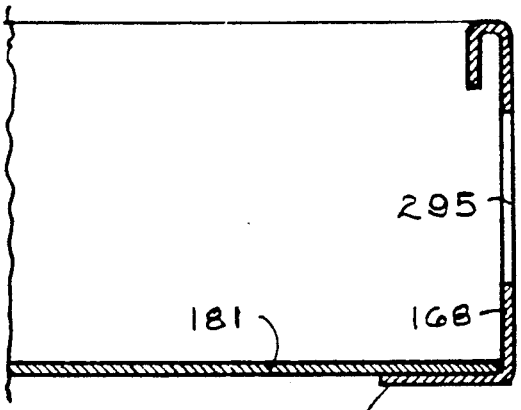
FIG. 42 is an enlarged, transverse, cross sectional view of an interchangeable vertical side plate for a modular accessible node box of this invention.
Figure 43:
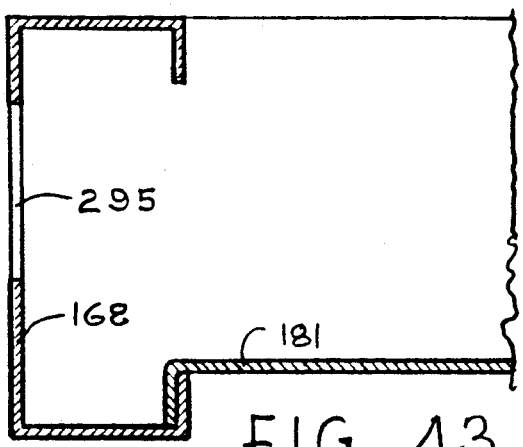
FIG. 43 is an enlarged, transverse, cross sectional view of an interchangeable vertical side plate for a modular accessible node box of this invention.
Figure 44:
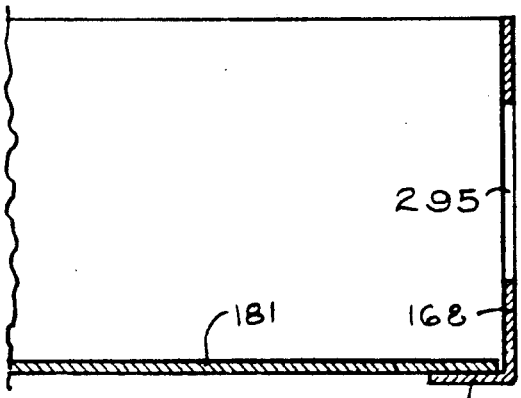
FIG. 44 is an enlarged, transverse, cross sectional view of an interchangeable vertical side plate for a modular accessible node box of this invention.

FIGS. 39–44 illustrate various configurations of the interchangeable vertical side plates 168 of the modular accessible node box 107 and show also the bottom plate 181 and knockout apertures 295 in the side plates accommodating different conductors and electrical devices. FIG. 39 shows a side plate 168 with an outward-facing top leg 308 and an inward-facing bottom leg 178. FIG. 40 shows an inward-facing top leg 307 and an inward-facing bottom leg 178. FIG. 41 shows an inward-facing and outward-facing top leg 309 and an inward-facing bottom leg 178. FIG. 42 shows a vertical side plate 168 with a folded-over top leg and an inward-facing bottom leg 178. FIG. 43 shows a channel-shaped vertical side plate 168 with a bottom plate 181 having a turned-down leg. FIG. 44 shows a vertical side plate 168 without an extended top leg and an inward-facing bottom leg 178.

Figure 45:
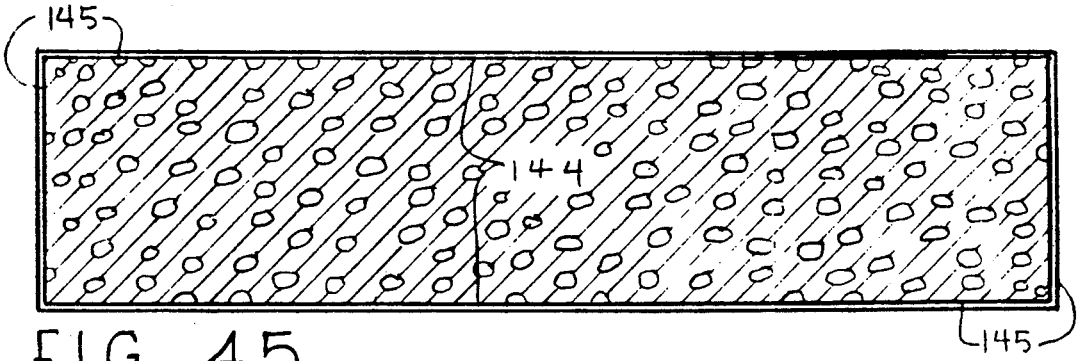
FIG. 45 is an enlarged, transverse, sectional view of the modular-accessible-paver of this invention.
Figure 46:
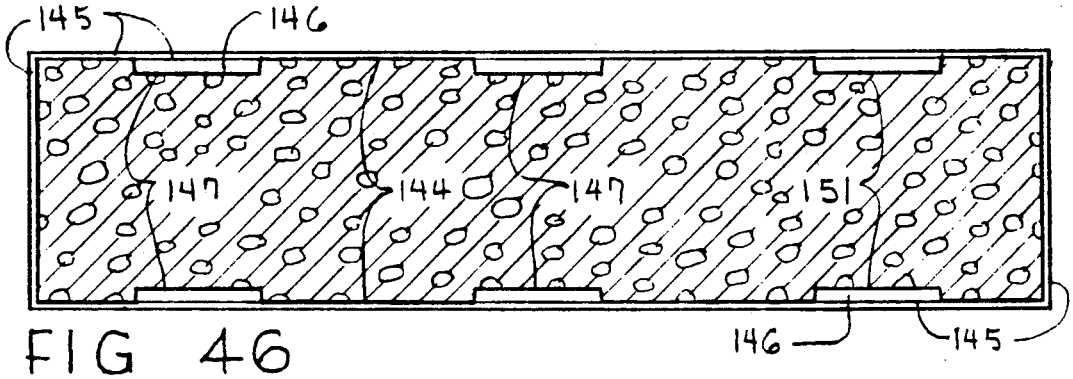
FIG. 46 is an enlarged, transverse, sectional view of the modular-accessible-paver of this invention.

FIGS. 45–52 illustrate variations of a modular-accessible-paver having two good wearing surfaces 189 with one or more tension reinforcement layers. FIG. 45 shows a moldcast compression and filler core 144, made of a castable settable mix, and a resin bonded protective wearing layer 145 on the opposing faces and all sides. FIG. 46 shows a moldcast compression and filler core 144, made of a castable settable mix, having high tension resin reinforcing grooves 147 in the opposing faces, indicating the area 151 in the opposing faces where the grooves 147 are located. A tension reinforcement resin layer 146 fills the grooves 147, and a resin bonded protective wearing layer 145 is bonded to and encapsulates the tension reinforcement resin layer 146.

Figure 47:
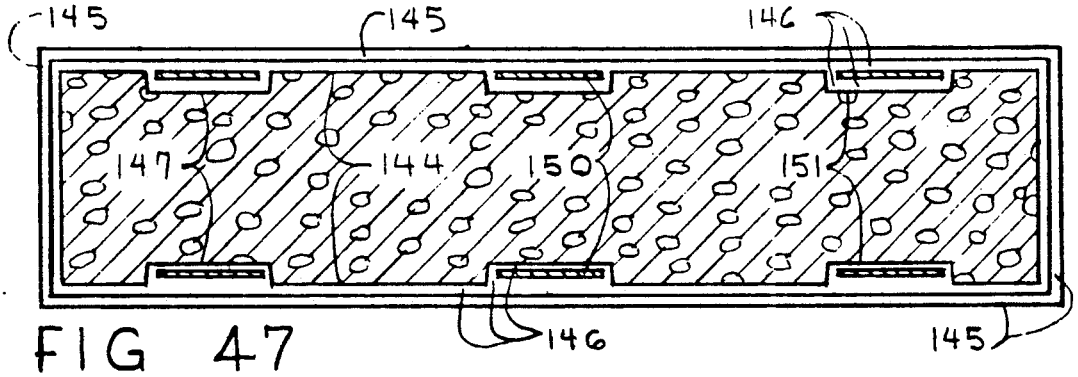
FIG. 47 is an enlarged, transverse, sectional view of the modular-accessible-paver of this invention.

FIG. 47 shows a moldcast compression and filler core 144, made of a castable settable mix, with the area 151 where high tension resin reinforcing grooves 147 are located. The grooves 147 have an external reinforcement 150 comprising reinforcing bars or mesh in addition to the tension reinforcement resin layer 146 filling the grooves 147 and bonding to the opposing faces and all sides of the moldcast core 144. A resin bonded protecting wearing layer 145 bonds to and encapsulates the tension reinforcement resin layer 146.

Figure 48:
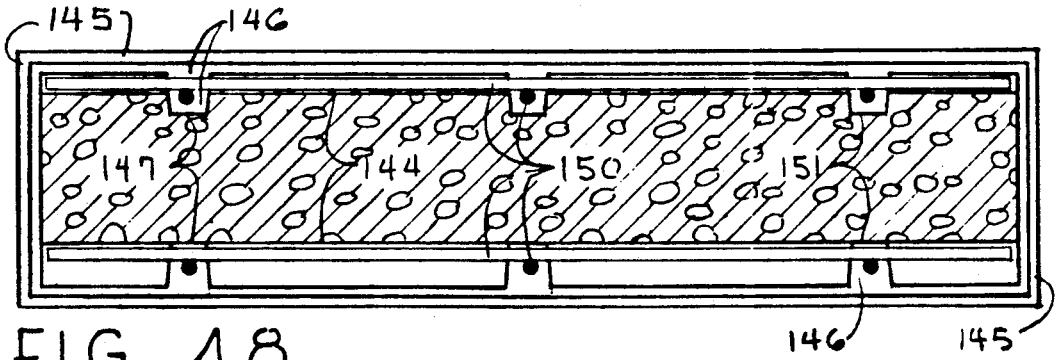
FIG. 48 is an enlarged, transverse, sectional view of the modular-accessible-paver of this invention.

FIG. 48 shows a moldcast compression and filler core 144, made of a castable settable mix, and the area 151 where the high tension resin reinforcing grooves 147 are located. The grooves 147 have an external reinforcement 150 comprising reinforcing rods in addition to the tension reinforcement resin layer 146. A resin bonded protective wearing layer 145 bonds to and encapsulates the tension reinforcement resin layer 146.

Figure 49:
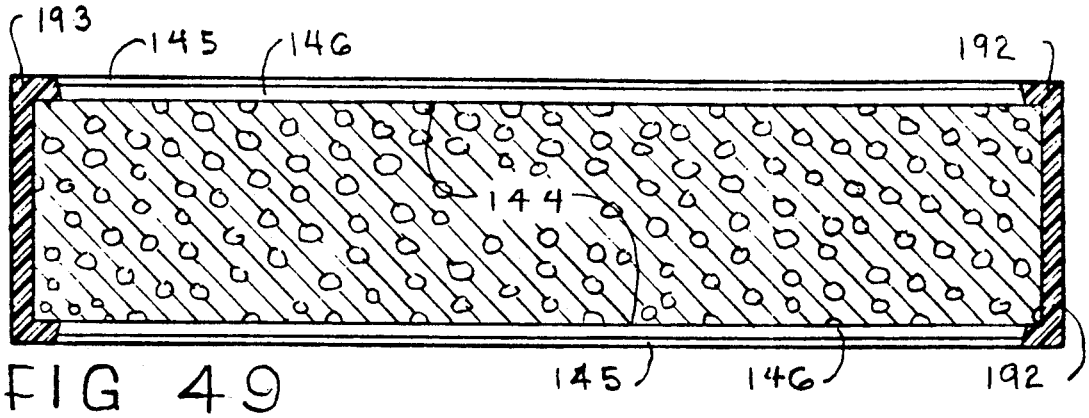
FIG. 49 is an enlarged, transverse, sectional view of the modular-accessible-paver of this invention.

FIG. 49 shows a moldcast compression and filler core 144, made of a castable settable mix, with a pre formed permanent perimeter edge having, for illustrative purposes, a channel shape with short legs and an inward beveled edge 192 or an outward beveled edge 193. The perimeter edge forms a very shallow containment to receive a tension reinforcing resin layer 146 and a resin bonded protective wearing layer 145 bonded to and encapsulating the tension reinforcing resin layer 146.

Figure 50:
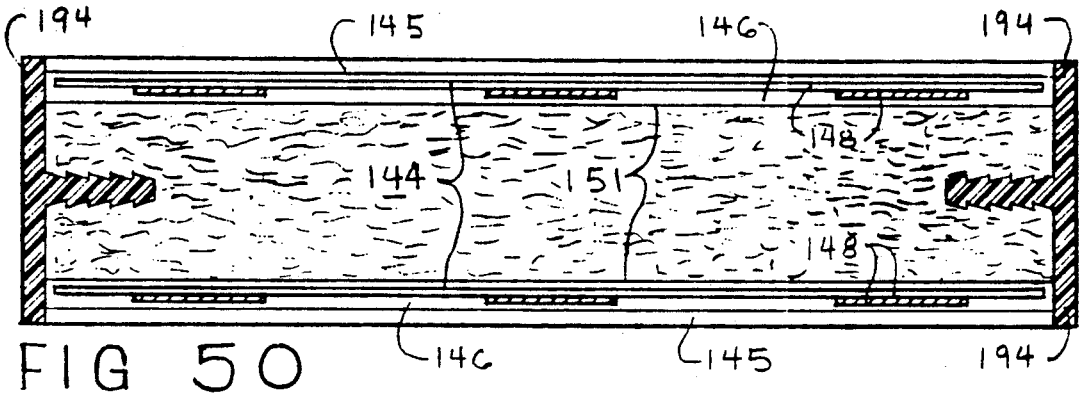
FIG. 50 is an enlarged, transverse, sectional view of the modular-accessible-paver of this invention.

FIG. 50 shows the area 151 where the grooves 147 are located to accommodate a high tension resin reinforcing grid 148 comprised of multiple layers of reinforcing. A T-shaped preformed permanent perimeter edge 194 has a projection embedded in the moldcast core 144, made of fiberboard or chipboard, or the like. The perimeter edge 194 forms a very shallow containment for a tension reinforcement resin layer 146 which is bonded to and encapsulated by a resin bonded protective wearing layer 145.

Figure 51:
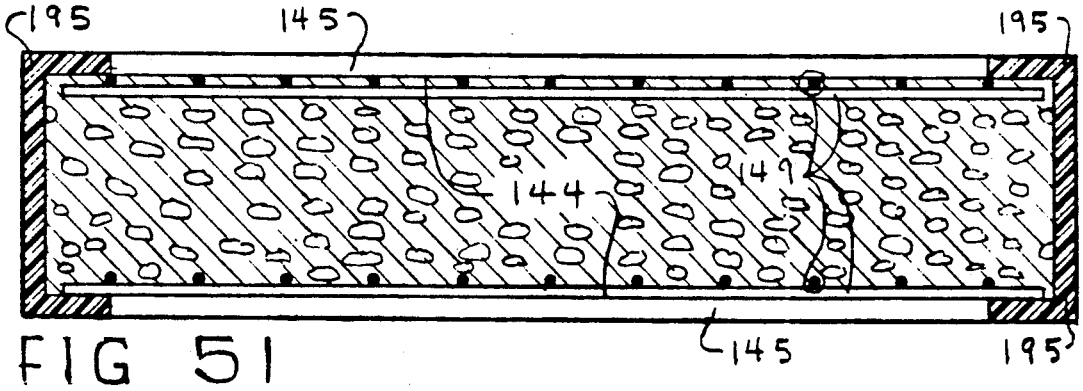
FIG. 51 is an enlarged, transverse, sectional view of the modular-accessible-paver of this invention.

FIG. 51 shows multiple layers of internal reinforcement placed close to the opposing faces of the moldcast compression and filler core 144, made of a castable settable mix. A channel-shaped preformed permanent perimeter edge 195 forms a very shallow containment for a single resin bonded protective wearing layer 145. Internal reinforcement 149 is also shown.

Figure 52:
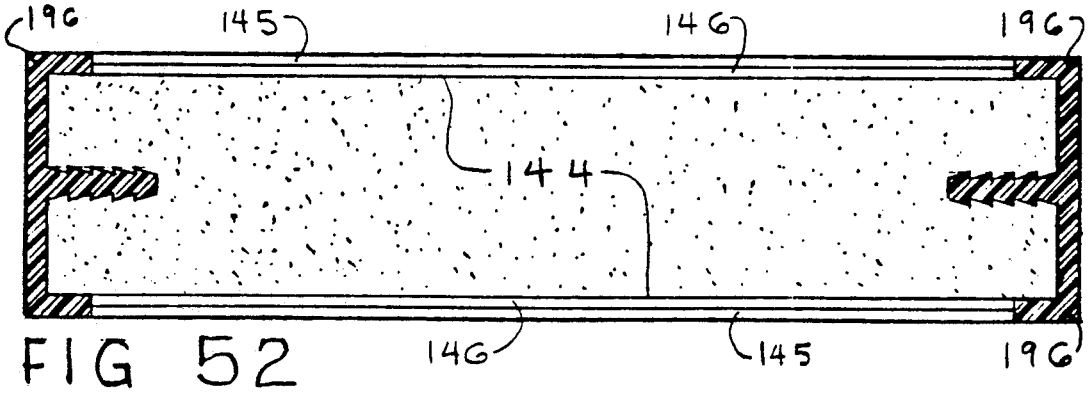
FIG. 52 is an enlarged, transverse, sectional view of the modular-accessible-paver of this invention.

FIG. 52 shows a moldcast compression and filler core 144, made of particleboard or a foam board, or the like, with a T-shaped channel preformed permanent perimeter edge 196 forming a very shallow containment for a tension reinforcement resin layer 146 bonded and encapsulated by a resin bonded protective wearing layer 145. The various alternative types of external reinforcement 150, internal reinforcement 149, perimeter edges 192–196, and varying thicknesses of the tension reinforcement resin layer 145 and resin bonded protective wearing layer 145 of FIGS. 45–52 are for illustrative purposes only and can be reconfigured into other combinations.

Figure 53:
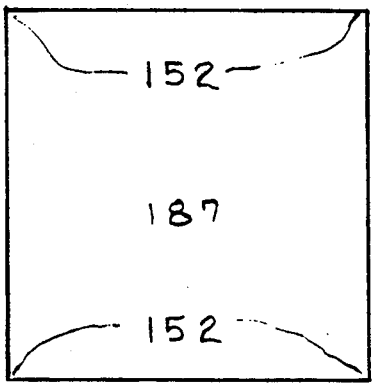
FIG. 53 is a top plan view of the suspended structural load-bearing modular-accessible-paver of this invention, illustrating all square corners.
Figure 54:
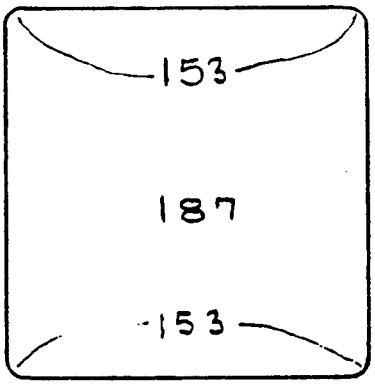
FIG. 54 is a top plan view of the suspended structural load-bearing modular-accessible-paver of this invention, illustrating all convex corners.
Figure 55:
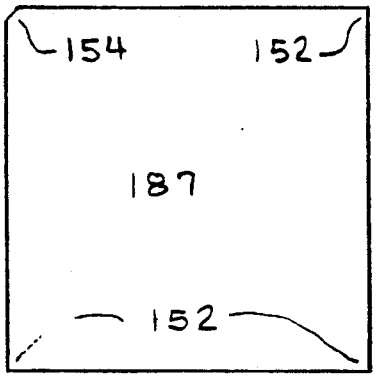
FIG. 55 is a top plan view of the suspended structural load-bearing modular-accessible-paver of this invention, illustrating one biased corner and three square corners.
Figure 56:
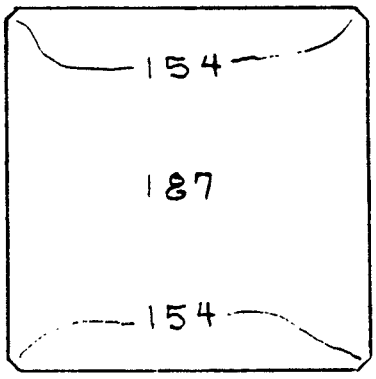
FIG. 56 is a top plan view of the suspended structural load-bearing modular-accessible-paver of this invention, illustrating all biased corners.
Figure 57:
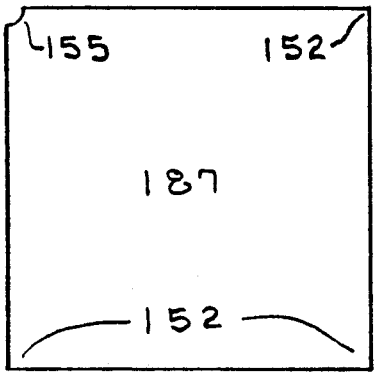
FIG. 57 is a top plan view of the suspended structural load-bearing modular-accessible-paver of this invention, illustrating one concave corner and three square corners.
Figure 58:
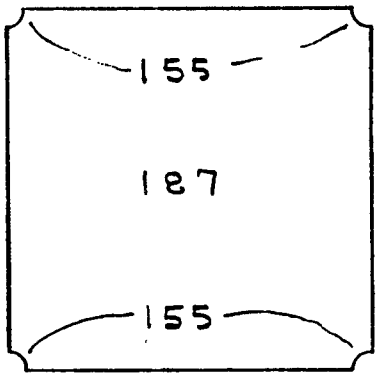
FIG. 58 is a top plan view of the suspended structural load-bearing modular-accessible-paver of this invention, illustrating all concave corners.
Figure 59:
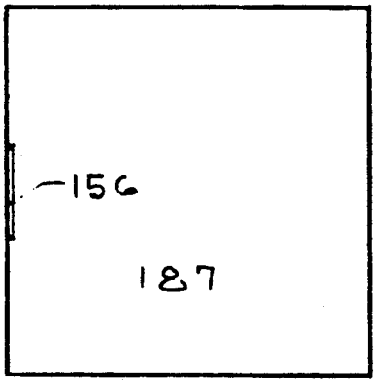
FIG. 59 is a top plan view of the suspended structural load-bearing modular-accessible-paver of this invention, illustrating a notch of shallow depth in the side of the paver to accommodate the passage of conductors.
Figure 60:
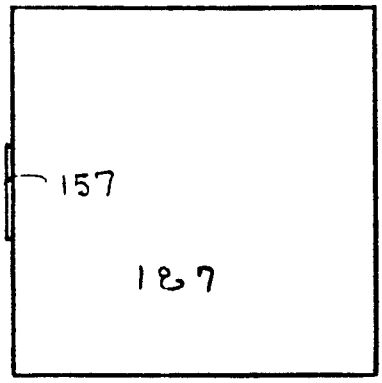
FIG. 60 is a top plan view of the suspended structural load-bearing modular-accessible-paver of this invention, illustrating a linear insert in a joint to control the passage of supply air and return air.

FIGS. 53–64 show variations in the modular-accessible-pavers 187. FIG. 53 shows all square corners 152. FIG. 54 shows all convex corners 153. FIG. 55 shows one biased corner 154 and three square corners 152. FIG. 56 shows all biased corners 154. FIG. 57 shows one concave corner 155 and three square corners 152. FIG. 58 shows all concave corners 155. FIG. 59 shows a flat notch 156 of shallow depth in the side of the modular-accessible-paver 187, allowing passage of conductors (flat conductor cable and ribbon conductor cable and the like.) FIG. 60 shows passage of conductors (flat conductor cable and ribbon conductor cable and the like) in a spaced-apart butt joint 157.

Figure 61:
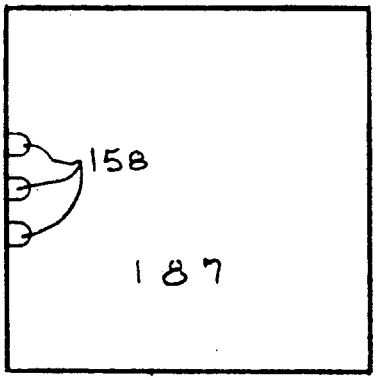
FIG. 61 is a top plan view of the suspended structural load-bearing modular-accessible-paver of this invention, illustrating rounded apertures at the edge of the paver to allow passage of conductors.
Figure 62:
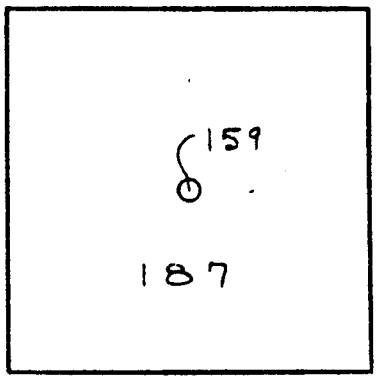
FIG. 62 is a top plan view of the suspended structural load-bearing modular-accessible-paver of this invention, illustrating a polygonally-shaped opening in the center of the paver to allow passage of conductors.
Figure 63:
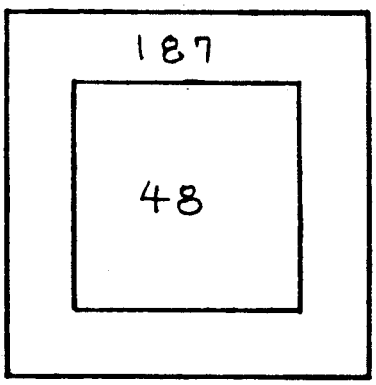
FIG. 63 is a top plan view of the suspended structural load-bearing modular-accessible-paver of this invention, illustrating an access cover covering an opening centered in the paver.
Figure 64:
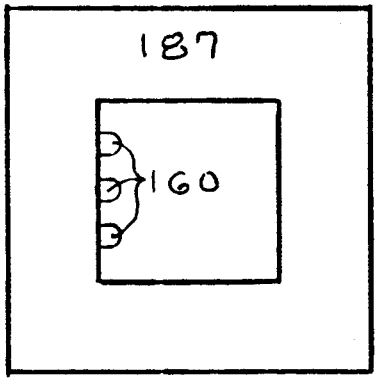
FIG. 64 is a top plan view of the suspended structural load-bearing modular-accessible-paver of this invention, illustrating an access cover covering an opening centered in the paver and having rounded apertures to allow the passage of conductors.

FIG. 61 shows rounded notches 158 inside a modular-accessible-paver 187, allowing the passage of conductors. FIG. 62 shows a conductor passage opening 159 of any polygonal shape (although a round opening is preferred) centered in a modular-accessible-paver 187. FIG. 63 shows a square decorative wearing surface load-bearing access cover 48 centered in a modular-accessible-paver 187. FIG. 64 shows a load-bearing access cover 160 with one or more rounded notches in the side to accommodate the passage of conductors, centered in a modular-accessible-paver 187.

Figure 65:
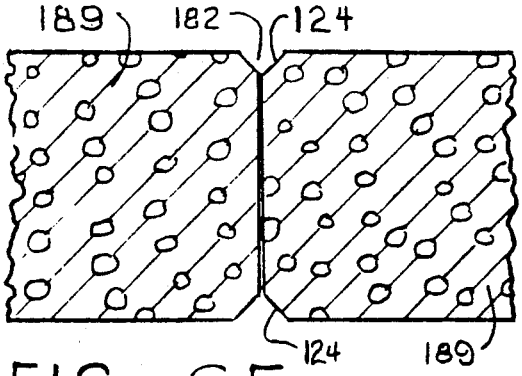
FIG. 65 is an enlarged, transverse, sectional view of the suspended structural load-bearing modular-accessible-paver of this invention.
Figure 66:
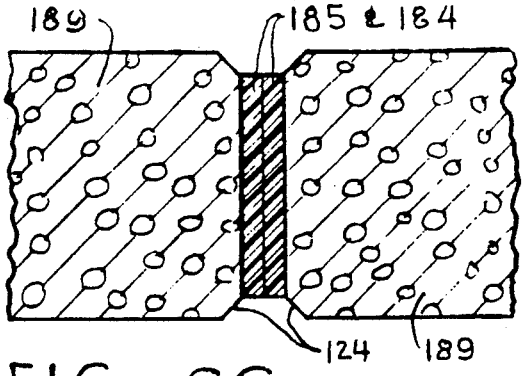
FIG. 66 is an enlarged, transverse, sectional view of the suspended structural load-bearing modular-accessible-paver of this invention.

FIGS. 65–72 shows cross sections of modular-accessible-pavers having two good wearing surfaces 189 and a variety of joints. FIG. 65 shows a tight butt joint 182 with beveled edges 124. FIG. 66 shows a spaced-apart joint 184 with beveled edges 124. A layer of foam is adhered to all sides of each modular-accessible-paver 189 so that the joint comprises two layers of foam 185.

Figure 67:
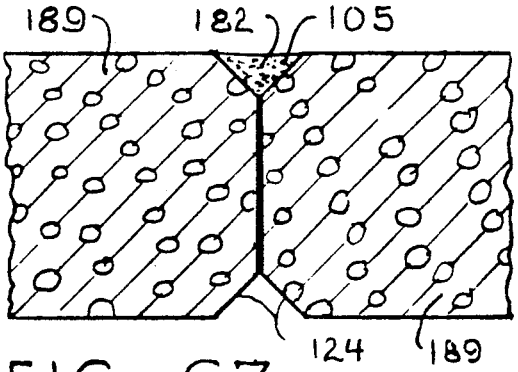
FIG. 67 is an enlarged, transverse, sectional view of the suspended structural load-bearing modular-accessible-paver of this invention.
Figure 68:
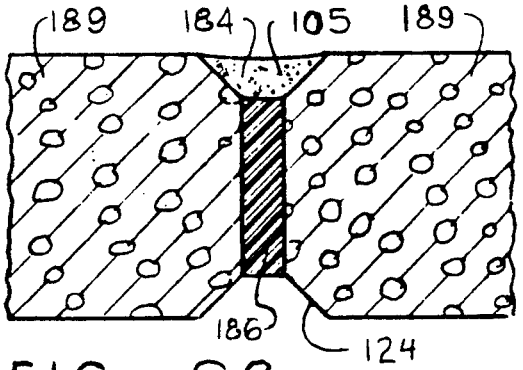
FIG. 68 is an enlarged, transverse, sectional view of the suspended structural load-bearing modular-accessible-paver of this invention.
Figure 69:
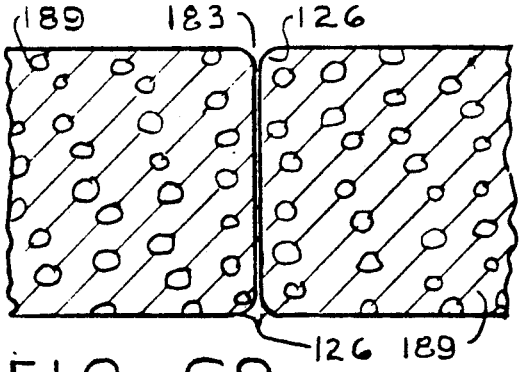
FIG. 69 is an enlarged, transverse, sectional view of the suspended structural load-bearing modular-accessible-paver of this invention.
Figure 70:
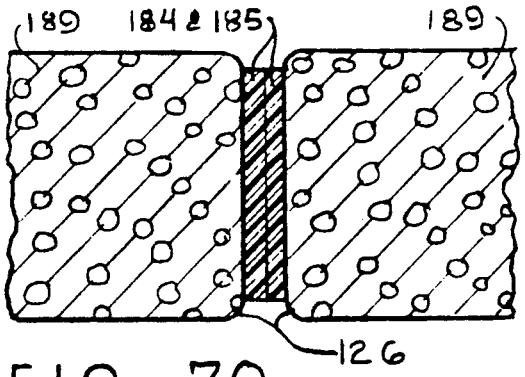
FIG. 70 is an enlarged, transverse, sectional view of the suspended structural load-bearing modular-accessible-paver of this invention.

FIG. 67 shows a tight butt joint 182 with beveled edges 124 and a cuttable and resealable flexible assembly joint 105 for assembly purposes and to provide fluid-tight joints. FIG. 68 shows a spaced-apart butt joint 184 with beveled edges 124, a layer of foam 186 adhered to alternating sides of the paver 189 so that the joint comprises one layer of foam 186, and a cuttable and resealable flexible assembly joint 105. FIG. 69 shows a fractionally spaced-apart butt joint 183 with convex rounded eased edges 126. FIG. 70 shows a spaced-apart butt joint 184 with eased edges 126. A layer of foam is adhered to all sides of each modular-accessible-paver 189 so that the joint is filled with two layers of foam 185.

Figure 71:
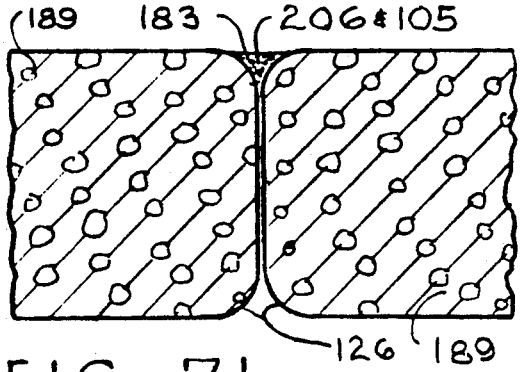
FIG. 71 is an enlarged, transverse, sectional view of the suspended structural load-bearing modular-accessible-paver of this invention.

FIG. 71 shows a fractionally spaced-apart butt joint 183 with eased edges 126 and an elastomeric sealant 206 in a cuttable and resealable flexible assembly joint 105.

Figure 72:
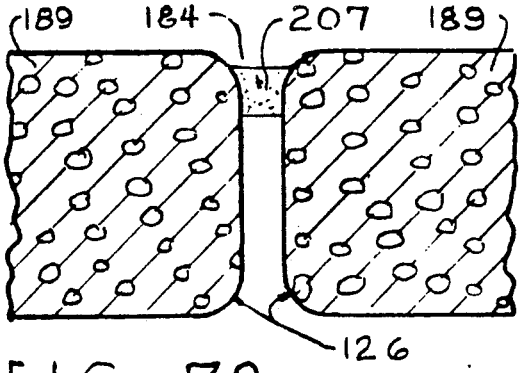
FIG. 72 is an enlarged, transverse, sectional view of the suspended structural load-bearing modular-accessible-paver of this invention.

FIG. 72 shows a fractionally spaced-apart butt joint 183 with eased edges 126 and an elastomeric sealant 206 in a cuttable and resealable flexible assembly joint 105.

The preferred embodiment of this invention is the Third Embodiment Of This Invention, depicted in the drawings by FIGS. 25–38, and discloses a paver floor system with accessible, flexible, reconfigurable conductor management for medium duty and heavy duty in industrial, warehousing, commercial and institutional buildings.

A concrete matrix as referred to in this disclosure is generally used in its broadest context to mean all types of cementitious concrete, all types of polymer concrete, and all types of gypsum concrete. The specification and the claims disclose modular-accessible-pavers which are part of the general category of modular-accessible-units. Modular-accessible-units also include the general design and construction of modular-accessible-tiles, modular-accessible-planks, and modular-accessible-matrices. Modular-accessible-units comprising cast plates in an open-faced bottom tension reinforcement containment, suspended structural load-bearing moldcast plates, and polygonally-shaped suspended structural load-bearing cast paver plates are more specifically disclosed.

All types of modular-accessible-units, modular-accessible-matrix-units, and modular accessible nodes may have carpet bonded as an applied wearing surface.

All types of modular-accessible-units and load-bearing three-dimensional-conductor-accommodative-passage-and-support-matrices may be disposed over a load-bearing support system or horizontal-base-surface. Typical examples of such load-bearing three-dimensional-conductor-accommodative-passage-and-support-matrices are arrays of load-bearing plinths, load-bearing channels, load-bearing modular accessible node boxes, or combinations thereof, the lower layer of lay-in and pull-through matrix conductors, as well as subgrades, granular substrate layers, or granular underdrain substrate layers.

Every three-dimensional-conductor-accommodative-passage-and-support-matrix and every load-bearing three-dimensional-conductor-accommodative-passage-and-support-matrix may have conductor channels disposed on one or more axes crosswise to one another, with the three-dimensional-conductor-accommodative-passage-and-support-matrix and the load-bearing three-dimensional-conductor-accommodative-passage-and-support-matrix providing separation of power conductors from all types of electronic conductors for increased safety, for electrical code conformance, and for enhanced electromagnetic interference and radio frequency interference control, the separation accomplished by physical means, such as channels, and the like.

The second and third preferred embodiments cover light duty, medium duty, and heavy duty industrial floors with accessible conductor accommodation management. The Second Embodiment, which is the second preferred embodiment and is depicted in the drawings by FIGS. 9–24, discloses suspended structural load-bearing cast paver plates supported by a load-bearing three-dimensional-conductor-accommodative-passage-and-support-matrix comprising the assembly bearing pads of this invention. The First Embodiment, which is the third preferred embodiment and is depicted in the drawings by FIGS. 1-8, discloses suspended structural load-bearing moldcast plates over the load-bearing three-dimensional-conductor-accommodative-passage-and-support-matrix of this invention.

The above has been offered for illustrative purposes only, and is not intended to limit the invention of this application, which is as further defined in the claims below.

I claim:

1. A paver floor system comprising a conductor-accommodating supporting layer disposed over a base surface and an array of removable pavers disposed over the supporting layer, characterized in that the supporting layer comprises a plurality of plinths arranged in a patterned layout and removably supporting said array of pavers, each of said plinths having a plurality of vertically extending slots, and a plurality of side plates selectively insertable into said slots to selectively define conductor-accommodating passages and node boxes which are accessible beneath said array of removable pavers.

2. A paver floor system according to claim 1, characterized in that said base surface comprises an earth base; and in that a plurality of modular structural plates is interposed between said earth base and said plinths.

3. A paver floor system according to claim 2, characterized in that a cushioning granular substrate is interposed between said earth base and said modular structural plates.

4. A paver floor system according to claim 2, characterized in that said pavers, said modular structural plates, and said plinths are made from a castable, settable mix.

5. A paver floor system according to claim 4, characterized in that said pavers, said plates, and said plinths are made from a castable, settable mix selected from the group consisting of cementitious concrete, polymer concrete, gypsum concrete, and gypsum.

6. A paver floor system according to claim 2, characterized in that said pavers and said modular structural plates are reinforced by one or more layers of reinforcement.

7. A paver floor system according to claim 4, characterized in that said mix for said plinths is strengthened by one or more mix consolidation means selected from the group consisting of vibration, shocking, and pressing.

8. A paver floor system according to claim 4, characterized in that said mix for said pavers and said plates comprises a durable wearing surface and is strengthened by means of metallic filings in at least the upper ⅛ inch (3 mm) of said paver.

9. A paver floor system according to claim 4, characterized in that said pavers, said modular structural plates, and said plinths are cast in permanent, disposable or reusable molds.

10. A paver floor system according to claim 4, characterized in that said mix comprises ingredients selected from the group consisting of cementitious-bound non-combustible aggregate and stone fillers and combustible shredded, chipped, and ground fiber fillers.

11. A paver floor system according to claim 1, characterized in that said base surface comprises a cushioning granular substrate disposed over an earth base; and in that a plurality of modular structural plates is interposed between said substrate and said plinths.

12. A paver floor system according to claim 11, characterized in that one or more layers selected from the group consisting of a vapor barrier, a flexible modular positioning layer, and one or more slip sheets is disposed above, below or within said cushioning granular substrate.

13. A paver floor system according to claim 11, characterized in that one or more layers selected from the group consisting of a vapor barrier, a flexible modular positioning layer, and one or more slip sheets is disposed above said modular structural plates.

14. A paver floor system according to claim 11, characterized in that fluid conductors for low Delta t heating and cooling are disposed above or below said modular structural plates or within said cushioning granular substrate.

15. A paver floor system according to claim 11, characterized in that said plinths are structural bearing supports integrally cast with said modular structural plates.

16. A paver floor system according to claim 11, characterized in that said plinths are structural bearing supports separately cast from said modular structural plates and adhered to said plates by means selected from the group consisting of sealants, adhesives and adhesive-backed foam.

17. A paver floor system according to claim 11, characterized in that said plates are aligned and kept in place by means of cuttable splines inserted in slots made in the sides of said plates.

18. A paver floor system according to claim 1, characterized in that said pavers are reversible and have two good opposing wearing faces.

19. A paver floor system according to claim 18, characterized in that one or more recessed aperture registry points is precision cast or drilled in one or both of said faces.

20. A paver floor system according to claim 1, characterized in that said pavers are reversible and have two good opposing wearing faces and a plurality of sides; and in that each said paver has a moldcast compression and filler core having two opposing faces and a plurality of sides; and in that a tension reinforcement resin layer is bonded to said faces and said sides of said core; and in that a resin bonded protective wearing layer is applied over and bonded to said tension reinforcement resin layer.

21. A paver floor system according to claim 1, characterized in that each said node box has a removable bottom closure plate.

22. A paver floor system according to claim 21, characterized in that said side plates have a bottom leg to receive said removable bottom closure plate.

23. A paver floor system according to claim 21, characterized in that said removable bottom closure plate is fastened to said side plates by means selected from the group consisting of mechanical fastening, adhesion, riveting, welding, and magnets.

24. A paver floor system according to claim 1, characterized in that said pavers have slots in their perimeter sides; and in that said pavers are aligned and kept in place by means of a plurality of removable flexible splines inserted into said slots.

25. A paver floor system according to claim 1, characterized in that said plinths have a vertical cross-sectional shape selected from the group consisting of a truncated cone, a truncated pyramid, a cylinder, a cube, an elongated cube, and any polygonal vertical cross-sectional shape having a flat top bearing surface and a flat bottom bearing surface.

26. A paver floor system according to claim 1, characterized in that said pavers have top and bottom edges selected from the group consisting of beveled, eased, and bullnose; and in that said edges facilitates the adhering of an elastomeric sealant for assembling said pavers into fluidtight arrays.

27. A paver floor system according to claim 1, characterized in that said base surface comprises a layer or rigid foam insulation.

28. A paver floor system according to claim 1, characterized in that one or more corners is removed from a plurality of said pavers to form apertures accommodating said node boxes at adjoining removed corners.

29. A paver floor system according to claim 28, characterized in that said corners removed from said pavers have a form in top plan view selected from the group consisting of a straight angle cut at a symmetrical angle, a rounded convex form, and a rounded concave form.

30. A paver floor system according to claim 28, characterized in that said node boxes have covers selected from the group consisting of solid covers, solid covers with one or more pass-through holes, hinged covers, lift-out lay-in covers with press-in and pull-out engagement, covers held in place magnetically, covers held in place mechanically by means of registry within said covers, covers held in place mechanically by means of registry within joints adjacent to said covers, and covers held in place by means of one or more fasteners.

31. A paver floor system according to claim 1, characterized in that said pavers have a top wearing surface, a bottom bearing surface and a plurality of sides; and in that said bottom bearing surface has one or more recessed or projecting aperture registry points for mating to said supporting layer.

32. A paver floor system according to claim 1, characterized in that said pavers are held in place over said supporting layer by gravity, friction, and assembly and have a flexible joint selected from the group consisting of unfilled tight butt joints, unfilled fractionally spaced-apart butt joints, and fractionally spaced-apart butt joints filled with foam and an elastomeric sealant.

33. A paver floor system according to claim 1, characterized in that said pavers are held in place over said supporting layer by gravity, friction, and registry assembly and have a flexible joint comprising a spaced-apart foam-filled joint formed by a layer of foam adhered to alternate sides of said pavers, providing thereby one layer in said joint in that a side having a layer of foam mates with a side having no foam.

34. A paver floor system according to claim 33, characterized in that an elastomeric sealant is placed in said joint above said foam.

35. A paver floor system according to claim 1, characterized in that said pavers are held in place over said supporting layer by gravity, friction, and registry assembly and have a flexible joint comprising a spaced-apart butt joint ranging in width from 1/16 inch (1.5 mm) to ¼ inch (6 mm); and in that said joint accommodates passage and closing off of return air and supply air through a linear insert in said joint.

36. A paver floor system according to claim 1, characterized in that said pavers are held in place over said supporting layer by gravity, friction, and registry assembly and have a flexible joint comprising a spaced-apart butt joint; and in that said pavers have beveled or eased top and bottom edges; and in that said joint comprises an unfilled joint or a cuttable, resealable elastomeric sealant joint formed in a fillet created between adjoining pavers.

37. A paver floor system according to claim 1, characterized in that said plinths comprise assembly bearing pads having conductor passages arranged in a cross layout beneath said adjoining removed corners.

38. A paver floor system according to claim 37, characterized in that said assembly bearing pads comprise one or more materials selected from the group consisting of virgin and recycled dense flexible foam, dense rigid foam, cementitious concrete, polymer concrete, gypsum concrete, gypsum, natural rubber, synthetic rubber, cast polymer injection-molded polymer, and metal.

39. A paver floor system according to claim 37, characterized in that a predetermined pattern layout of assembly bearing pad bearing points is marked on the top surface of a flexible modular positioning layer; and in that said bearing pads are loose laid on said bearing points.

40. A paver floor system according to claim 39, characterized in that a horizontal disassociation cushioning layer is loose laid above or below said supporting layer at least at said bearing points and provides cushioning underfoot and between brittle materials.

41. A paver floor system according to claim 39, characterized in that a horizontal disassociation cushioning layer is adhered to the bottom surface of said assembly bearing pads and to the bearing surface on which said pads rest.

42. A paver floor system according to claim 1, characterized in that said pavers are kept in position by means of registry inserts having a central shaft, concentric rings, and a spacer head having two or more wings to fit in the joints between said pavers to provide registry and positioning of said pavers; and in that said shaft fits into a female registry aperture in the top of said plinths.

43. A paver floor system according to claim 1, characterized in that each said paver has one or more registry apertures; and in that said aperture on the wearing surface of said paver is filled by a filler plug having a central shaft, concentric rings, and a head fitting into said aperture.

44. A paver floor system according to claim 1, characterized in that each said paver has one or more registry inserts having a central shaft and concentric rings; and in that the lower half of said insert fits into a female registry aperture in the top of said plinth and the upper half of said insert fits into a female registry aperture running the entire depth of said paver.

45. A paver floor system according to claim 1, characterized in that each said paver has one or more registry inserts having a central shaft and concentric rings; and in that the lower half of said insert fits into a female registry aperture in the top of said plinth and the upper half of said insert fits into a female registry aperture on the underside of said paver.

46. A paver floor system according to claim 1, characterized in that each said paver has one or more registry inserts having an externally threaded central shaft; and in that the lower half of said insert fits into an internally threaded female registry aperture in the top of said plinth and the upper half of said insert fits into a female registry aperture cast into the full depth of said paver.

47. A paver floor system according to claim 1, characterized in that each said paver has one or more mechanical screw holddown fasteners having a central shaft with external threads at one end and an integral round head at the opposing end; and in that said shaft fits into an aperture running the entire depth of said paver and then into an internally threaded aperture in said plinth; and in that said head has a mechanical torquing means selected from the group consisting of hexagonal, phillips, and slot.

48. A paver floor system according to claim 1, characterized in that each said paver has one or more mechanical screw holddown fasteners having a central shaft with external threads at one end and a polygonally shaped holddown head at the opposing end; and in that said shaft fits into an aperture running the entire depth of said paver and then into an internally threaded aperture in said plinth; and in that said head has a countersunk aperture accommodating a fastener with a countersunk head to provide a flush wearing surface.

49. A paver floor system according to claim 1, characterized in that each said paver has one or more mechanical push-pull holddown fasteners having a central shaft, concentric rings at one end, and an integral holddown head at the opposing end; and in that said shaft fits into an aperture running the entire depth of said paver and then into a female aperture in said plinth; and in that said concentric rings have a diameter slightly greater than the diameter of said female aperture, providing thereby a withdrawal resistance.

50. A paver floor system according to claim 1, characterized in that a winged registry insert is positioned within an aperture in said plinth and extends between adjacent corner joints of adjacent pavers; and in that each said registry insert comprises four crosswise upwardly extending wings radially extended from one end of a central shaft at 90 degree angles to registry position said pavers between said wings; and in that the opposing end of said shaft has a plurality of concentric rings; and in that said concentric rings are inserted into a female registry engagement aperture centered in each said plinth positioned beneath said corner joints.

51. A paver floor system according to claim 1, characterized in that a winged insert is positioned within adjacent corner joints of adjacent pavers; and in that each said registry insert comprises three upwardly extending wings radially extended from one end of a central shaft at 135, 90 and 135 degree angles to registry position said node boxes and said pavers between said wings; and in that the opposing end of said shaft has a plurality of concentric rings; and in that said concentric rings are inserted into a female registry engagement aperture centered in each said plinth positioned beneath said corner joints.

52. A paver floor system according to claim 4, characterized in that said mix forms said plinths by means selected from the group consisting of casting in a form, die forming, extrusion, and injection molding.

53. A paver floor system according to claim 1, characterized in that said side plates are interchangeable and have at least one knockout.

54. A paver floor system according to claim 20, characterized in that said moldcast core is reinforced by a top layer and a bottom layer of internal reinforcement; and in that said layers are spaced equidistantly from and close to said opposing faces of said core.

55. A paver floor system according to claim 20, characterized in that granular filler materials are seeded into one or more of said layers; and in that said granular filler materials are selected from the group consisting of sand, pea gravel, crushed gravel, crushed stone, glass beads, ceramic beads, carborundum, and conductive powder; and in that said resin bonded protective wearing layer bonds said granular materials to said core and to adjoining granular materials and forms a tension web layer around said granular materials.

56. A paver floor system according to claim 20, characterized in that said two opposing faces of said core contain a plurality of high tension resin reinforcing grooves on one or more axes; and in that said grooves are filled with a material comprising said tension reinforcement resin layer; and in that said grooves when filled comprise a high tension resin reinforcing grid bonded to both said opposing faces of said core and providing external reinforcement.

57. A paver floor system according to claim 56, characterized in that reinforcing is placed in said grooves; and in that said reinforcing is bonded to said core by means of said tension reinforcement resin layer filling said grooves.

58. A paver floor system according to claim 20, characterized in that said paver has a preformed permanent perimeter edge applied to all said sides; and in that said perimeter edge is fractionally deeper than said sides and forms a shallow containment to receive successive applications of said resin bonded protective wearing layer on said opposing faces of said core.

59. A paver floor system according to claim 58, characterized in that said perimeter edge comprises a configuration selected from the group consisting of a bar, a channel, a channel with two short legs having edges beveled inwardly or outwardly; a T, and a T-shaped channel.

60. A paver floor system according to claim 20, characterized in that said moldcast core comprises one or more materials selected from the group consisting of virgin and recycled metal, dense rigid foam, dense flexible foam, cast polymer, injection-molded polymer, plastic, elastomeric material, wood fibers, solid wood, laminated wood, plywood, microlam plywood, particleboard, oriented particleboard, hardboard, cementitious concrete, 61. A paver floor system according to claim 1, characterized in that said plinths are made from one or more materials selected from the group consisting of virgin and recycled metal, rigid foam, flexible foam, polymer, plastic, elastomers, wood, particleboard, and hardboard.

62. A paver floor system according to claim 4, characterized in that said mix comprises ingredients selected from the group consisting of resin-bound non-combustible aggregate and stone fillers and combustible shredded, chipped and ground fiber fillers.

63. A paver floor system according to claim 1, characterized in that said side plates are interchangeable and generally similar in height to said plinths.

64. A paver floor system according to claim 63, characterized in that said side plates accommodate discrete apertures to form evolutionary alterable node boxes to achieve uniaxial, biaxial, and multiaxial conductor accommodation on one or more levels within the height of said plinths in said supporting layer and to provide reconfigurability and recyclability of said paver floor system.

65. A paver floor system according to claim 1, characterized in that said node boxes are compartmentalized into two or more compartments to provide separation of power conductors from other conductors.

66. A paver floor system according to claim 65, characterized in that said separation of said conductors into said two or more compartments provides enhanced personal safety, conductor and equipment safety, and enhanced electromagnetic interference and radio frequency interference separative protection and confinement.

67. A paver floor system according to claim 65, characterized in that said compartments have one or more removable horizontal closure plates bearing on the top of said plinth or on an offset formed in said top.

68. A paver floor system according to claim 1, characterized in that said base surface comprises a concrete slab or subfloor.

69. A paver floor system according to claim 1, characterized in that said side plate shave one or two top projecting legs; and in that said top projecting legs bear on the top of said plinth or on an offset formed in said top.

70. A paver floor system according to claim 32, characterized in that said pavers are held in place over said supporting layer also by registry.

71. A paver floor system according to claim 1, characterized in that said pavers are held in place over said supporting layer by gravity, friction. and registry assembly and have a flexible joint selected from the group consisting of a spaced-apart foam-filled joint formed by a layer of foam adhered to all sides of said pavers, providing thereby two layers of foam in said joint, and a spaced-apart foam-filled joint formed by a layer of foam adhered to all sides of said pavers and covered by a layer of elastomeric sealant.

* * * * *